US007308853B2

(12) United States Patent
Satoh et al.

(10) Patent No.: US 7,308,853 B2
(45) Date of Patent: Dec. 18, 2007

(54) BULK PAPER FEEDING DEVICE WITH INTERMEDIATE CONVEYOR FOR IMAGE FORMING DEVICE

(75) Inventors: Keiichi Satoh, Miyagi (JP); Mituru Takahashi, Miyagi (JP); Tomotaka Osada, Miyagi (JP); Yoshiyuki Araseki, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 365 days.

(21) Appl. No.: 10/796,194

(22) Filed: Mar. 10, 2004

(65) Prior Publication Data

US 2004/0251589 A1 Dec. 16, 2004

(30) Foreign Application Priority Data

Mar. 11, 2003 (JP) ..... 2003-064490
Mar. 11, 2003 (JP) ..... 2003-064492
Mar. 11, 2003 (JP) ..... 2003-064503

(51) Int. Cl.
*B41L 13/00* (2006.01)

(52) U.S. Cl. ..... 101/118; 101/232; 271/110; 271/265.02

(58) Field of Classification Search ..... 101/116, 101/117, 118, 232; 271/10.01, 10.03, 110, 271/111, 258.01, 259, 265.01, 265.02
See application file for complete search history.

(56) References Cited

U.S. PATENT DOCUMENTS 5,441,247 A 8/1995 Quilliam
5,543,894 A * 8/1996 Carolan ..... 399/78
6,098,536 A * 8/2000 Ohkawa ..... 101/118
6,205,918 B1 * 3/2001 Takahashi et al. ..... 101/118

FOREIGN PATENT DOCUMENTS

JP 59-124633 7/1984
JP 5-18342 5/1993
JP 8-67061 3/1996
JP 8-259008 10/1996
JP 8-259009 10/1996
JP 10-45268 2/1998
JP 2002-226122 8/2002
JP 2002-326732 11/2002

* cited by examiner

*Primary Examiner*—Ren Yan
(74) *Attorney, Agent, or Firm*—Oblon, Spivak, McClelland, Maier & Neustadt, P.C.

(57) ABSTRACT

Provided is a bulk paper feeding device with an intermediate conveyor comprising a carrier capable of carrying a large quantity of paper, a paper feeding mechanism for picking up and feeding one sheet at a time of the paper from the carrier, and an intermediate conveyor for transporting a sheet of paper fed from the feeding mechanism to the main paper feeding table of the paper feeder on the body of the image forming device or to the vicinity of a paper feeding port that faces the main paper feeding means of the paper feeder.

7 Claims, 34 Drawing Sheets

Fig. 15

| PRINTING SPEED | PAPER LENGTH (FIRST TO EIGHT SENSORS) | PAPER SIZE | INITIAL POSITION OF PAPER TRAILING EDGE : BETWEEN SENSORS | MEASUREMENT OF TIME BETWEEN SENSORS IN SPEED MEASURING ZONE | 2ND SHEET INTAKE SENSOR (TRANSPORT TYPE) |
|---|---|---|---|---|---|
| 16rpm 30rpm | LONG SIZE | DLY, A3Y | 0-1 | 1-2 | 1ST SENSOR |
| | | B4Y, LEGAL Y | 1-2 | 2-3 | 2ND SENSOR |
| | SHORT SIZE | A4Y, B5Y, | 2-3 | 3-5 | 3RD SENSOR |
| | | A4T, LETTER T | 3-4 | 4-6 | 4TH SENSOR |
| | | B5T | 4-5 | 5-7 | 6TH SENSOR |
| OTHER SPEED | LONG SIZE | DLY, A3Y | 0-1 | 1-2 | 1ST SENSOR |
| | | B4Y, LEGAL Y | 1-2 | 2-3 | 2ND SENSOR |
| | SHORT SIZE | A4Y, B5Y, LETTER Y | 2-3 | 3-5 | 3RD SENSOR |
| | | A4T, LETTER T | 3-4 | 4-6 | 4TH SENSOR |
| | | B5T | 4-5 | 5-7 | 6TH SENSOR |

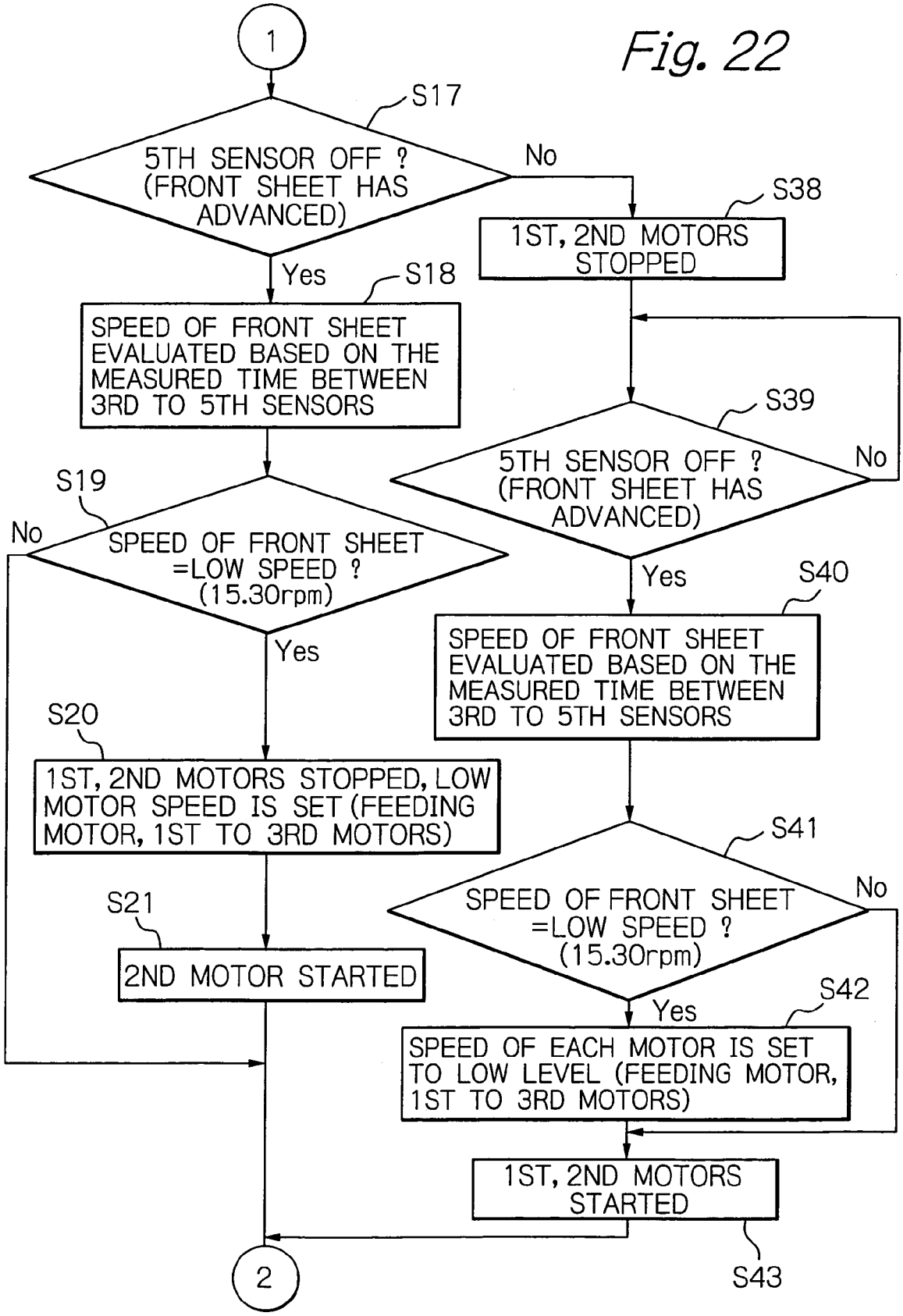
1
Fig. 22
S17
5TH SENSOR OFF ? (FRONT SHEET HAS ADVANCED)
No
S38
1ST, 2ND MOTORS STOPPED
Yes
S18
SPEED OF FRONT SHEET EVALUATED BASED ON THE MEASURED TIME BETWEEN 3RD TO 5TH SENSORS
S39
5TH SENSOR OFF ? (FRONT SHEET HAS ADVANCED)
No
S19
No
SPEED OF FRONT SHEET =LOW SPEED ? (15.30rpm)
Yes
S40
SPEED OF FRONT SHEET EVALUATED BASED ON THE MEASURED TIME BETWEEN 3RD TO 5TH SENSORS
Yes
S20
1ST, 2ND MOTORS STOPPED, LOW MOTOR SPEED IS SET (FEEDING MOTOR, 1ST TO 3RD MOTORS)
S41
SPEED OF FRONT SHEET =LOW SPEED ? (15.30rpm)
No
S21
2ND MOTOR STARTED
Yes
S42
SPEED OF EACH MOTOR IS SET TO LOW LEVEL (FEEDING MOTOR, 1ST TO 3RD MOTORS)
1ST, 2ND MOTORS STARTED
S43
2

BULK PAPER FEEDING DEVICE WITH INTERMEDIATE CONVEYOR FOR IMAGE FORMING DEVICE

BACKGROUND OF THE INVENTION

1. Field of the Invention

The present invention relates to a copier, printer, facsimile device, or other image-forming device, and particularly relates to a bulk paper feeding device having an intermediate conveyor for feeding paper to an image-forming device.

2. Description of the Background Art

Among copiers, printers, facsimile devices, and other image forming devices, an image forming device such as a printer, especially a stencil printer or offset printer, is suited for use in printing based on a plate created from a single original sheet, and large-volume printing from a single original sheet often involves printing several thousand sheets because, unlike a copier or the like, such a device uses the original image plate.

A bulk paper feeding device having an intermediate conveyor capable of feeding a large quantity of paper on which an image is to be formed by this type of printer or other image forming device is known, and an example thereof is depicted in FIGS. 1 through 6 of U.S. Pat. No. 5,441,247. This bulk paper feeding device having an intermediate conveyor is equipped with a carrier capable of carrying a large quantity of paper, a paper feeding mechanism for picking up and feeding one sheet at a time of the paper from the carrier, and an intermediate conveyor for transporting a sheet of paper fed from the feeding mechanism to the main paper feeding table of the paper feeder on the body of the printer. Placing a raisable intermediate conveyor on the main paper feeding table of the printer allows a paper sensor (reflecting photosensor) for detecting the presence of paper, mounted on the main paper feeding table, to be shielded, indicating that paper is present. In this state, a sheet of paper is picked up from the carrier by the paper feeding mechanism, the paper is transported by the intermediate conveyor to an appropriate position (under the main paper feeding roller) from which paper can be fed to the printer body, and the paper is then stopped.

After an operator, user, or the like (hereinafter referred to as "operator") confirms that the paper has been transported and stopped in the appropriate position, specifically, under the main paper feeding roller, the operator presses a print button corresponding to a plate-making switch or printing switch mounted on the printer body, whereupon the control device for the printer body assumes that paper is present on the main paper feeding table based on the signal indicating that the intermediate conveyor is covering the paper sensor on the main paper feeding table, and elevates the main paper feeding table until a correct-height sensor (transmission photosensor) is activated for detecting the height at which paper can be fed at the feed pressure of the main paper feeding roller, and the intermediate conveyor is elevated together with the elevation of the main paper feeding table while tilted via its attachment to the bulk paper feeding device. A standby mode (state in which paper can be fed) occurs when the correct-height sensor is activated, the paper on the intermediate conveyor is taken in to the printing body, and printing begins.

In keeping with recent increases in the speed of printers and copiers, this bulk paper feeding device having an intermediate conveyor as described in U.S. Pat. No. 5,441,247 is prepared for the production capability of such printers and copiers, and can be applied to various machines, is mobile, and has large storage capacity for paper.

However, this conventional bulk paper feeding device having an intermediate conveyor has such drawbacks as are described below.

(1) It is concluded that paper is present in the printer body and printing is initiated if the print button on the printer body is pressed when paper is not being fed to the intermediate conveyor, but since paper is not being fed, a paper feeding jam is determined to have occurred. Because of this, correcting the problem takes time because the operator cannot determine why the paper feeding jam occurred. In addition, mistakes in the operating procedure are more likely to occur because the operator is always changing, and since the printer cannot be operated properly when the operating procedure is not correctly followed, it is required that the operator be trained for the machine, and a great deal of skill is involved.

(2) When paper is no longer being fed to the carrier and intermediate conveyor during printing, paper jamming occurs because the absence of paper cannot be recognized by the printer body, or, specifically, because an offline state occurs in which there is no exchange of electrical signals between the printer and the bulk paper feeding device having an intermediate conveyor.

(3) After the print button is pressed, the intermediate conveyor is elevated while tilted, and printing becomes possible only after the correct-height sensor is activated, so some waiting time elapses while the main paper feeding table is elevated.

(4) When a dedicated bulk paper feeding table or conveyor device is connected to a direct shipping machine, an electrical connection must be established with the printer body, requiring that the wiring or exterior cover be disassembled and making this on-site conversion extremely inconvenient. Also, mistakes in wiring connections lead to serious problems, and the danger of electrocution gives this operation the potential for extreme danger.

(5) Because only paper of a size whose length is determined by the paper transport direction can be transported, the usage range of the paper becomes limited. Therefore, such a system cannot be used by a user of a stencil printer (hereinafter referred to as (stencil printer) that uses particularly varied paper sizes, including a copier, for example.

(6) Because printing cannot be performed except on paper whose size has a length determined as described in (5) above, there is no need to differentiate paper sizes. However, in a bulk paper feeding device with an intermediate conveyor that is compatible with various paper sizes, control for maintaining the distance between sheets during transport is simplified if the paper sizes can be differentiated. It becomes possible to maintain the distance between sheets without differentiating the paper size by increasing the number of sensors for detecting the trailing edge of the sheet in front transported earlier (hereinafter referred to as "front sheet") and the leading edge of the next transported sheet, but control in this arrangement is complex. Because of the resultant increase in cost, it is preferred that control be performed with as few sensors as possible.

(7) In order to achieve the object described in (6) above, it may be possible to mount a sensor on the carrier that would be equivalent to a paper length sensor for differentiating the length of the paper being used by the paper feeding table of a printing device or the like, but such a configuration would be complex and arranging the sensor wiring would be difficult, leading to increased cost. Also, the paper length sensor can classify paper only into two types of sizes above and below A4 transverse size.

(8) When accommodating printing speeds from a particularly low speed (16 rpm when versioning, for example) to the maximum speed (120 rpm, for example) such as with a stencil printer, for example, the subsequent sheet overtakes the front sheet transported at a low speed and drawbacks occur whereby both sheets are damaged, the sheets deform and jam, and not all speeds for paper feeding can be accommodated. Among printers, a large variety of papers are used in stencil printers in particular. Paper is generally classified as standard, thin, or thick, but because the. standard paper used regularly for bulk paper feeding itself includes high quality (high quality 55 kg paper, high quality stencil paper, and the like), medium quality, recycled paper, and the like, the conventional arrangement is not compatible with these papers.

(9) Because there is no one-way clutch attached to the transport roller of the intermediate conveyor, when using a thin paper whose surface has a comparatively large frictional coefficient, for example, a resistant load against paper transport is created during rotation of the paper feed roller, also known as the paper feed roll, in the body of the image forming device (hereinafter referred to as "device body"), leading to inadequate paper transport and possible jamming. Specifically, after it is confirmed that the paper has moved by the rotation of the paper feed roller of the device body, rotation starts for the transport roller of the intermediate conveyor located under the paper feed roller of the device body, making it difficult initially for the transport roller to rotate because of the load on the electric motor for rotatably driving the transport roller.

(10) Because guiding members for guiding the paper over the intermediate conveyor are mounted only in certain locations, the conventional bulk paper feeding device with an intermediate conveyor is not suited for transport of paper with inconsistent quality, in which there are wide variations in stiffness, such as groundwood paper, because with thin paper such as groundwood paper that has no stiffness (strength represented by flexural rigidity), the leading edge of the paper catches on protrusions (which characterize the jaggedness of the surface) on the paper feed roller of the device body, prompting tearing of the leading edge of the paper, paper damage, and jamming. The conventional approach is not compatible with stencil printers, in particular among printers.

Technologies relating to the present invention are also disclosed in, e.g., Japanese Patent Application Laid-open Nos. S59-124633, H8-67061, H8-259008, H8-259009, H10-45268, 2002-226122, and 2002-326732, and in Japanese Utility Model Publication No. H5-18342.

SUMMARY OF THE INVENTION

Therefore, an object of the present invention is to provide a bulk paper feeding device having an intermediate conveyor that is capable of transporting a particularly large number of paper sizes among various types of paper (more generally, sheet recording media), and that can feed paper so as to be compatible with low-speed to high-speed image forming without limiting the image forming speed that includes the printing speed in the body of an image forming device.

Another object of the present invention is to provide a bulk paper feeding device having an intermediate conveyor whereby it becomes possible to perform sequential transport without the trailing edge of the front sheet coming into contact with the leading edge of the subsequent sheet in the vicinity of the paper feeding means or the paper feeding port in the body of an image forming device even when there is no electrical connection (signal exchange) with the body of the image forming device, by detecting and recognizing in the bulk paper feeding device with an intermediate conveyor the paper size and transport speed of the paper transported by the intermediate conveyor.

In accordance with the present invention, there is provided a bulk paper feeding device with an intermediate conveyor. The bulk paper feeding device comprises a carrier capable of carrying a large quantity of paper, a paper feeding mechanism for picking up and feeding one sheet at a time of the paper from the carrier, and an intermediate conveyor for transporting a sheet of paper fed from the feeding mechanism to a main paper feeding table of a paper feeder on the body of an image forming device or to the vicinity of a paper feeding port that faces main paper feeding means of the paper feeder. The intermediate conveyor comprises paper transport means for transporting paper that has been fed from the paper feeding mechanism, disposed in a plurality at prescribed intervals from upstream to downstream along the intermediate transport path thereof, and paper detecting means for detecting at least one edge from among the leading and trailing edges of the paper being transported, disposed in a plurality at intervals from upstream to downstream along the intermediate transport path.

In accordance with the present invention, there is also provided a method for feeding paper by using a bulk paper feeding device with an intermediate conveyor. The bulk paper feeding device comprises a carrier capable of carrying a large quantity of paper, a paper feeding mechanism for picking up and feeding one sheet at a time of the paper from the carrier, and an intermediate conveyor for transporting a sheet of paper fed from feeding mechanism to a main paper feeding table of a paper feeder on the body of an image forming device or to the vicinity of a paper feeding port that faces main paper feeding means of the paper feeder. The sequential transport can be accomplished without the trailing edge of the front sheet, coming into contact with the leading edge of the subsequent sheet in the paper feeding means or the vicinity of the paper feeding port even when there is no electrical connection with the body of the image forming device, by detecting and identifying the size and transport speed of the paper being transported by the intermediate conveyor.

In accordance with the present invention, there is also provided a bulk paper feeding device with an intermediate conveyor. The bulk paper feeding device comprises a carrier capable of carrying a large quantity of paper, a paper feeding mechanism for picking up and feeding one sheet at a time of the paper from the carrier, and an intermediate conveyor for transporting a sheet of paper fed from the feeding mechanism to a main paper feeding table of a paper feeder on the body of an image forming device or to the vicinity of a paper feeding port that faces main paper feeding means of the paper feeder. The intermediate conveyor comprises paper transport means for transporting paper that has been fed from the paper feeding mechanism, a pair of guiding means for guiding paper that is transported by the paper transport means to the main paper feeding table or to the vicinity of the paper feeding port, and a chassis for accommodating the paper transport means and the pair of guiding means.

In accordance with the present invention, there is also provided a bulk paper feeding device with an intermediate conveyor. The bulk paper feeding device comprises a carrier capable of carrying a large quantity of paper, a paper feeding mechanism for picking up and feeding one sheet at a time of the paper from the carrier, and an intermediate conveyor for transporting a sheet of paper fed from the feeding mechanism to a main paper feeding table of a paper feeder on the body of an image forming device or to the vicinity of a paper feeding port that faces main paper feeding means of the paper feeder, at least one of paper length detecting means for detecting paper length, and paper presence detecting means for detecting the presence or absence of paper on the main feeding table, which are provided on the main feeding table, and a shutter mechanism, provided to the intermediate conveyor, for selectively shielding at least one of the paper presence detecting means and paper length detecting means.

BRIEF DESCRIPTION OF THE DRAWINGS

The above and other objects, features, and advantages of the present invention will become more apparent from the following detailed description taken with the accompanying drawings in which:

FIG. 15 is a chart summarizing the data and the like used for the paper transport control pattern in the present embodiment;

FIG. 22 is a continuation of the flowchart beginning in FIG. 21;

DESCRIPTION OF THE PREFERRED EMBODIMENTS

Figure 1:
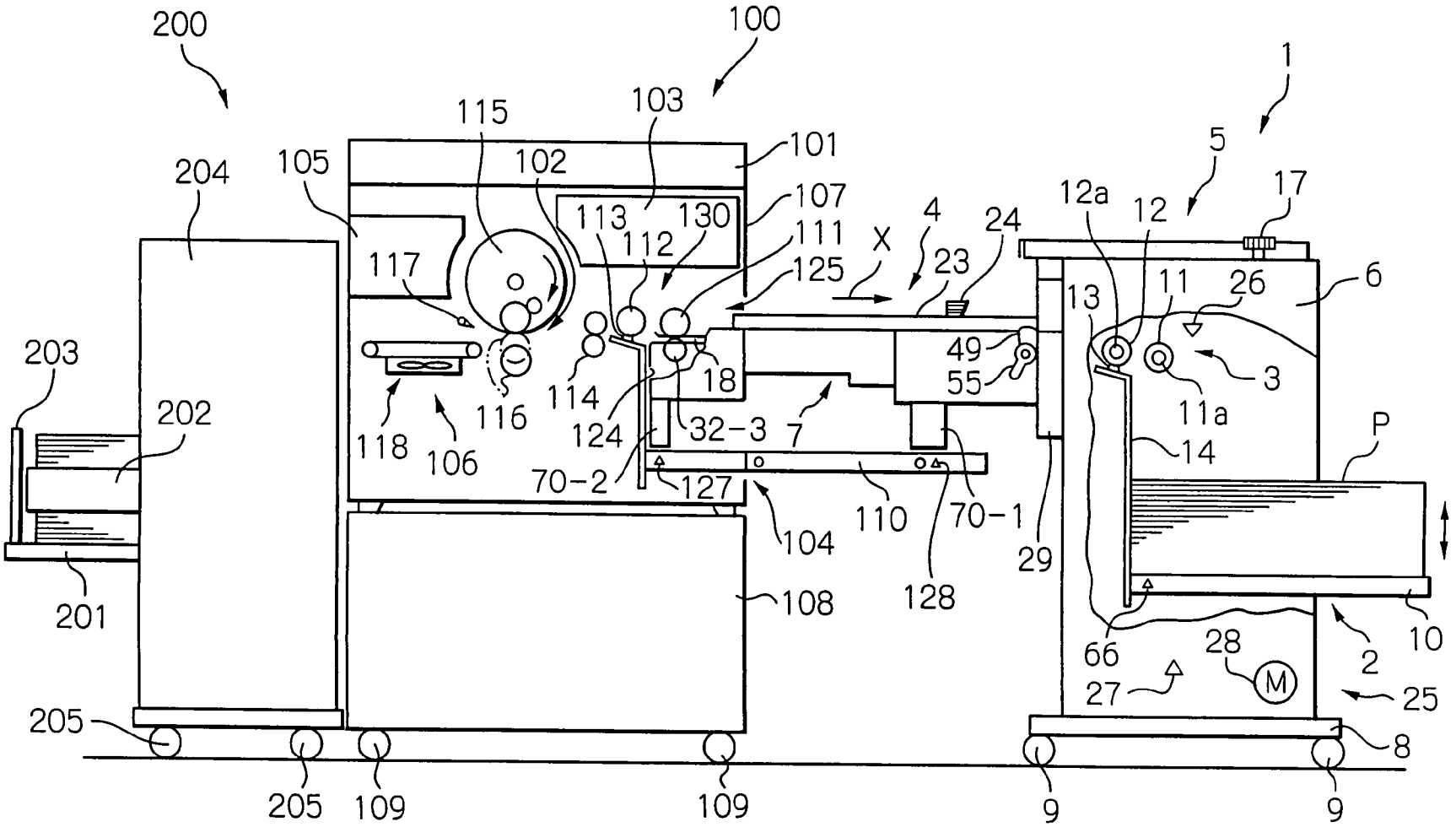
FIG. 1 is a schematic front cutaway view that depicts the overall structure of an apparatus in which a bulk paper transporting unit, stencil printer, and bulk paper delivery and storage unit are connected as relates to an embodiment of the present invention.

The present invention will be described in detail hereinafter with reference to the drawings.

Regarding embodiments, modifications, or the like of the present invention described hereinafter, after constituent elements (members or component parts) having the same function, shape, or the like are described once, subsequent description thereof is omitted by using the same symbols. Constituent elements in the drawings that are configured in pairs and require no separate description are instead described by appropriately noting one member of the pair in order to simplify the description thereof. In order to simplify the drawings and description, constituent elements that would otherwise be shown in the drawing are omitted as appropriate if these constituent elements require no special description in the drawing. When descriptions of constituent elements taken from unexamined patent application publications and the like are given, those elements are depicted with brackets placed around their symbols, and are distinguished from equivalent elements in the embodiments and the like of the present invention.

A description will first be given with reference to FIGS. 1 and 2 of the overall device configuration that includes the bulk paper feeding device with an intermediate conveyor pertaining to an embodiment of the present invention. In both figures, "1" indicates the bulk paper transporting unit described as a bulk paper feeding device with an intermediate conveyor, "100" indicates the stencil printer described as an example of an image forming device, and "200" indicates the bulk paper delivery and storage unit described as a bulk paper delivery and storage device.

The bulk feeding/transporting unit 1 is electrically connected with the bulk delivery and storage unit 200 by a power supply cable not shown in the drawing. Thus, there is no electrical connection between the bulk feeding/transporting unit 1 and the stencil printer 100, and a so-called "offline" state is established in which there is no exchange of signals between them. Also, the bulk feeding/transporting unit 1 can be attached to and detached from the stencil printer 100, the bulk delivery and storage unit 200 can be attached to and detached from the stencil printer 100, and FIG. 1 shows these components in their mechanically attached state.

Figure 2:
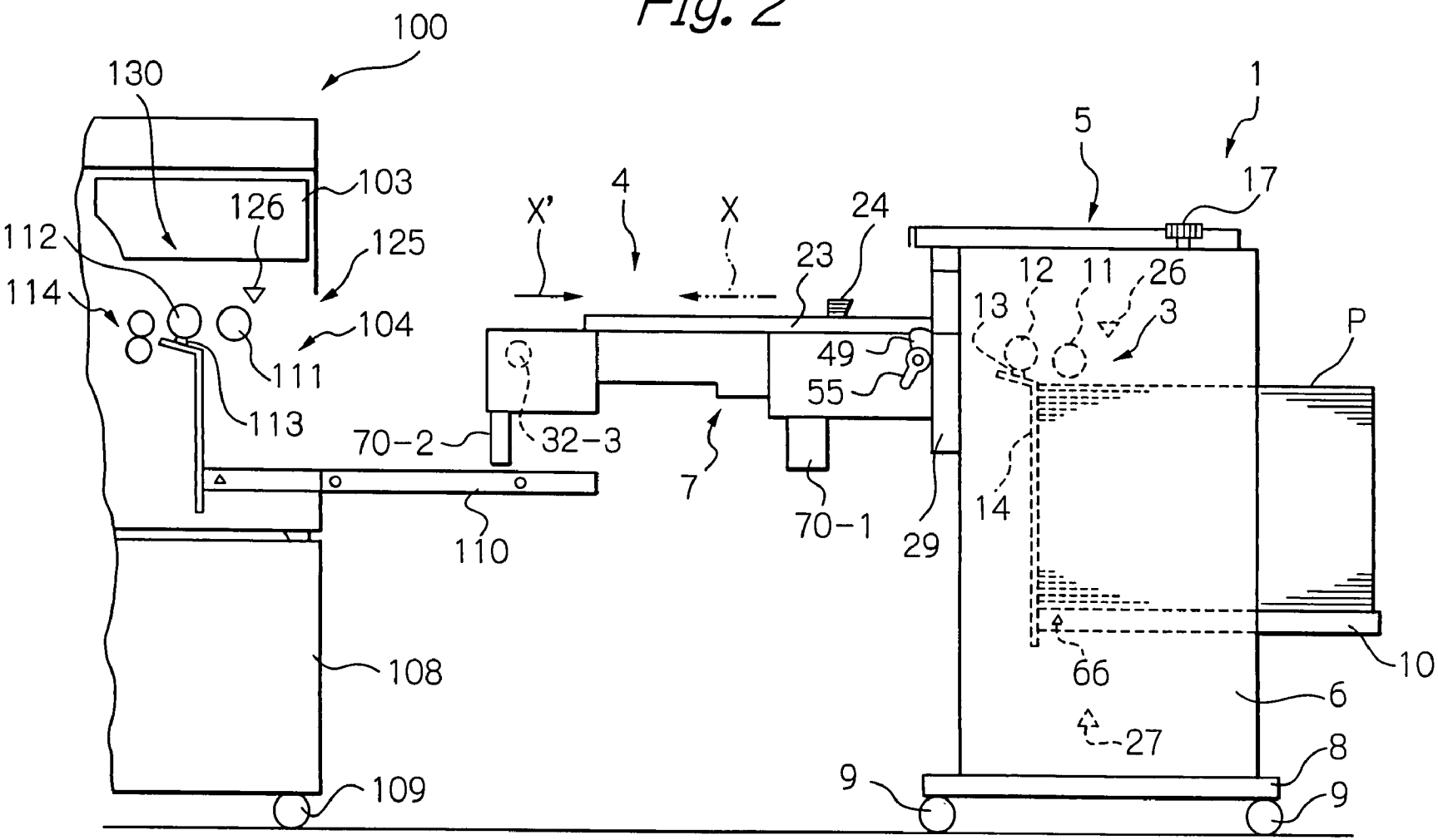
FIG. 2 is a schematic front view depicting a state in which the bulk paper-transporting unit occupies an unconnected position.

The bulk feeding/transporting unit 1 can be moved along the paper transport direction X, as shown in FIG. 1, into a connected position at which a third transporting roller 32-3 of the intermediate conveyor 4 described hereinafter is inserted under the main feeding roller 111 in the stencil printer 100, and are pressed against the external peripheral surface of the main feeding roller 111, whereby the paper P fed from the bulk feeding/transporting unit 1 can be securely transferred; and along the opposite direction X' from the paper transport direction X, as shown in FIG. 2, into an unconnected position in which the third transporting roller 32-3 of the intermediate conveyor 4 and the main feeding roller 111 are disengaged from each other. As described above, when the bulk feeding/transporting unit 1 occupies the connected position, the relationship between the positions is set such that the third transporting roller 32-3 receives a pressing force that corresponds to a moderate paper feed pressure from the main feeding roller 111.

In other words, as depicted in FIGS. 1 and 2, the bulk feeding/transporting unit 1 is configured so as to be movable between, first, a connected position in which paper P fed from the intermediate conveyor 4 can be taken in by the main feeding roller 111 and fed, by the bulk feeding/transporting unit 1 being moved along the paper transport direction X, such that the intermediate conveyor 4 constituting the bulk feeding/transporting unit 1 is placed on a main feeding table 110 retained at a prescribed height (in the present embodiment, the unit is placed on a main feeding table 110 in its minimum position, which is the lowermost position of the main feeding table 110 detected by a minimum detecting sensor (not pictured) disposed in the feeder side panel), or specifically, placed in a state occupying the minimum position without elevating the main feeding table 110, and, second, an unconnected position that is spaced apart from the aforementioned connected position, by being moved along an opposite direction X' from the paper transport direction X as depicted in FIG. 2.

As described above, the connected position is not limited to "a state occupying the minimum position without elevating the main feeding table 110," and may also be such that the main feeding table is slightly elevated from the minimum position to occupy a feedable position; specifically, a position in which the intermediate conveyor 4 is placed on the main feeding table 110 retained at a prescribed height, and paper P fed from the intermediate conveyor 4 can be received by the main feeding roller 111 and fed.

In FIGS. 1 and 2, "6" indicates a body chassis that forms the frame of the bulk feeding device body for accommodating the carrier 2 and feeding mechanism 3 (described hereinafter) of the bulk feeding/transporting unit 1; "7" indicates the chassis that forms the frame of the intermediate conveyor body (described hereinafter) of the bulk feeding/transporting unit 1; "107" indicates the body chassis that forms the frame of the body of the stencil printer 100 as the body of the image forming device; and "204" indicates the delivery unit chassis that forms the frame of the body of the bulk delivery and storage unit 200 as the body of the delivery and storage device.

For convenience of description, the stencil printer 100, bulk delivery and storage unit 200, and bulk feeding/transporting unit 1 will be described in order.

The stencil printer 100 has essentially the same structure as, for example, the stencil printer according to FIG. 1 of Japanese Patent Application Laid-open No. H8-67061. Specifically, the stencil printer 100 is equipped with an image reader 101 for reading a manuscript image, mounted on top of the body chassis 107; an engraving and plate feeding unit 103 for engraving and feeding a rolled thermal stencil master plate (not pictured) based on image information that has been read by the image reader 101 or on image information that has been input by a personal computer or other externally connected device (not pictured); a main feeder 104 consisting of a feeder in the body of the image forming device for separately feeding printing paper (hereinafter referred to simply as "paper") (not pictured) that is loaded onto the main feeding table 110, or paper P fed from the bulk feeding/transporting unit 1, towards a printing unit 102 described hereinafter; a printing unit 102 consisting of an image forming unit for forming a printed image on the paper P fed thereto, having a printing drum 115 provided with a plate cylinder on the external periphery thereof for winding a thermal stencil master (not pictured) produced with a plate feeding unit 103 or the like onto the external peripheral surface of the drum; and a delivery unit 106 or the like for delivering a printed image to the outside of the body chassis 107. The stencil printer 100 rests on a dedicated table 108 having casters 109, by means of the body chassis 107.

The main feeder 104 has a raisable main feeding table 110 for carrying paper P, disposed to the right of the body chassis 107; a main feeding roller 111 for sending the topmost sheet of paper (not pictured) on the main feeding table 110 or paper P fed from the bulk feeding/transporting unit 1; a main separating roller 112 for separating the sent paper P sheet by sheet and feeding the paper towards a pair of registering rollers 114; a main separating pad 113 consisting of a frictional member for separating the paper P sheet by sheet by cooperative operation with the main separating roller 112; and a pair of registering rollers 114 or the like for sending the paper separated/fed sheet by sheet to the printing unit 102 as an image forming unit at a prescribed timing.

The main feeding table 110 can fold so as to be capable of occupying a position that covers the feeding port 125 of the body chassis 107 and the position shown in FIG. 1. A paper-detecting sensor 127 consisting of a means for detecting the presence of paper on the main feeding table 110 and a paper length sensor 128 consisting of a means for detecting the length of the paper on the main feeding table 110 are disposed inside the main feeding table 110. The paper length sensor 128 constitutes a paper size detecting means for detecting both the longitudinal and transverse paper sizes in conjunction with the movement of a pair of side fences on either side (not pictured) as they align the paper, and is capable of moving on the main feeding table 110 in the paper width direction Y. Both the paper-detecting sensor 127 and the paper length sensor 128 consist of reflecting photosensors (sometimes referred to hereinafter simply as "reflecting sensors") provided with a light emitting element and a light receiving element. Consequently, both the paper-detecting sensor 127 and the paper length sensor 128 consist of detecting means that are switched to an ON or OFF signal by being mechanically opened and closed using a shutter described hereinafter as a shield member, or, in other words, by selective shielding/light blocking action.

Figure 3:
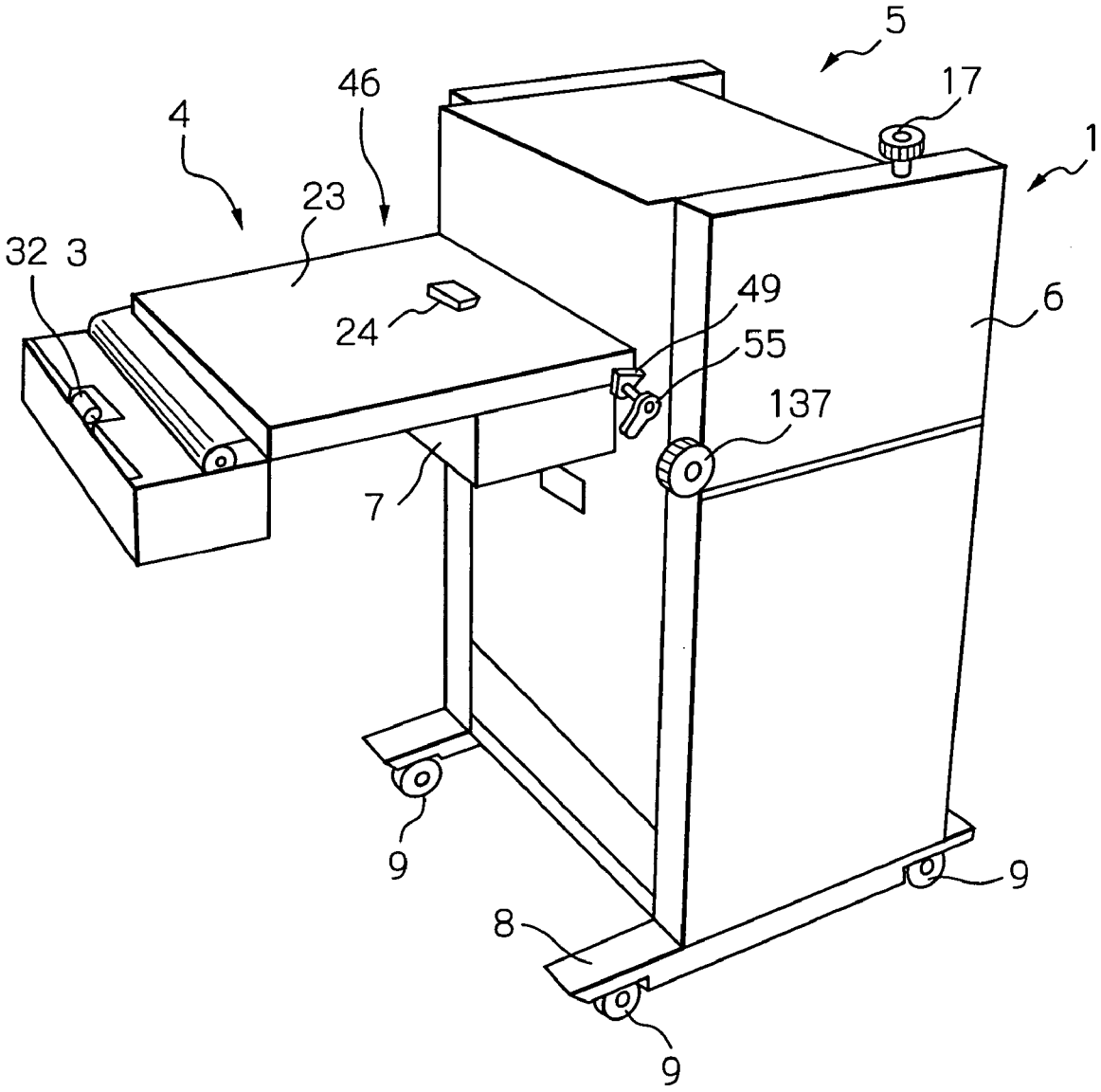
FIG. 3 is an oblique view depicting the appearance of the bulk paper-transporting unit as viewed from the front.
Figure 8:
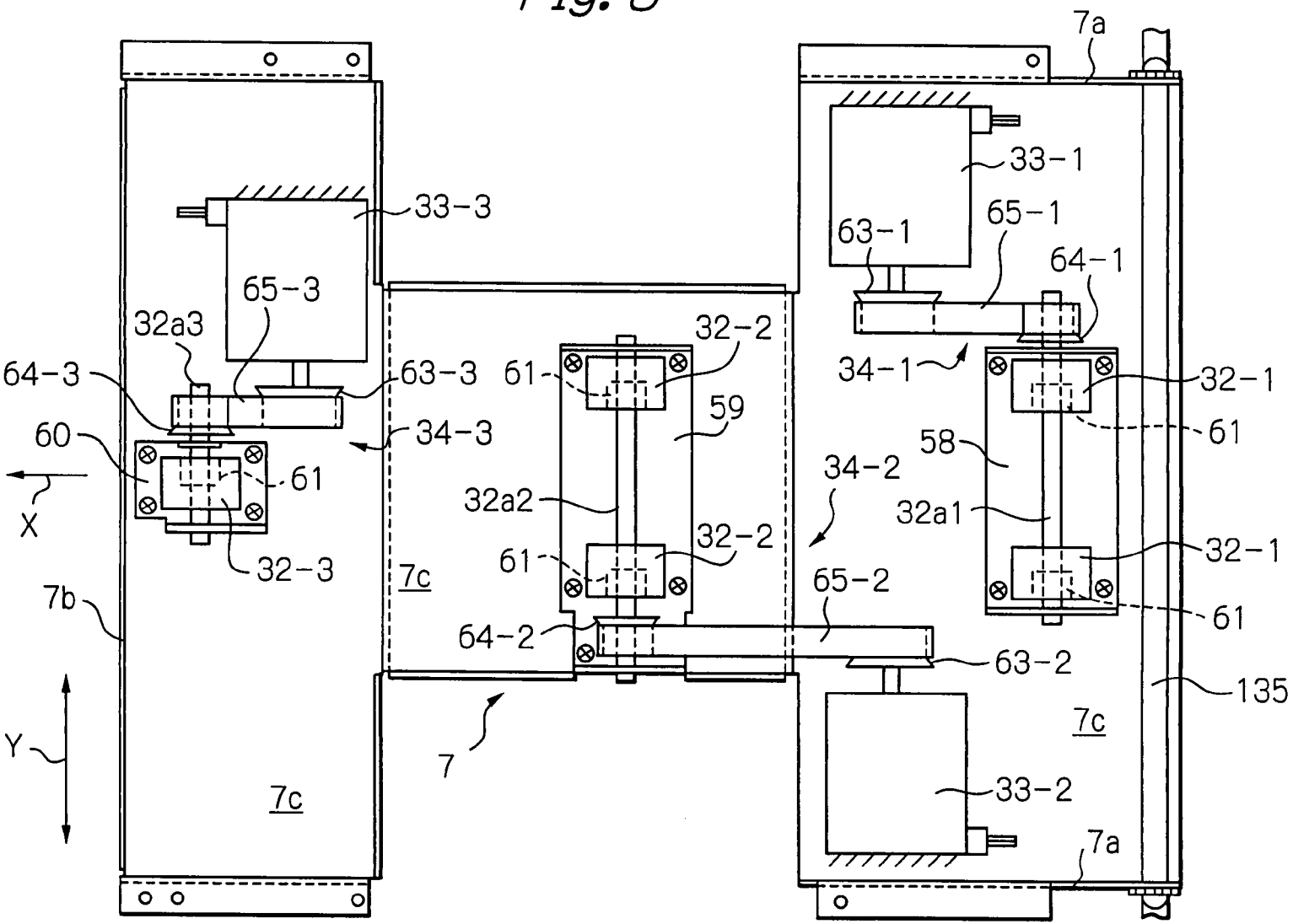
FIG. 8 is a plan view depicting the primary structure around the chassis with the top cover, upper guide plate, and lower guide plate removed.

The main feeding table 110 employs, for example, a hoisting mechanism provided with the same structure as the automatic intermittent hoisting mechanism depicted in FIGS. 3 and 8 of the aforementioned Japanese Utility Model Publication No. H5-18342, and is capable of being raised and lowered and carrying a plurality or a large number of sheets of paper P. By means of the aforementioned hoisting mechanism, the main feeding table 110 is driven up and down in a controlled manner so that the top sheet of the loaded paper is in a feeding position so as to contact the main feeding roller 111 at a prescribed feed pressure (pushing pressure at which the paper can be transported).

The hoisting mechanism of the feeding roller 111 is not limited to the aforementioned arrangement, and a mechanism that uses a wire or the like such as is depicted in FIG. 1 of Japanese Patent Application Laid-open No. S59-124633, for example, may also be used.

The main feeding roller 111 constitutes the feeding means of the main feeder 104. The main separating roller 112 and main separating pad 113 constitute the separating and feeding means of the body chassis 107. Also, the feeding means is not limited to the arrangement described above, and also includes an arrangement made up of a combination of a feeding roller and separating pad, or a pair of separating rollers. A friction separation system such as the aforementioned separating and feeding means, or a friction pad separating system, has the advantage of simple configuration and low cost in comparison to a so-called reverse roller separating system in which paper is separated/fed sheet by sheet with a pair of two separating rollers.

Figure 9A:
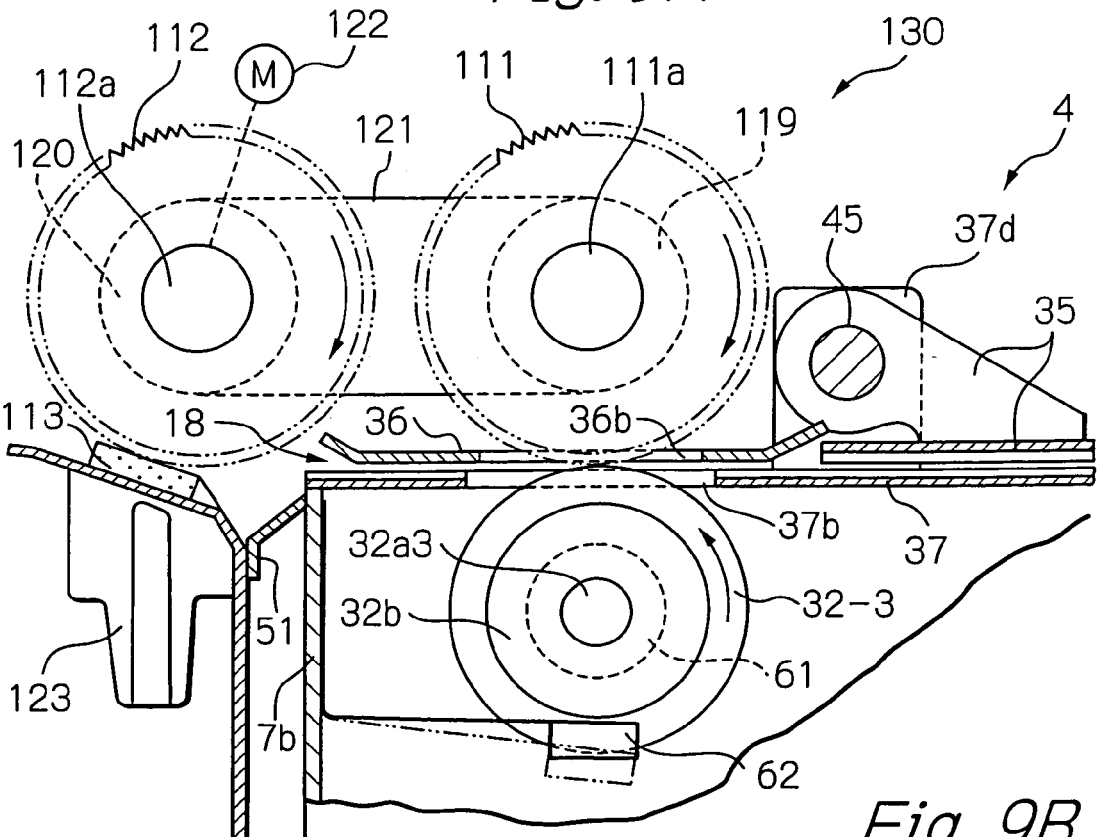
FIGS. 9A and 9B are cross-sectional views depicting the primary structure around the intermediate conveyor in a state in which the stencil printer is connected with the bulk paper delivery and storage unit.
Figure 9B:
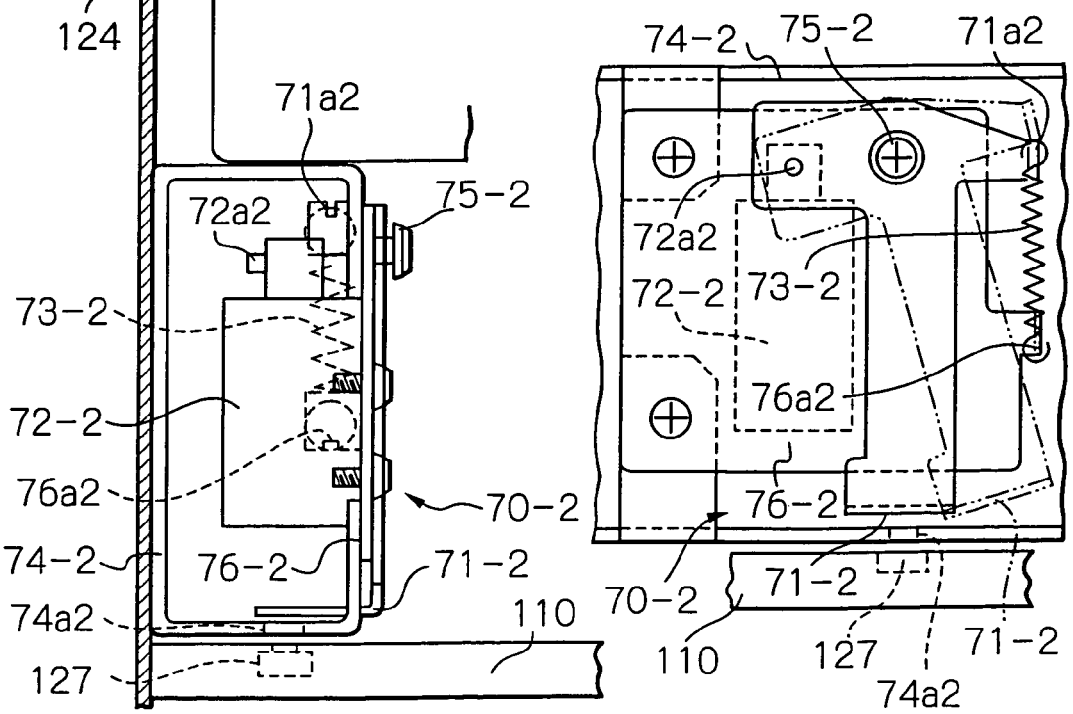

As depicted in detail in FIGS. 9A and 9B, the main feeding roller 111 is mounted on a feed side panel (not pictured) of the body chassis 107 in the feeding port 125 of the main feeder 104 so as to be able to pivot and rotate around the shaft 111*a* at the free end of a feeding arm (not pictured) (in a cross-sectional horseshoe shape that opens downward) that is supported so as to be able to pivot about the shaft 112*a* of the main separating roller 112. The main feeding roller 111 and main separating roller 112 are rotatably driven by a main feeding mechanism 130 depicted in FIGS. 9A and 9B, which is the same as the feeding drive means (30) depicted in FIGS. 1 through 3 of the aforementioned Japanese Patent Application Laid-open No. 2002-326732, for example.

Specifically, as shown by the simplified depiction in the diagrams, a one-way clutch (not pictured) is disposed between the main feeding roller 111 and the shaft 111*a* thereof, and between the main separating roller 112 and the shaft 112*a* thereof. A timing pulley 119 is mounted on the shaft 111*a* of the main feeding roller 111, and a timing pulley 120 is mounted on the shaft 112*a* of the main separating roller 112. A timing belt 121 is passed between the timing pulley 119 and timing pulley 120, and the main separating roller 112 and main feeding roller 111 transmit driving force to one another via the timing belt 121 and one-way clutches (not pictured). The clutch locking direction (linking direction of the driving force) of the one-way clutches not pictured in the diagrams is set to the clockwise direction indicated by the arrows in the diagram, in which the main separating roller 112 and main feeding roller 111 are rotated so as to separate and feed the paper P. By this means, the main separating roller 112 and main feeding roller 111 can rotate only in a clockwise direction. The main separating roller 112 is rotatably driven by means of a feeding motor 122 constituting the main feed drive means.

The shaft 112*a* of the main separating roller 112 and the output shaft of a feeding motor 122 (not pictured) transmit driving force to one another via timing pulleys (not pictured) and a timing belt (not pictured) extended between the timing pulleys. The feeding motor 122 consists of a stepping motor. Consequently, in the case of paper feeding, by the normal rotation of the feeding motor 122, for example, the main separating roller 112 and main feeding roller 111 rotate together in a clockwise direction, and the topmost sheet of paper (not pictured) loaded on the main feeding table 110 or paper P fed from the bulk feeding/transporting unit 1 is fed towards the pair of registering rollers 114 depicted in FIG. 1.

A feeding filler (not pictured), also referred to as a flash barrier, is attached to the aforementioned feeding arm. A correct-height detecting sensor 126 (see FIG. 2) made up of a transmission photosensor (hereinafter referred to simply as "transmission sensor") provided with a light emitting element and light receiving element for detecting the feeding position is affixed to an immobile member (not pictured) disposed in the body chassis 107 near the aforementioned feeding filler, so as to selectively straddle the free end of the aforementioned feeding filler. In FIGS. 9A and 9B, "123" indicates a movable separating pad holder for containing a compression spring consisting of a biasing member for biasing the main separating pad 113 in the direction in which pressure is applied to the external peripheral surface of the main separating roller 112; and "124" indicates a front surface plate for aligning the leading edges of paper (not pictured) loaded on the main feeding table 110.

The printing unit 102 is disposed in the substantial center of the body chassis 107, and has a printing drum 115 provided on the inside with ink supplying means, for winding a master plate created on the external peripheral surface; a press roller 116 consisting of pressing means for pressing paper P fed from the main feeder 104 or bulk feeding/transporting unit 1 onto the external peripheral surface of the printing drum 115 and transferring ink thereto; and the like. A press cylinder or the like provided with a paper clamp (retaining means) substantially equal in external diameter to the printing drum 115, for retaining the leading edge of paper on the external periphery of the printing drum 115, is also used as the pressing means.

The delivery unit 106 is disposed on the left side of the body chassis 107, and has a takeoff catch 117 for peeling printed paper from the external peripheral surface of the printing drum 115; a suction transporting unit 118 for using suction to deliver the peeled paper from the paper delivery port (not pictured) of the body chassis 107 to an externally located bulk delivery and storage unit 200; and the like.

The bulk delivery and storage unit 200 has essentially the same structure as the delivery and storage device (1) depicted in FIGS. 1 through 9B of the aforementioned Japanese Patent Application Laid-open No. 2002-226122, and performs essentially the same operations. Because the main difference in the bulk delivery and storage unit 200 compared to the delivery and storage device (1) is that the bulk delivery and storage unit 200 has a single bulk delivery table 201 instead of a first delivery tray (23) and second delivery tray (24) possessed by the delivery and storage device (1), description of structural details and operations thereof is omitted.

In FIG. 1, "202" indicates a pair of side fences for aligning the width direction of outgoing paper (end surfaces of both sides of delivered paper) disposed on both sides of the bulk delivery table 201 along the paper output direction, and "203" indicates the end fence for aligning the leading edges of outgoing paper. The bulk delivery table 201 consists of a generally known table that is movably (raisably) supported by the delivery unit chassis 204 via a movable body (not pictured), in the same manner as the first delivery tray (23) and second delivery tray (24) in the aforementioned publication. It is also apparent that the bulk delivery and storage unit 200 is not limited to this arrangement and may have the same structure as the delivery and storage device (1) depicted in FIGS. 1 through 9 of the aforementioned Japanese Patent Application Laid-open No. 2002-226122, for example.

The bulk feeding/transporting unit 1 has an intermediate conveyor 4 and a bulk-feeding unit 5 consisting of a bulk-feeding device. The bulk feeding unit 5 has a carrier 2 capable of carrying a large quantity of paper P, a paper feeding mechanism 3 for picking up and feeding one sheet at a time of the paper P from the carrier 2, and the body chassis 6 described above. The intermediate conveyor 4 is equipped with a function/structure for transporting a sheet of paper fed from the paper feeding mechanism 3 to the vicinity of a feeding port 125, which faces the main feeding roller 111 of the main feeder 104. The bulk-feeding unit 5 is fixedly attached to a base 8 having casters 9 mounted on the bottom of the body chassis 6.

The carrier 2, paper feeding mechanism 3, and intermediate conveyor 4 will be described in detail hereinafter, but in order to simplify description of the positioning of constituent elements thereof, the near side of the paper surface viewed in the paper transport direction X is sometimes referred to as "left" or "operation side," and the far side of the paper surface is sometimes referred to as "right" or "counter-operating side." Also, for the same purpose, the downstream end in the paper transport direction X can be referred to as "front," and the upstream end as "back." A pair of auxiliary side plates 29 are put in place on the right and left sides of the inside of the body chassis 6 depicted in FIG. 1.

The carrier 2 is equipped with a raisable bulk feeding table 10 capable of carrying a large quantity of paper P; a pair of side fences 15 and 16 (see FIG. 4) on either side consisting of a paper width-aligning member for aligning the width (right and left ends) of the paper P on the bulk feeding table 10; a feeding table hoisting mechanism 25 consisting of a feeding table hoisting means for raising the bulk feeding table 10; a correct-height sensor 26 consisting of a feeding position detecting means or maximum detecting means for detecting the maximum position of the bulk feeding table 10 or detecting that the feeding roller 11 is in the feeding position; and a minimum sensor 27 consisting of a minimum detecting means for detecting the minimum position of the bulk feeding table 10.

The correct-height sensor 26 and minimum sensor 27 both consist of transmission sensors. The correct-height sensor 26 and minimum sensor 27 are disposed in prescribed positions inside the body chassis 6.

The bulk-feeding table 10 has a raisable structure capable of carrying at least 3,000 sheets of regular A3-size paper, for example, and a helical groove 10*a* in four locations to allow the side fences 15 and 16 to move in the paper width direction Y. A paper-detecting sensor 66 consisting of means for detecting the presence of paper P on the bulk feeding table 10 is mounted inside the bulk feeding table 10. The paper-detecting sensor 66 consists of a reflecting sensor. Unless specified otherwise, "paper size" as mentioned in the present embodiment refers to length along the paper transport direction X.

Figure 4:
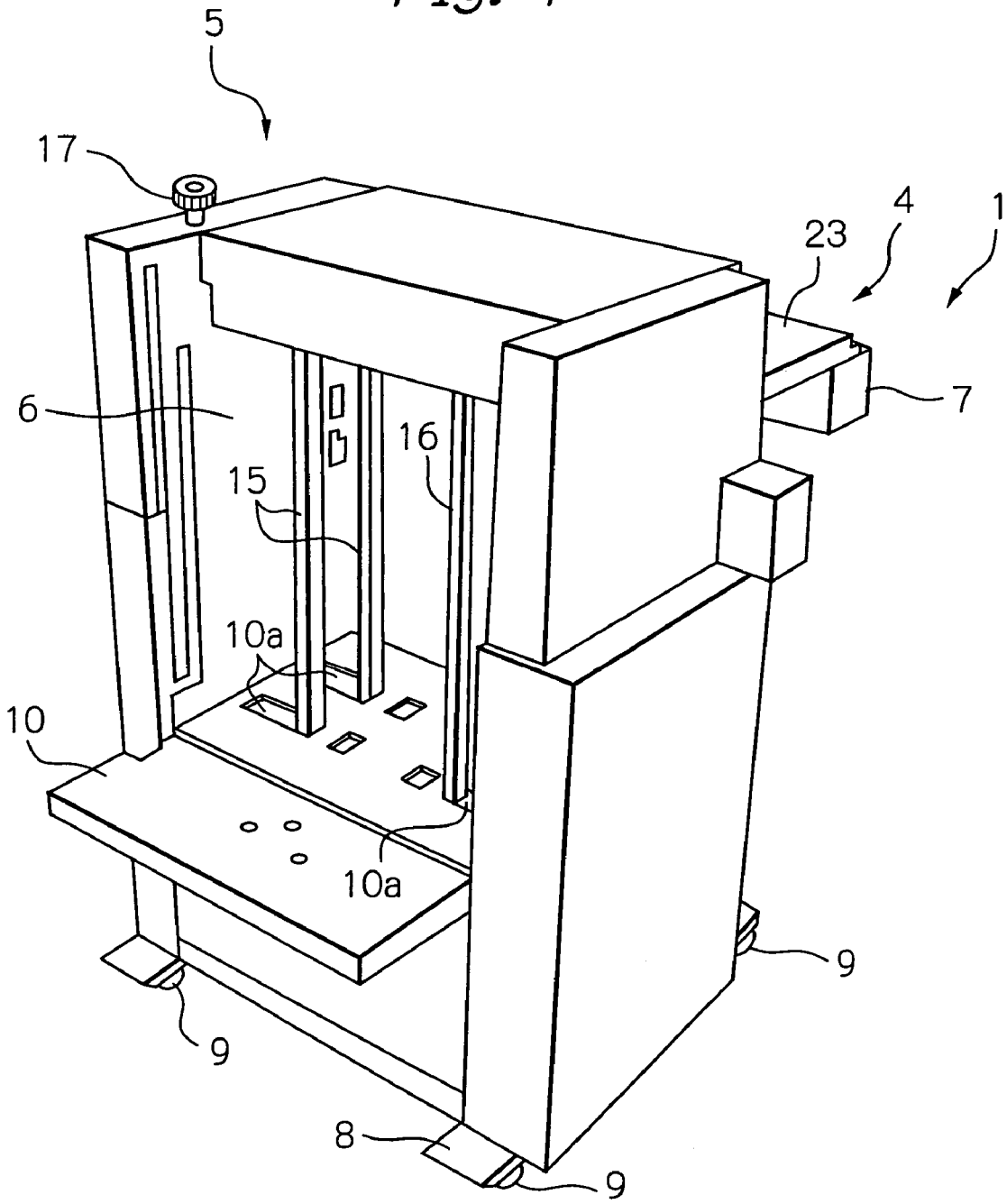
FIG. 4 is an oblique view depicting the appearance of the bulk paper-transporting unit in FIG. 3 from the rear.

As depicted in FIG. 4, the side fences 15 and 16 form rectangular pillars and have hollow rectangular cross-sections, and two of them are disposed in the front and rear in the paper transport direction X and to the right and left in the paper width direction Y. The side fences 15 and 16 are configured such that by rotatably operating a side fence operating handle 17, the side fences 15 and 16 are moved in the paper width direction Y via a pair of side fence centering mechanisms (not pictured) mounted to the top and bottom of the body chassis 6 to enable the side fences 15 and 16 to be centered.

Figure 7:
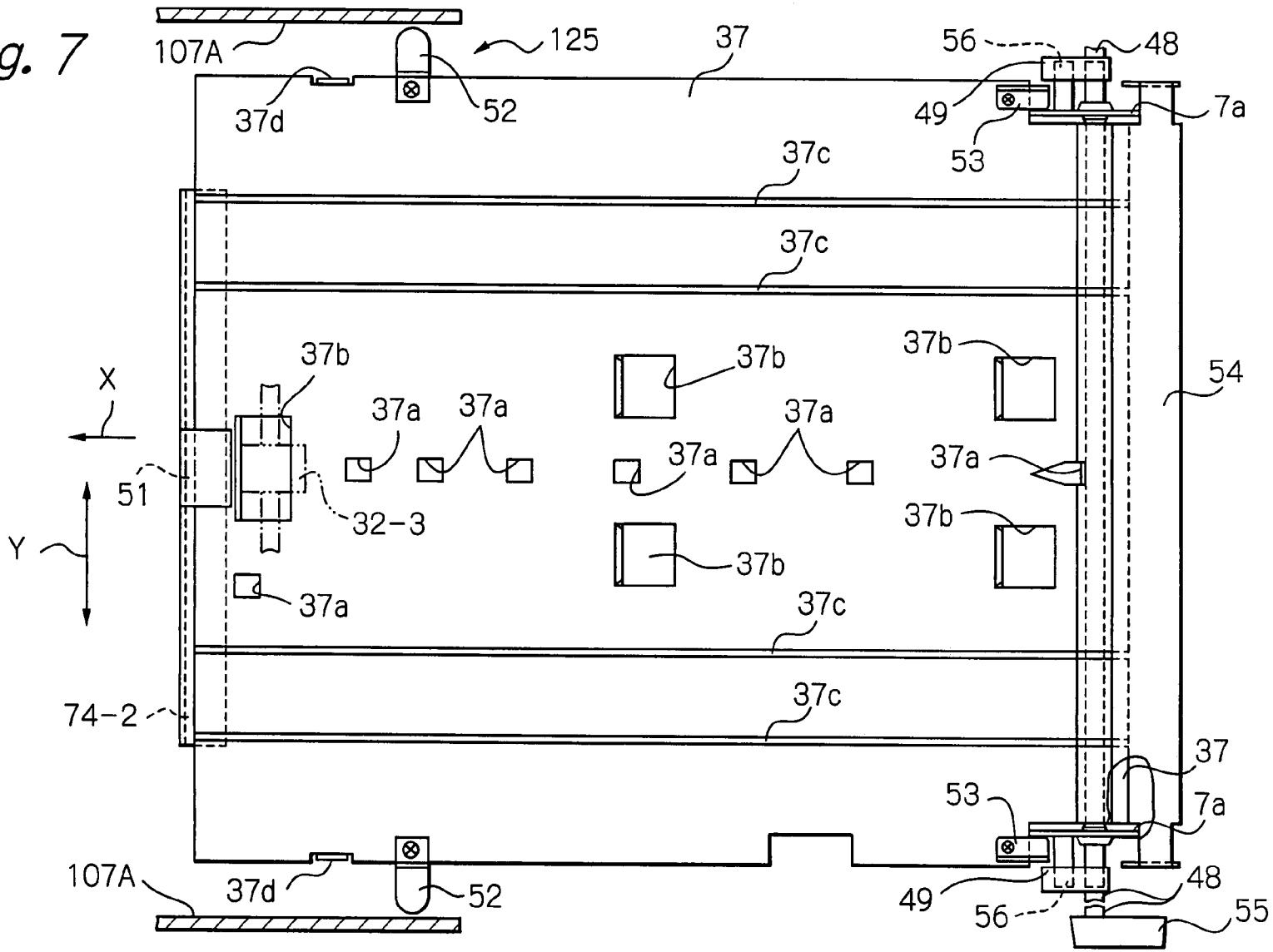
FIG. 7 is a plan view depicting the primary structure around the lower guide plate with the top cover, upper guide plate, and transport rollers removed.

The feeding table hoisting mechanism 25 has essentially the same basic structure as the hoisting mechanism (25) and movable body (57) of the delivery and storage device (1) disclosed in FIGS. 7 and 8 and paragraph Nos. 0024 through 0026 of the above-mentioned Japanese Patent Application Laid-open No. 2002-226122, and is configured so as to raise the bulk feeding table 10 while keeping it in a substantially horizontal position. The feeding table hoisting mechanism 25 consists of a known structure, as described above, and because it is therefore not part of the main content of the present invention, detailed description thereof is omitted to avoid redundant description, and it suffices in the present embodiment to cite the reversible electric elevating motor 28 depicted schematically in FIG. 1, consisting of raisable driving means for raisably driving the bulk feeding table 10. The bulk-feeding table 10 is controlled by a hereinafter-described control device so as to occupy a feeding position in which the top sheet of the loaded paper continually contacts the main feeding roller 11 at a prescribed feed pressure (pushing pressure at which the paper can be transported) via the feeding table hoisting mechanism 25.

The paper feeding mechanism 3 is mounted around the pair of auxiliary side plates 29 above the position of the carrier 2. As depicted in somewhat basic fashion in FIG. 5, in which the thickness and other attributes of members are ignored, the paper feeding mechanism 3 has the same function/structure as the main feeding mechanism 130, which is equipped with the feeding means, separating and feeding means, feeding drive means, and driving force transmitting means of the main feeder 104 described above, so a detailed description will instead be given of the main feeding mechanism 130 by subtracting "100" from each of the numbers used to label the constituent elements thereof to avoid redundant description. The separating roller 12 and feeding roller 11 are rotatably driven by a feeding motor 22 made up of a stepping motor as a feeding drive means. The feeding motor 22, driving force transmitting means, and the like are mounted on the surface of the outer wall of the auxiliary side plates 29 on the far side of the paper surface in FIG. 1.

Figure 5:
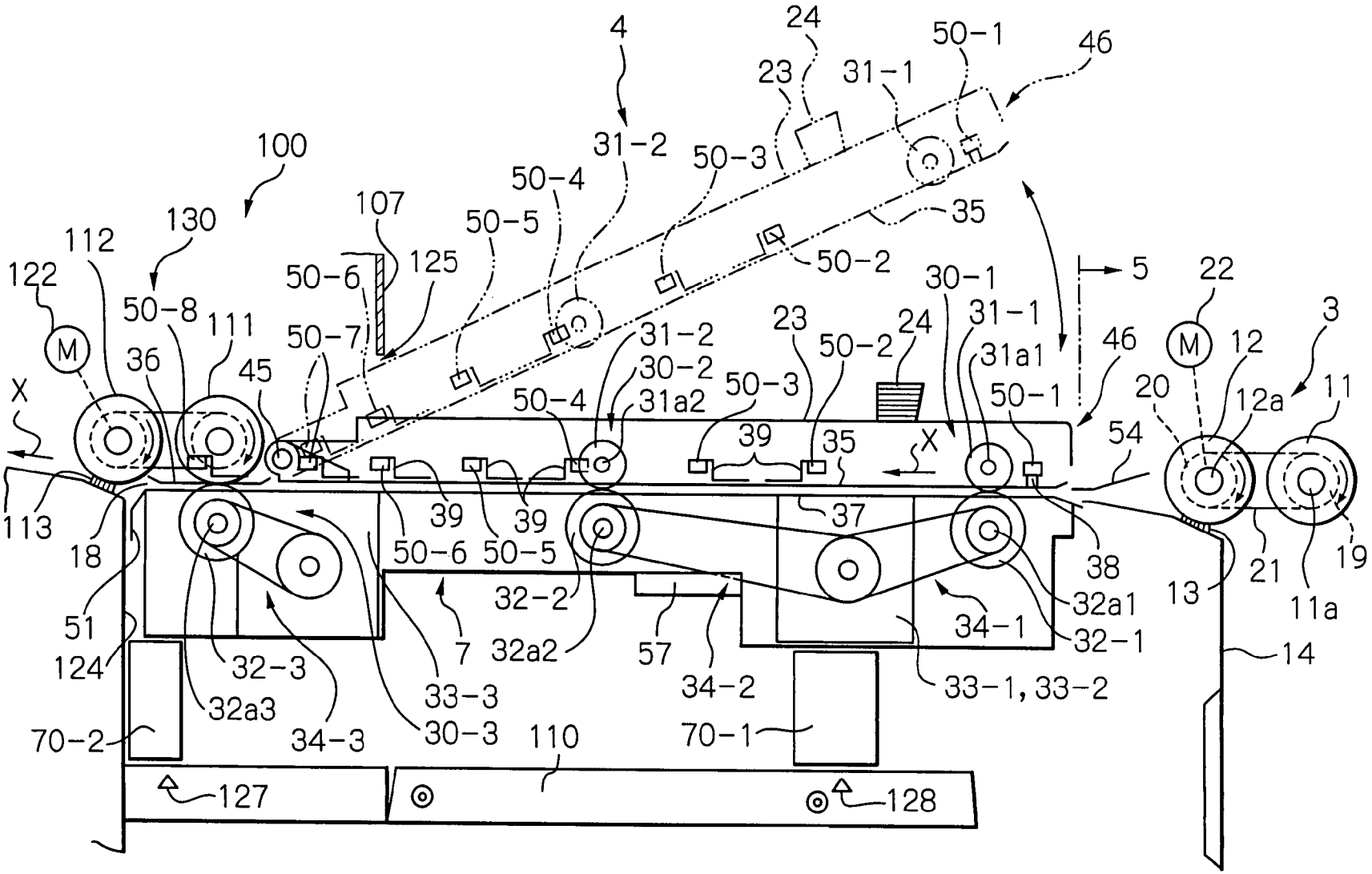
FIG. 5 is a front view depicting the primary structure around the intermediate conveyor in a state in which the stencil printer is connected with the bulk paper delivery and storage unit, and also depicting the opening and closing of the upper guiding unit that includes the upper guide plate.

A feeding filler (not pictured), also referred to as "the same feeding filler as the one for the main feeder 104," is attached to the same feeding arm (not pictured) as the one provided to the main feeding mechanism 130 for rotatably supporting the feeding roller 11 and separating roller 12. A correct-height detecting sensor 26 is affixed to an immobile member (not pictured) disposed in the body chassis 6 near the above-mentioned feeding filler, so as to selectively straddle the free end of the above-mentioned feeding filler. In FIGS. 1, 2, and 5, "14" indicates a face plate for aligning the leading edges of the paper P carried on the bulk feeding table 10. The faceplate 14 is affixed to the pair of auxiliary side plates 29 by a screw or other fastening means.

The bulk feeding device is not limited to the bulk feeding unit 5 described above, and the feeding device (100) disclosed in Japanese Patent Application Laid-open Nos. H8-259008 and H8-259009, for example, may be used as a large-capacity feeding unit. Specifically, the unit may consist of a bulk feeding unit having a structure which is equipped with an LCT (large-capacity feeding table) and can be raised, and with which paper can be fed with the aid of feeding means or separating and feeding means.

The intermediate conveyor 4 pertaining to the characteristic structure of the present embodiment will next be described.

In FIGS. 1, 5, 9A, 9B, and 10, "18" indicates an intermediate transport path for transporting paper P fed from the paper feeding mechanism 3 to the feeding port 125 of the stencil printer 100. The intermediate conveyor 4 is removably attached to the pair of auxiliary side plates 29 of the body chassis 6.

As depicted in FIG. 5, the intermediate conveyor 4 has a plurality (three in the present embodiment) of first paper transporting means 30-1, second paper transporting means 30-2, and third paper transporting means 30-3 for transporting paper P fed from the paper feeding mechanism 3; a plurality (three in the present embodiment) of paper transport electric motors as driving means for independently driving the transporting means, being provided for the first paper transporting means 30-1, second paper transporting means 30-2, and third paper transporting means 30-3, and consisting of a first electric motor 33-1, second electric motor 33-2, and third electric motor 33-3; a first drive power transmitting means 34-1, second drive power transmitting means 34-2, and third drive power transmitting means 34-3 for transmitting the rotational drive power of the first electric motor 33-1, second electric motor 33-2, and third electric motor 33-3 to the first paper transporting means 30-1, second paper transporting means 30-2, and third paper transporting means 30-3; an upper guiding member and lower guiding member (described hereinafter) constituting a pair of guiding means for guiding paper P transported by the first through third paper transporting means 30-1 through 30-3 to the vicinity of the feeding port 125 of the stencil printer 100; the chassis 7 described above for housing the first through third paper transporting means 30-1 through 30-3 and the above-mentioned pair of guiding means; and eight sensors consisting of a first sensor 50-1 through eighth sensor 50-8 as a paper detecting means for detecting at least one (both the leading edge and trailing edge of the paper P in the present embodiment) of either the leading edge or trailing edge of transported paper P, being plurally disposed in the upper guiding member at prescribed intervals from upstream to downstream along the intermediate transport path 18.

The first paper transporting means 30-1 is made up of first transporting rollers 32-1 and first pressing rollers 31-1 that press against the first transporting rollers. The second paper transporting means 30-2 is made up of a second transporting rollers 32-2 and second pressing rollers 31-2 that press against the second transporting rollers. The third paper transporting means 30-3 is made up of the third transporting roller 32-3. The first paper transporting means 30-1, second paper transporting means 30-2, and third paper transporting means 30-3 are arranged in that order at prescribed intervals from upstream to downstream along the intermediate transport path 18.

The external periphery of the first pressing rollers 31-1 that includes at least the external peripheral surface thereof is made of resin. The external periphery of the first transporting rollers 32-1 that includes at least the external peripheral surface thereof is formed by an appropriate rubber or other high-friction elastic body having a high coefficient of friction with the paper P used by the bulk feeding/transporting unit 1. The second pressing rollers 31-2, second transporting rollers 32-2, and third transporting roller 32-3 are also constituted as described above.

Hereinafter, because the first paper transporting means 30-1 and second paper transporting means 30-2 differ from one another only in placement and location and have the same constituent elements, in order to unify description thereof, description of aspects other than placement and location thereof will be given by extension of the detailed description of one to the other. In the description of the above-mentioned structure and the like, numbers following a hyphen after a symbol indicate an order of placement from upstream to downstream along the intermediate transport path 18, and the prefixes "first" through "third" are sometimes omitted.

As described above, because the first electric motor 33-1, second electric motor 33-2, and third electric motor 33-3 differ from one another only in placement and location and have the same constituent elements, in order to unify description thereof, description of aspects other than placement and location thereof will be given by extension of the detailed description of one to the others.

In the same manner, because the first sensor 50-1 through eighth sensor 50-8 differ from one another only in placement and location and are identical to each other, in order to unify description thereof, description of aspects other than placement and location thereof will be given by extension of the detailed description of the first sensor 50-1, for example, to the others. In the description of the above-mentioned structure and the like, numbers following a hyphen after a symbol indicate an order of placement from upstream to downstream along the intermediate transport path 18, and the prefixes "first" through "eighth" are sometimes omitted.

The chassis 7 will first be described. As depicted in FIGS. 1, 2, 3, 8, and elsewhere, the chassis 7 forms the frame of the intermediate conveyor 4, is H-shaped when viewed from above, and is formed in a substantial box shape that is open at the top. The chassis 7 is integrally formed of sheet metal with an appropriate surface treatment, for example. In FIG. 8, the rear panel of the chassis 7 is labeled "7*a*," the front panel of the chassis 7 is labeled "7*b*," and the bottom panel is labeled "7*c*." As shown in FIGS. 5, 8, and elsewhere, the bottom panel 7*c* has a graded shape as viewed from the front. In FIG. 5, "57" indicates a belt cover shown only in that diagram. The belt cover 57 protects the timing belt of the second drive power transmitting means 34-2 from exposure to the outside.

The area around the above-mentioned pair of guiding means will be described with reference to FIGS. 5, 6, 9A, 9B, 10, and others.

As depicted in FIG. 5, the pair of guiding means is made up of an upper guide plate 35 and an auxiliary upper guide plate 36 as upper guiding members constituting an upper guiding member, and a lower guide plate 37 as a lower guiding member disposed opposite the other member. The upper guide plate 35, auxiliary upper guide plate 36, and lower guide plate 37 are each integrally formed of sheet metal with an appropriate surface treatment, for example. The space enclosed by the upper guide plate 35, auxiliary upper guide plate 36, and lower guide plate 37 makes up the intermediate transport path 18.

As depicted in FIGS. 5, 6, 9A, and 9B, shaft supports 35*d* turned upwards are integrally formed at both ends of the front end of the upper guide plate 35. These shaft supports 35*d* are fitted over the support shaft 45 indicated by the double-dashed line in FIG. 6 together with shaft receivers 37*d*, which are integrally formed at both ends of the leading end of the lower guide plate 37 depicted in FIG. 7, and the assembly is fastened by retaining rings. By this means, the upper guide plate 35 is configured such that the anchoring end thereof is able to turn a prescribed angle around the support shaft 45, or, specifically, such that the free end thereof can pivot with respect to the lower guide plate 37, and the upper guide plate 35 can be opened.

Figure 6:
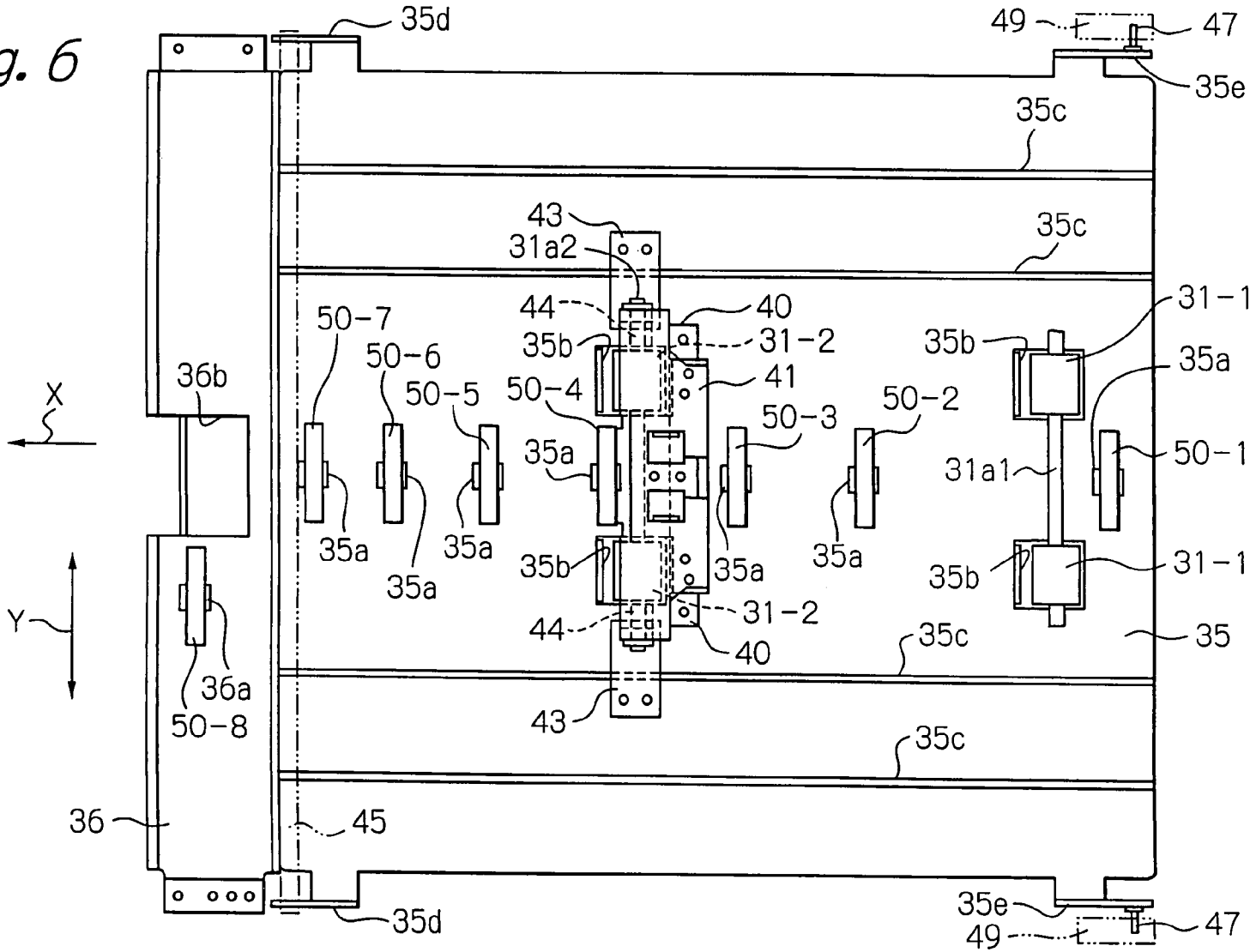
FIG. 6 is a plan view depicting the primary structure around the upper guide plate with the top cover removed.

On the other hand, as depicted in FIG. 6, upturned parts 35*e* that are turned upwards are integrally formed in both ends of the trailing end of the upper guide plate 35. An outwardly protruding fixed shaft 47 is attached to each of the upturned parts 35*e*. As depicted in FIG. 7, the fixed shafts 47 are selectively engaged and fixed/locked by the oscillation of an opening and closing cam 49 (indicated by the double-dashed line in FIG. 6) held in place by a through-shaft 48 (hereinafter referred to as "through-shaft 48") for fixing the upper guide plate disposed on the right and left ends of the rear panel 7*a* of the chassis 7 so as to be able to turn a prescribed angle. In FIG. 7, "51" indicates a tilted member formed of sheet metal, for example, that is fixed to the leading end of the lower guide plate 37.

In FIGS. 6, 9A, 9B, and 10, "35c" indicates a convex reinforcing rib facing downward. An appropriate number of other reinforcing ribs 35*c* are also formed in the center of the upper guide plate 35 other than what is shown in the diagram.

As depicted in FIGS. 5 and 6, the first sensor 50-1 is mounted/affixed on the upper guide plate 35 via a sensor mounting member 38, and the second sensor 50-2 through seventh sensor 50-7 are mounted/affixed on the upper guide plate 35 via a sensor mounting member 39, by a screw (not pictured) or other fastening means. Also, in FIG. 6, depiction of the sensor mounting members 38 and 39 is omitted.

The first sensor 50-1 through eighth sensor 50-8 are made up of reflection sensors. It is apparent that the first sensor 50-1 through eighth sensor 50-8 have functionality for detecting the presence of paper P on the intermediate transport path 18 of the intermediate conveyor 4 and for detecting the length (paper size) of the paper P. Seven openings 35*a* for transmitting projected light and reflected light from the sensors 50-1 through 50-7 are formed in the upper guide plate 35 for each of the first sensor 50-1 through seventh sensor 50-7.

Figure 10:
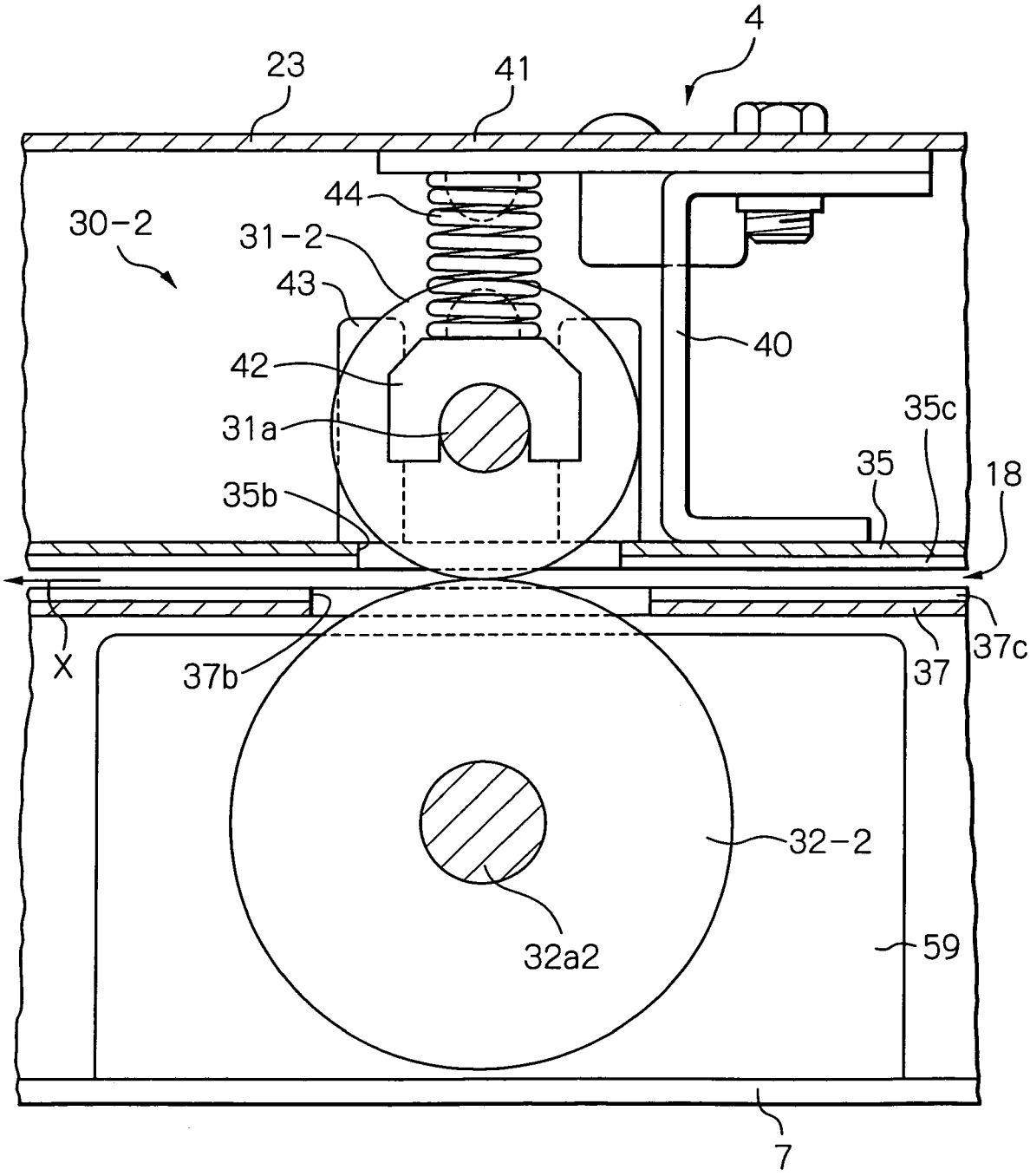
FIG. 10 is a cross-sectional view depicting a state in which the second press roller and second transport roller in the intermediate conveyor are pressed together.

As depicted in FIGS. 6 and 10, two each of openings 35*b* are formed forward and backward and right and left in the upper guide plate 35 for allowing part of the external periphery of the first pressing rollers 31-1 and second pressing rollers 31-2 to protrude.

An opening (not pictured) is also formed in the auxiliary upper guide plate 36 the same as the aforementioned openings 35*a*, for transmitting projected light and reflected light from the eighth sensor 50-8. As depicted in FIGS. 5, 6, 9A, and 9B, both the front and back ends of the auxiliary upper guide plate 36 are turned so as to tilt upward. As depicted in FIGS. 9A and 9B, an opening 36*b* is formed in the center of the downstream end of the intermediate transport path 18 of the auxiliary upper guide plate 36, for allowing part of the external periphery of the main feeding roller 111 to protrude when the bulk feeding/transporting unit 1 occupies the connected position depicted in FIG. 1. As depicted in FIG. 5, part of the external periphery of the third transporting roller 32-3 described hereinafter is exposed downward near the opening 36*b*.

The upper guide plate 35 is mounted in essentially integrated fashion on the top cover 23 disposed above the upper guide plate 35, by means of the supporting member 40 depicted in FIG. 10. Hereinafter, the top cover 23 and upper guide plate 35 are sometimes referred to together as the "upper guiding unit 46." Only one is shown in FIG. 10, but a supporting member 40 is also placed near the first pressing rollers 31-1 and is used to attach the upper guide plate 35 to the top cover 23. The top cover 23 is integrally formed of sheet metal with an appropriate surface treatment, for example. As in the aforementioned configuration, the free end of the upper guiding unit 46 towards the bulk feeding unit 5 is configured so as to be able to pivot with respect to the lower guide plate 37 around the support shaft 45, or, specifically, the upper guiding unit 46 that includes the upper guide plate 35 is able to open and close between the closed position indicated by the solid line in FIG. 5 and the open position indicated by the double-dashed line in the same figure.

A picker 24 used for opening and closing the upper guiding unit 46 with respect to the lower guide plate 37 is attached to the upper surface of the top cover 23 in the direction of the bulk-feeding unit 5 (paper feeding mechanism 3). Thus, when a paper jam occurs in the intermediate conveyor 4, jammed paper can be easily removed because the upper guiding unit 46, or, in other words, the upper guide plate 35 and top cover 23, can be opened using the picker 24. Also, when cleaning the pressing rollers 31-1 and 31-2 or the transporting rollers 32-1 through 32-3, maintenance is facilitated by the ability to perform cleaning with the upper guide plate 35 and top cover 23 opened. Paper dust and contamination adhering to the surface of the sensors 50-1 through 50-7 constituting the reflection photosensors can also be easily removed.

Furthermore, placing the support shaft 45 as a pivot point on the side of the stencil printer 100 provides more room for safely performing that operation because there is a large space for manual access when removing jammed paper. For example, if the support shaft 45 is mounted in the bulk-feeding unit 5 in contrast to the arrangement described above, and manual access is attempted from the side of the stencil printer 100, the body chassis 107 presents an obstacle that makes such access difficult, as depicted in FIG. 1.

As depicted in FIG. 6, the first pressing rollers 31-1 are formed in integrated fashion with its shaft 31*a*, and is formed as a pair in a symmetrical arrangement at the right and left ends of the shaft 31*a*. The second pressing rollers 31-2 are arranged in the same manner. The first pressing rollers 31-1 and second pressing rollers 31-2 are mounted by the support structure depicted in FIGS. 6 and 10 (the first pressing rollers 31-1 are omitted, but its support structure is the same) so as to be able to rotate between the top cover 23 and upper guide plate 35, and the first and second pressing rollers 31-1 and 31-2 are mounted so that part of the external periphery thereof protrudes downward from the opening 35*b* of the upper guide plate 35 and approaches the intermediate transport path 18.

The aforementioned support structure is constituted mainly of a lateral pair of wing guides 42 for supporting the shaft 31*a*2 of the pair of second pressing rollers 31-2 at both ends so as to allow the shaft to rotate; a lateral pair of upper and loser guiding members 43 attached by welding to the upper guide plate 35, for guiding the wing guides 42 so they can move upwards and downwards; a wing fixing member 41 fixed with a screw to the supporting member 40 so as to cover the pair of wing guides 42 from above; and a lateral pair of compression wings 44 disposed in the space between an upward protrusion integrally formed in the wing guides 42 and a downward protrusion integrally formed in the wing fixing members 41.

A material having low frictional resistance and good abrasion resistance is appropriately selected for the wing guides 42 in order to provide support that allows the shaft 31*a*2 to rotate. The compression wings 44 function as a biasing member for biasing the external peripheral surface of the second pressing rollers 31-2 to press against the external peripheral surface of the second transporting rollers 32-2 protruding down from the lower guide plate 37. The pair of first pressing rollers 31-1 is arranged in the same manner.

The present embodiment is not limiting, and the pressing rollers may be mounted on the lower guiding member and the transporting rollers on the upper guiding member, and a biasing member (the aforementioned compression wings, for example) for biasing the pressing rollers towards pressing against the transporting rollers may be disposed in the lower guiding member.

The area around the upper part of the lower guide plate 37 and chassis 7 will next be described with reference to FIGS. 5, 7, 9A, 9B, and 10.

The lower guide plate 37 is mounted/affixed to the upper part of the chassis 7 that is opened upward by a screw (not pictured) or other fastening means, via an appropriate reinforcing member or the like. Eight downward openings 37*a* are formed in the lower guide plate 37 at bottom locations that correspond to seven openings 35*a* formed in the upper guide plate 35 and one opening 36*a* formed in the auxiliary upper guide plate 36. These eight openings 37*a* are for transmitting projected light corresponding to each of the first sensor 50-1 through eighth sensor 50-8 mounted in the upper guide plate 35.

As depicted in FIGS. 7, 9A, 9B, and 10, two each of openings 37*b* are formed forward and backward and right and left in the lower guide plate 37 for allowing part of the external periphery of the first transporting rollers 32-1 and second transporting rollers 32-2 at the trailing end thereof to protrude. An opening 37*b* is also formed at the center of the leading end of the lower guide plate 37, for allowing part of the external periphery of the third transporting roller 32-3 to protrude.

As depicted in FIG. 7, a tilted member 51 whose leading end is tilted downward is affixed to the leading end of the lower guide plate 37. The tilted member 51 is designed to pivot the feeding filler (not pictured) via the pivoting of the above-mentioned feeding arm (not pictured) towards engaging the correct-height sensor 126, by smoothly contacting the main feeding roller 111 and the skid at the lower end of the above-mentioned feeding filler (not pictured) when the bulk feeding/transporting unit 1 moves in the paper transport direction X to occupy the connected position depicted in FIG. 1. The tilted member 51 also functions to position the paper transport direction X when the bulk feeding/transporting unit 1 is occupying the connected position depicted in FIG. 1.

Positioning members 52 are fastened/fixed by screws on the right and left ends of the lower guide plate 37 towards the leading edge thereof. The positioning members 52 position the paper width direction Y with respect to a lateral pair of feeding panels 107A secured to the body chassis 107 to the right and left of the feeding port 125 when the bulk feeding/transporting unit 1 moves in the paper transport direction X to occupy the connected position depicted in FIG. 1.

Contacting members 53 having a prescribed thickness are fastened/fixed by screws on right and left end towards the trailing edge of the lower guide plate 37. The contacting members 53 are designed for forming a consistent intermediate transport path 18 by maintaining a constant gap (maintaining a paper height of 1.2 mm, for example) between the bottom surface of the upper guide plate 35 and the top surface of the lower guide plate 37 when the upper guiding unit 46 (top cover 23 and upper guide plate 35) occupies a closed position.

As depicted in FIG. 7, part of the rear panel 7*a* of the chassis 7 is shown to the rear of the lower guide plate 37 (to the right in the figure). Part of the through-shaft 48 described above is supported so as to be able to pivot via a shaft-receiving member at the top of the rear panel 7*a* on both the right and left sides. Opening and closing cams 49 in phase with each other are affixed to both the right and left ends of the through-shaft 48. An opening and closing handle 55 is affixed as a fixing means at the left end of the through-shaft 48.

Grooves (not pictured) running along the fixed shaft 47 depicted in FIG. 6 and tabs (not pictured) for locking/fixing are in communication/formed in the opening and closing cams 49. The opening and closing cams 49 and opening and closing handle 55 depicted in FIGS. 1 through 3 are shown in a position such that the upper guiding unit 46 that includes the upper guide plate 35 is fixed in a closed position. Specifically, when the opening and closing handle 55 is pivoted clockwise in FIG. 7 with respect to the upper guiding unit 46 in a closed position, the two opening and closing cams 49 oscillate around the through-shaft 48, thereby causing the opening and closing cams 49 to be in phase with respect to the fixed shaft 47 depicted in FIG. 6, and the above-mentioned tabs to engage, and the upper guiding unit 46 can be securely fixed near the closed position. An opening and closing sensor 67 (shown only in FIG. 13) is affixed to the auxiliary side plates 29 (not pictured) to the right (far side of paper surface, counter-operating side) of FIG. 7 as a fixed-state detecting means for detecting that the above-mentioned tabs of the opening and closing cams 49 are engaged with the fixed shaft 47 of the upper guiding unit 46 and that the upper guiding unit 46 that includes the upper guide plate 35 is fixed/locked with respect to the lower guide plate 37. The opening and closing sensor 67 consists of a transmission sensor.

In FIGS. 7, 9A, 9B, and 10, "37c" indicates a convex reinforcing rib facing downward. An appropriate number of other reinforcing ribs 37*c* are also formed in the center of the lower guide plate 37 other than what is shown in the diagram. In FIGS. 5 and 7, "54" indicates an upper feeding plate fixed to the body chassis 6. In FIG. 7, "56" indicates a stopper fixed in the rear panel 7*a* near the opening and closing cams 49. The stopper 56 contacts the opening and closing cams 49 to regulate the opening position.

As described above, by means of the present embodiment, advantages are demonstrated whereby both the lower guide plate 37 and auxiliary upper guide plate 36 as an upper guiding member constituting an upper guiding member, and the lower guide plate 37 as an opposite-facing lower guiding member, extend together to the vicinity of the feeding port 125, allowing the paper P to be reliably transported and transferred from the paper feeding mechanism 3 of the bulk feeding unit 5 to the main feeding roller 111 of the stencil printer 100 by way of the intermediate conveyor 4 even if the paper P has inconsistent quality with wide variations in stiffness, such as groundwood paper, for example, thereby eliminating instances of the leading edge of the paper P getting caught on protrusions in the main feeding roller 111, edge tearing or damage of the paper P, jamming, and the like.

If advantages equivalent to those achieved by the above-mentioned present embodiment are not deemed necessary, an arrangement may be adopted wherein at least one of either the upper guiding member or lower guiding member extends to the vicinity of the main feeding table 110 or feeding port 125. In this case, "extending" to the vicinity of the main feeding table 110 or feeding port 125, as is apparent from the depiction of the above-mentioned present embodiment in FIG. 5, means that a case in which the auxiliary upper guide plate 36 is separate from, and independent of, the lower guide plate 37 is also included.

The area around the chassis 7 will next be described with reference to FIGS. 5 and 8 through 10.

The first through third electric motors 33-1 through 33-3 each consist of stepping motors that operate by pulse input. The electric motors 33-1 through 33-3 are each mounted/fixed to the bottom panel 7*c* of the chassis 7 via a motor bracket (not pictured) by a screw or other fastening means so as to by slightly movable and capable of adjusting the tension of the timing belts that constitute the first through third drive power transmitting means 34-1 through 34-3.

If advantages equivalent to those achieved by the above-mentioned present embodiment are not deemed necessary, it is possible to adopt an arrangement that is not limited to the above-mentioned present embodiment and involves having at least one driving means (stepping motor, for example) for rotatably driving the transporting rollers 32-1 through 32-3, for example. In this case, a magnetic clutch or the like, for example, may be disposed in at least two of the transporting rollers 32-1 through 32-3, and the driving force of a driving means (stepping motor, for example) may be switchably (on/off) controlled at an appropriate timing.

As depicted in FIG. 8, the first transporting rollers 32-1 are mounted as a pair at both the right and left ends of the shaft 32*a*1 thereof. These first transporting rollers 32-1 are rotatably supported by a first bracket 58 mounted/fixed by a screw to the bottom panel 7*c* via the shaft 32*a*1 and bearing (not 5 pictured). A one-way clutch 61 as a means for transmitting driving force in one direction is disposed between the first transporting rollers 32-1 and the shaft 32*a*1, and the first transporting rollers 32-1 are capable of rotating only in the counterclockwise direction of FIG. 5, or, in other words, only in the direction in which paper P fed from the paper feeding mechanism 3 is transported in the paper transport direction X. The second transporting rollers 32-2 are also rotatably supported by a second bracket 59 mounted/fixed by a screw to the bottom panel 7*c* via the shaft 32*a*2 and bearing (not pictured) in the same manner as described above.

As depicted in FIG. 10, the first and second transporting rollers 32-1 and 32-2 are both disposed so that part of the external periphery thereof protrudes upward from the opening 37*b* in the lower guide plate 37 and approaches the intermediate transport path 18.

Among the first through third transporting rollers 32-1 through 32-3, the third transporting roller 32-3 is disposed furthest downstream in the intermediate transport path 18, and is made up of a single roller. The third transporting roller 32-3 is rotatably supported by a third bracket 60 mounted/fixed by a screw to the bottom panel 7*c* via the shaft 32*a*3 and bearing (not pictured) thereof. A one-way clutch 61 the same as described above is disposed between the third transporting roller 32-3 and the shaft 32*a*3, and the third transporting roller 32-3 is capable of rotating only in the counterclockwise direction of FIG. 5, or, in other words, only in the direction in which paper P fed from the paper feeding mechanism 3 is transported in the paper transport direction X.

As depicted in FIGS. 9A and 9B, the third transporting roller 32-3 is also disposed so that part of the external periphery thereof protrudes upward from the opening 37*b* in the lower guide plate 37 and approaches the intermediate transport path 18. The third transporting roller 32-3 is disposed in a position facing the main feeding roller 111 of the stencil printer 100, and is disposed in a prescribed position of the chassis 7 of the intermediate conveyor 4 depicted in the diagrams so as to be able to slip under and press against the external peripheral surface of the main feeding roller 111 when the bulk feeding/transporting unit 1 occupies the connected position depicted in FIG. 1.

As depicted in FIGS. 9A and 9B, a leaf spring 62 is mounted/fixed inside the front side panel 7*b* of the chassis 7 by a screw or other fastening means as a braking force applying means for applying an appropriate level of braking force to the third transporting roller 32-3. As indicated by the solid line in the same diagrams, the braking force applied by the leaf spring 62 is applied to the core 32*b* as the shaft of the third transporting roller 32-3 to which the rotational driving force of the third electric motor 33-3 is transmitted via the third drive power transmitting means 34-3 and one-way clutch 61.

This arrangement is not limiting, and an arrangement may be adopted whereby the braking force of the leaf spring 62 is applied to the third transporting roller 32-3 itself, to which the rotational driving force of the third electric motor 33-3 is transmitted via the third drive power transmitting means 34-3 and one-way clutch 61, as indicated by the double-dashed line in the same figures. It is apparent in this case that braking force is applied in a range that imparts durability to the third transporting roller 32-3 or that does not place an excessive load on the third electric motor 33-3 constituting the driving means thereof.

By applying the above-mentioned appropriate braking force, the effects of inertia in the third transporting roller 32-3 during transport can be minimized and a consistent stopping position for the paper can be maintained, resulting in enhanced precision of paper transport.

The above-mentioned present embodiment is not limiting, and the one-way clutch 61 as a means for transmitting rotational driving force in one direction may be disposed in the shaft of the third transporting roller 32-3, which is disposed furthest downstream in the intermediate transport path 18. Also, an arrangement may be adopted whereby the braking force applied by the leaf spring 62 as a braking force applying means is applied appropriately to include the second transporting rollers 32-2 or first transporting rollers 32-1 disposed downstream in the intermediate transport path 18. In this case, the braking force applied by the leaf spring 62 should be set to a level that increases towards the main feeding roller 111 of the stencil printer 100.

The first drive power transmitting means 34-1 is constituted mainly of a timing pulley 63-1 fixed to the output shaft (rotating shaft) of the first electric motor 33-1; a timing pulley 64-1 fixed to one end of the shaft 32*a*1 of the first transporting rollers 32-1; and a timing belt 65-1 passed between the timing pulley 63-1 and the timing pulley 64-1.

The second drive power transmitting means 34-2 is constituted mainly of a timing pulley 63-2 fixed to the output shaft (rotating shaft) of the second electric motor 33-2; a timing pulley 64-2 fixed to one end of the shaft 32*a*2 of the second transporting rollers 32-2; and a timing belt 65-2 passed between the timing pulley 63-2 and the timing pulley 64-2.

In the same manner, the third drive power transmitting means 34-3 is constituted mainly of a timing pulley 63-3 fixed to the output shaft (rotating shaft) of the third electric motor 33-3; a timing pulley 64-3 fixed to one end of the shaft 32*a*3 of the third transporting roller 32-3; and a timing belt 65-3 passed between the timing pulley 63-3 and the timing pulley 64-3.

As depicted in FIGS. 1, 5, 9A, and 9B, the bottom of the chassis 7 is provided with a shutter mechanism 70-1 for the paper length sensor as a paper length detecting shutter mechanism for selectively shielding the paper length sensor 128 that faces the mechanism and is disposed inside the main feeding table 110, and a shutter mechanism 70-2 for the paper detection sensor is mounted as a paper detecting shutter mechanism for selectively shielding the paper-detecting sensor 127 that faces the mechanism when the bulk feeding/transporting unit 1 occupies the connected position depicted in FIG. 1. Because the shutter mechanism 70-1 for the paper length sensor and the shutter mechanism 70-2 for the paper detection sensor have substantially the same structure, describing the detailed structure of the shutter mechanism 70-2 for the paper detection sensor will allow description of the shutter mechanism 70-1 for the paper length sensor to be omitted.

As depicted in detail in the front view of FIG. 9A and side view of FIG. 9B, the shutter mechanism 70-2 for the paper detection sensor is constituted mainly of a shutter 71-2 as a shielding member, a pulling-type solenoid 72-2 as a shield driving means, a tension wing 73-2 as a biasing means, a shutter mechanism protecting member 74-2, a fulcrum shaft 75-2, and a holder 76-2.

The shutter mechanism protecting member 74-2 is an immobile member, is made of sheet metal, for example, and is formed roughly into a horseshoe shape as viewed from the front. The shutter mechanism protecting member 74-2 is mounted/fixed to the lower surface of the bottom panel 7*c* of the chassis 7 by a screw or other attachment/fixing means. An opening 74*a*2 for transmitting projected light/reflected light from the paper-detecting sensor 127 is formed in the bottom panel of the shutter mechanism protecting member 74-2. A holder 76-2 for mounting/fixing the solenoid 72-2 and anchoring the fulcrum shaft 75-2 by a screw is mounted/fixed by screws to the right-hand surface in FIG. 9A of the shutter mechanism protecting member 74-2. Thus, the holder 76-2 becomes an immobile member in the same manner as the shutter mechanism protecting member 74-2. A wing latch 76*a*2 for catching on/engaging with one end of the tension wing 73-2 is folded back at the central right end of the holder 76-2 in FIG. 9B.

The shutter 71-2 is made of sheet metal, for example, and is configured so that the free end thereof is able to oscillate around the fulcrum shaft 75-2 between a virtual "paper present" position that blocks/reflects the projected light of the paper-detecting sensor 127 via the opening 74*a*2 as depicted by the solid line in FIG. 9B, and a virtual "paper absent" position that transmits the projected light of the paper-detecting sensor 127 as depicted by the double-dashed line in FIG. 9B. A wing latch 71*a*2 for catching on/engaging with the other end of the tension wing 73-2 is folded back at the upper right end of the shutter 71-2 in FIG. 9B. An interlocking hole for loosely interlocking a pin 72*a*2 pushed in by the leading end of the plunger of the solenoid 72-2 is formed in the upper left end of the shutter 71-2 in FIG. 9B. The pin 72*a*2 of the solenoid 72-2 is connected to the shutter 71-2 through a pin insertion tube (not pictured) opened in the holder 76-2 and the above-mentioned interlocking hole in the shutter 71-2.

The lower part of the shutter 71-2 is folded back into an L shape, and an appropriate surface treatment is performed on the lower surface thereof for reflecting the projected light from the paper-detecting sensor 127 to the same degree as the paper surface. The tension wing 73-2 extends between the wing latch 76*a*2 of the holder 76-2 and the wing latch 71*a*2 of the shutter 71-2, and continually urges the free end of the shutter 71-2 (lower surface in the figure) in the clockwise direction in FIG. 9B towards occupying the virtual "paper present" position. Also, the biasing force of the tension wing 73-2 aids the return of the plunger of the solenoid 72-2 and the pin 72*a*2 via the shutter 71-2.

The operation of the shutter mechanism 70-2 for the paper detection sensor will be described herein in advance. When electrical power is supplied to the solenoid 72-2 and the solenoid 72-2 is turned on, the plunger and pin 72*a*2 are moved substantially downward in FIGS. 9A and 9B against the biasing force of the tension wing 73-2 by the magnetic attraction thereof, and the free end of the shutter 71-2 thereby pivots around the fulcrum shaft 75-2 in the counterclockwise direction in FIG. 9B, and occupies the virtual "paper absent" position indicated by the double-dashed line in FIG. 9B.

On the other hand, when electrical power is cut from the solenoid 72-2 and the solenoid 72-2 is turned off, the plunger and pin 72*a*2 are moved substantially upward in FIGS. 9A and 9B by the biasing force of the tension wing 73-2, and the free end of the shutter 71-2 thereby pivots around the fulcrum shaft 75-2 in the clockwise direction in FIG. 9B, and occupies the virtual "paper present" position indicated by the solid line in FIG. 9B.

When the bulk feeding/transporting unit 1 occupies the connected position depicted in FIGS. 1, 9A, and 9B, the solenoid 72-2 is turned off by a command from the hereinafter described control device, and the free end of the shutter 71-2 is thereby brought to a virtual "paper present" position that blocks/reflects the projected light of the paper-detecting sensor 127. When paper on the carrier 2 and intermediate conveyor 4 then runs out, the free end of the shutter 71-2 pivots around the fulcrum shaft 75-2 in the counterclockwise direction of FIG. 9B against the biasing force of the tension wing 73-2 and occupies the virtual "paper absent" position indicated by the double-dashed line in FIG. 9B by means of the solenoid 72-2 being turned on by a command from the above-mentioned control device, allowing the control device (not pictured) in the stencil printer 100 to recognize that there is no paper.

On the other hand, when paper is present on the intermediate conveyor 4, movement of paper from the intermediate conveyor 4 to the stencil printer 100 becomes possible by the solenoid 72-2 being turned off by a command from the above-mentioned control device, whereby the free end of the shutter 71-2 is brought into the virtual "paper present" position in the same manner as described above, and the above-mentioned control device in the stencil printer 100 recognizes that there is paper.

The shutter mechanism 70-2 for the paper detection sensor mainly differs in comparison to the shutter mechanism 70-1 for the paper length sensor in possessing functionality whereby the shutter mechanism protecting member 74-2 comes in contact with the front panel 124 of the main feeder 104 and performs connection positioning together with the tilted member 51 when the bulk feeding/transporting unit 1 occupies the connected position depicted in FIGS. 9A and 9B. Consequently, the shutter mechanism 70-1 for the paper length sensor has essentially the same constituent elements as the partially structurally different shutter mechanism 70-2 for the paper detection sensor, and description thereof will be omitted by adding "1" after hyphenated symbols for constituent elements.

It is also apparent that by changing the shape and covering position of the shutter with respect to the paper-detecting sensor 127, retraction and return of the solenoid can be reversed. After paper P has run out on the bulk feeding table 10 and paper P has run out on the intermediate transport path 18 as well, it is concluded that paper is not coming (paper will apparently not come, because there is no paper) and a feeding jam occurs even if the shutter is still over the paper-detecting sensor 127 and it is concluded that paper is present in the stencil printer 100 and the paper is fed when the presence or absence of paper is determined by the control device (not pictured) of the stencil printer 100 in cases in which the time required for releasing (transmitting) the paper-detecting sensor 127 by the shutter is longer that the time for picking up the subsequent sheet of paper in the stencil printer 100 because the solenoid is operated and information/signals are transmitted to the stencil printer 100. To avoid this situation, feed jamming can be reliably prevented by opening the shutter toward a retraction side/in a retraction direction with a short operating time for the solenoid (since this is a magnetic operation, the latent time is inherently shorter than the mechanical biasing and returning operation of a tension wing). Consequently, using the retraction of the solenoid in conjunction with the release condition of the paper-detecting sensor 127 becomes a foundation for consistently controlling paper transport and sustaining paper feed quality.

By means of the present embodiment, the presence of paper P on the bulk feeding table 10 mounted on the carrier 2 or the presence of paper P in the paper feeding mechanism 3 can be observed by an operator, and manual operation can be performed even if, for example, the solenoids 72-1, 72-2 and other electric driving means of the shutter mechanism 70-1 for the paper length sensor and shutter mechanism 70-2 for the paper detection sensor break down.

In FIG. 8, "135" indicates a rotating shaft used for print centering (width-directed adjustment of the paper P). An external thread (not pictured) is cut into one end of the rotating shaft 135. In this arrangement, the movement in the paper width direction Y with this screw mechanism is used to perform width-directed adjustment of the paper P by a method in which the external thread on one end of the rotating shaft 135 is threadably joined with a threadable joining member (not pictured) in which an internal thread is cut in the top of the lateral pair of auxiliary side plates 29 of the body chassis 6.

The electronic control structure for controlling the hereinafter described operation of the bulk feeding/transporting unit 1 described above will next be described with reference to FIGS. 11 and 12. Also, to simplify the figures, sensors 26, 27, and 66; first through eighth sensors 50-1 through 50-8; and the like are indicated by triangles, whereas electric motors 22, 28, and 33-1 through 33-3; and solenoids 72-1 and 72-2; and the like are depicted schematically and in simplified fashion. The first through eighth sensors 50-1 through 50-8 are depicted as though they were disposed in the lower guide plate 37 in FIGS. 11 and 12, but this is merely intended to simplify description of the control structure and operation, and does not change the fact that the first through eighth sensors 50-1 through 50-8 are disposed in the upper guide plate 35 as described above.

A supplementary description of the positioning of the first through eighth sensors 50-1 through 50-8 and the like will first be given based on FIG. 11.

Figure 11:
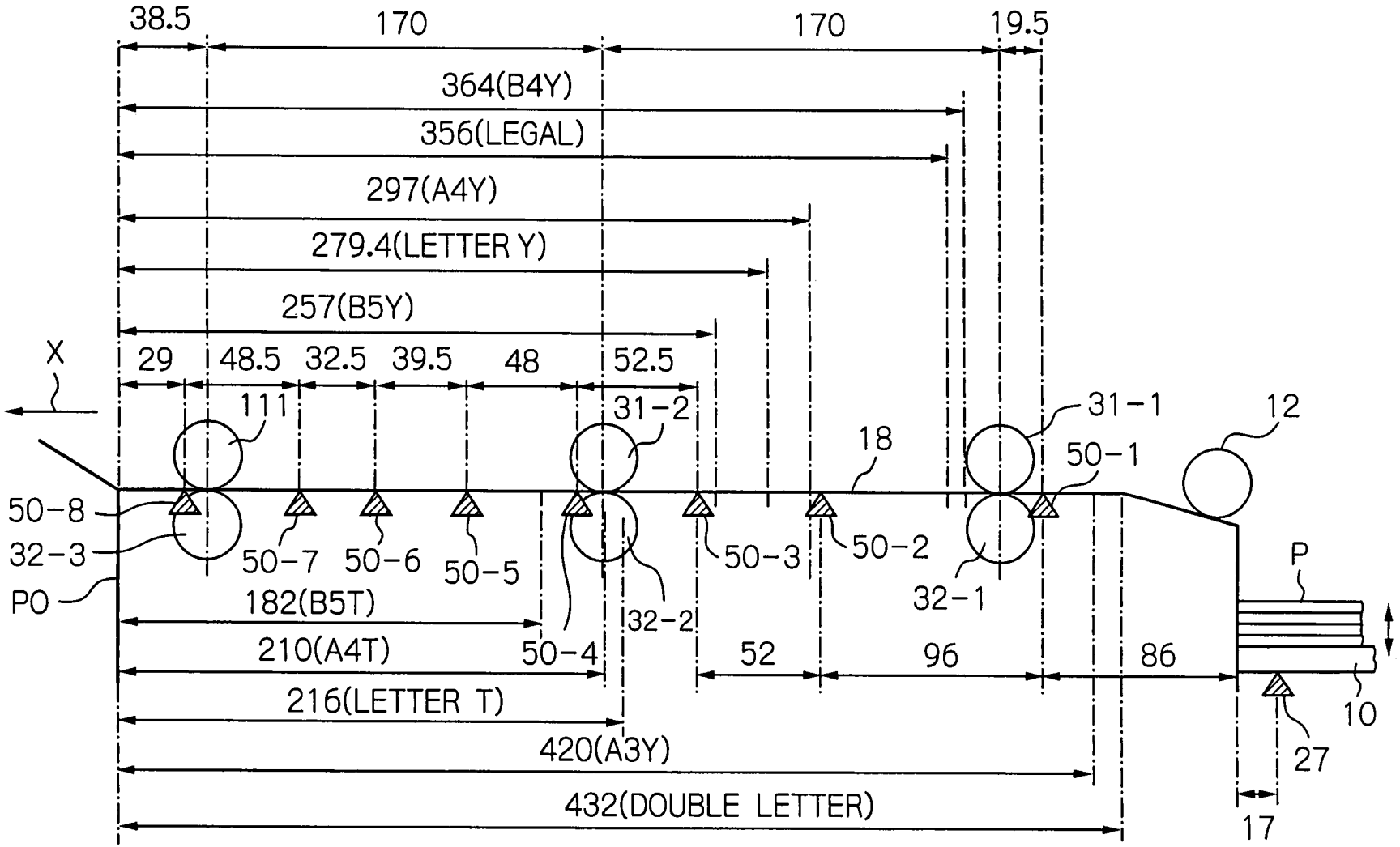
FIG. 11 is a diagram for describing the paper transporting means and the placement/dimensions of the paper detecting means (sensors 1 through 8) in the intermediate conveyor, as well as various paper sizes.
Figure 14:
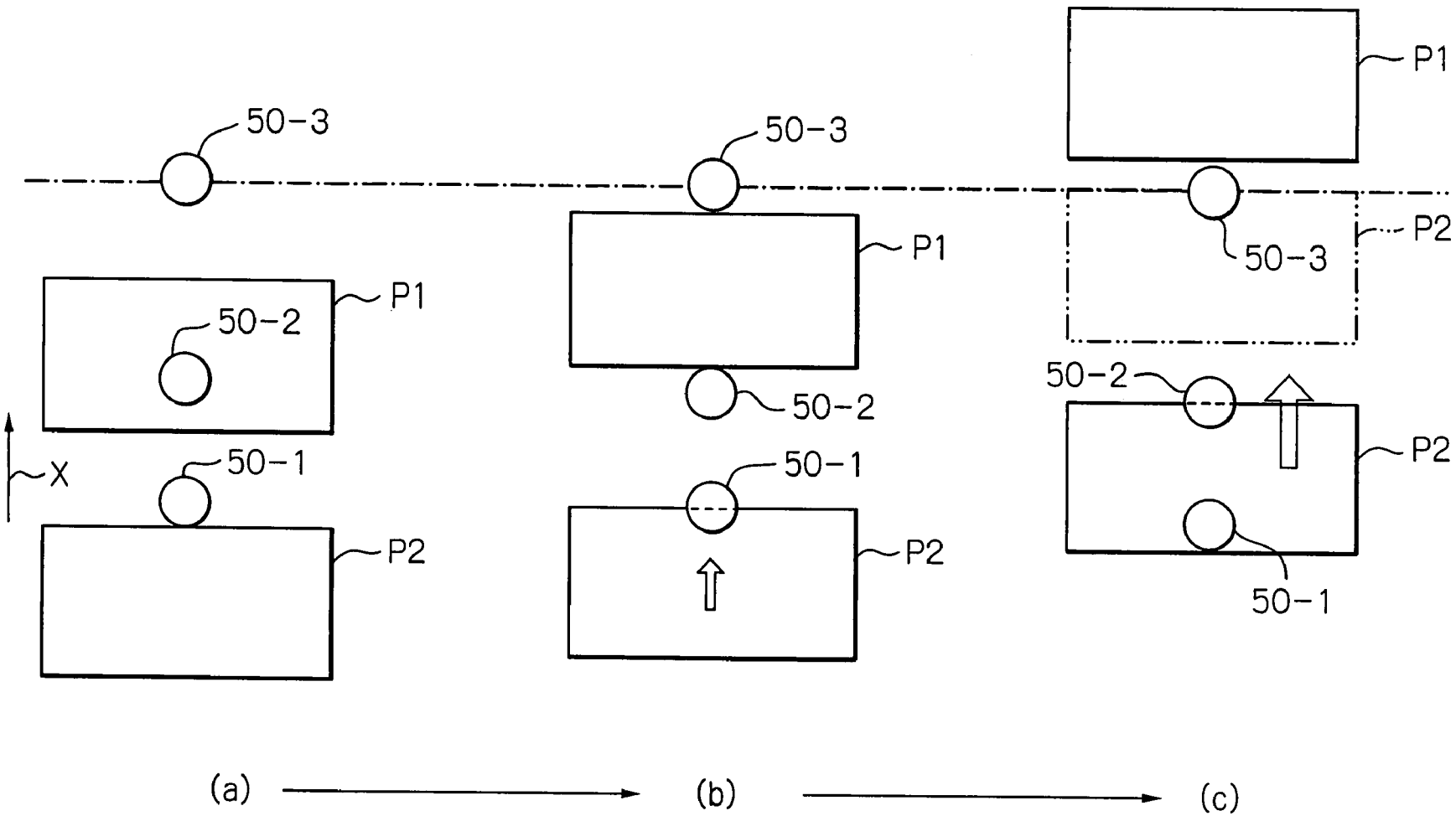
FIG. 14 is a plan view for describing the principle of paper transport control in the present embodiment.

The first through eighth sensors 50-1 through 50-8, specifically, are disposed/fixed on the upper guide plate 35 at the dimensional intervals shown in FIG. 11 from upstream to downstream along the paper transport direction X in the intermediate transport path 18. As indicated by parenthesis in the same figure and depicted in FIG. 14, this is set so that the length of the paper P along the paper transport direction X corresponds to ten types of paper sizes. In FIGS. 11 and 14, for the sake of reference, the A3Y (transversal) size corresponds to a length of 420 mm along the paper transport direction X, the A4T (longitudinal) size corresponds to a length of 210 mm along the paper transport direction X, and the DLY (double letter) size corresponds to a maximum length in the present embodiment of 432 mm along the paper transport direction X.

Also, for the DLY (double letter) size, the paper transport length of the intermediate transport path 18 is set to 480 mm. In FIG. 11, examples are cited in which the distance from the nip center formed by the first pressing rollers 31-1 and the first transporting rollers 32-1 to the nip center formed by the second pressing rollers 31-2 and the second transporting rollers 32-2 is 170 mm, and in which the distance from the nip center formed by the second pressing rollers 31-2 and the second transporting rollers 32-2 to the nip center formed by the main feeding roller 111 of the main feeder 104 and the third transporting roller 32-3 is 170 mm.

A supplementary description will be given herein of an embodiment of the main positional relationship between the printing unit 102 of the stencil printer 100, the main feeder 104, and the intermediate conveyor 4 in a situation in which the bulk feeding/transporting unit 1 occupies the connected position as depicted in FIG. 1.

The distance from the nip center, when the printing drum 115 and press roller 116 are pressed together, to the nip center of the registering rollers 114 is approximately 120 mm, the distance from the nip center of the registering rollers 114 to the nip center formed by the main feeding roller 111 in contact with the third transporting roller 32-3 is approximately 120 mm, and the distance from the nip center of the printing drum 115 and press roller 116 to the nip center of the main feeding roller 111 and third transporting roller 32-3 is approximately 240 mm. Consequently, when feeding is performed from the intermediate conveyor 4 to the main feeder 104 using the shortest size, B5T (182 mm), the region from the point at which the leading edge of the B5T reaches the nip of the printing drum 115 and press roller 116 to the location of the trailing edge of the B5T is equal to the space between the registering rollers 114 and the main separating roller 112.

This description is approximate, but the upper roller of the registering rollers 114 is configured so as to be able to connect with and separate from the lower roller by means of a connecting and separating mechanism equipped with biasing means for a timing cam (not pictured), tension wing, or the like. By means of this configuration, the upper roller of the registering rollers 114 is separated from the lower roller by the above-mentioned mechanism to prevent the pressure load on the nip of the registering rollers 114 from being imposed on the paper, the rotation of the printing drum 115, and the like in a state in which the leading edge of paper and a certain amount of the length thereof are held fast in the nip of the printing drum 115 and press roller 116. For the same reasons, an arrangement is put in place whereby as little as possible of the load created by the driving force transmitting means, feeding motor 122 (stepping motor), and other components connected to the main separating roller 112 and main feeding roller 111 by the one-way clutch mounted to the shafts of the main separating roller 112 and main feeding roller 111 is applied to the transported paper, the rotation of the printing drum 115, and the like.

Also, high-precision paper transport can be performed easily because the first through third electric motors 33-1 through 33-3 consisting of shared stepping motors are used in the present embodiment, and the paper transport distance (or the quantity of paper transported) can be controlled by the number of pulses delivered to the stepping motors when paper is transported in the intermediate transport path 18 having the pre-determined distances described above or in the paper transport path on the side of the stencil printer 100. The same applies to the feeding motor 22, feeding motor 122 on the side of the stencil printer 100, and a registering motor (not pictured) made up of stepping motors for rotatably driving the registering rollers 114 of the main feeder 104.

A description of the constituent elements of the control system used by the present embodiment that includes a supplementary description of the constituent elements described above will be given with reference to FIG. 12.

Figure 12:
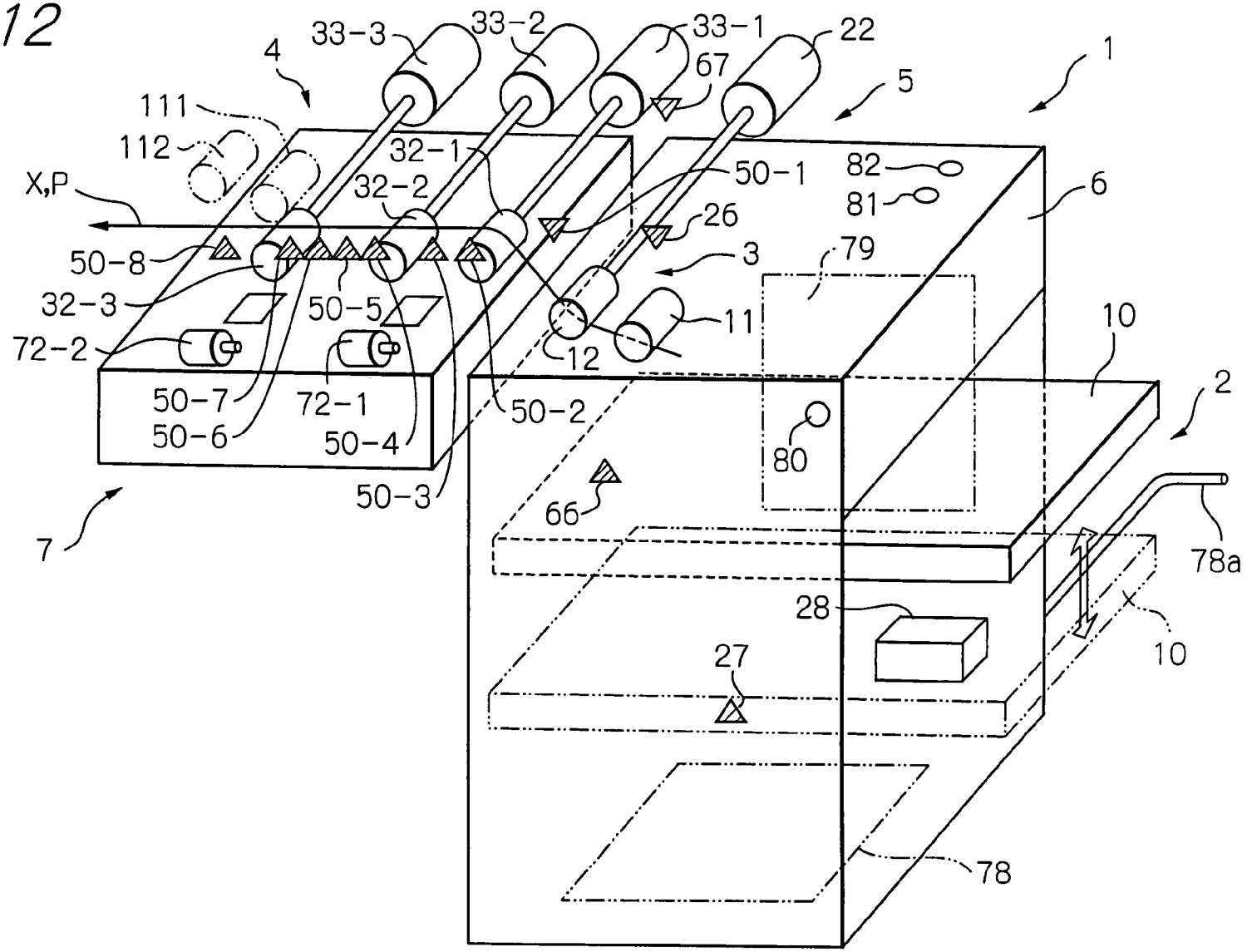
FIG. 12 is an oblique view schematically showing the placement of constituent elements of the primary control system in the bulk paper-transporting unit.

In FIG. 12, "78" indicates a power supply table; "78a" indicates a power cable for connecting to an external power supply used by a business, for example; "79," depicted by a double-dashed line, indicates a control table on which the hereinafter described control device and the like are mounted; "80" indicates a power switch for switching electrical power on and off, supplied via the power cable 78*a*; "81" indicates a reset switch as a means for initializing operation of the bulk feeding/transporting unit 1, or, specifically, establishing initial settings for giving instructions to activate an initialization (or initial setting) state; and "82" indicates a feeding table lowering switch for controlling the electric elevating motor 28 and giving actuation instructions for lowering the bulk feeding table 10 by being pressed for a prescribed time.

The power switch 80 is disposed in the left-hand panel on the operating side, and the reset switch 81 and feeding table lowering switch 82 are disposed on top of the body chassis 6, which can also be referred to as an operating panel for the bulk feeding/transporting unit 1. When paper is replenished/added to the bulk feeding table 10 of the carrier 2, the feeding table lowering switch 82 is operated when the bulk feeding table 10 is to be lowered, serviced, or the like in cases in which the bulk feeding table 10 is lowered by an amount corresponding to the amount of added paper to feed additional paper thereto, or in which jamming or the like occurs in the paper feeding mechanism 3 or the like.

Figure 13:
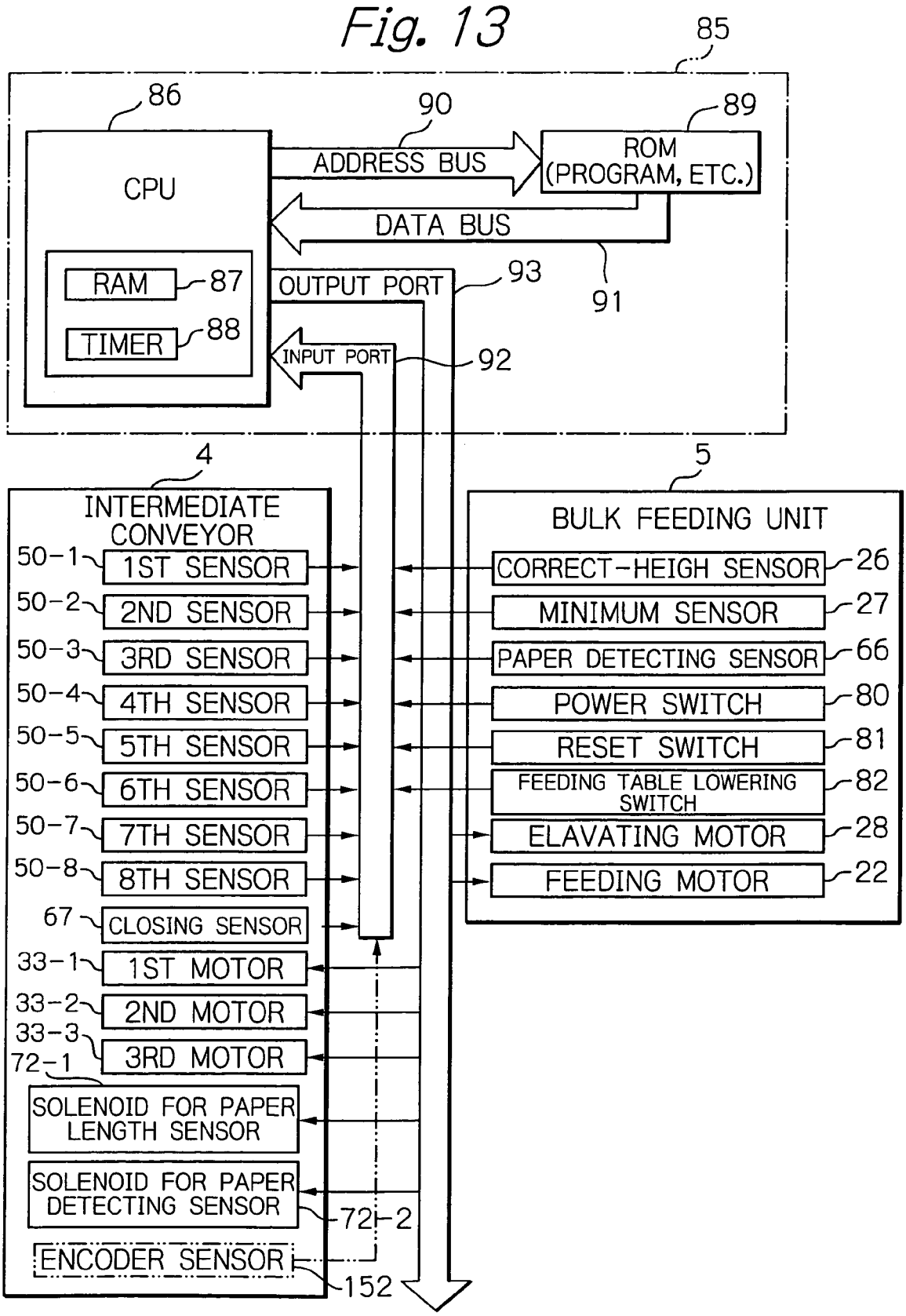
FIG. 13 is a block diagram depicting the structure of the main electrical control system of the bulk paper-transporting unit.

FIG. 13 depicts the main structure of the control system of the bulk feeding/transporting unit 1 in block format. In the figure, the control device 85 has an internal CPU 86 (central computational processing unit); RAM 87 (readable/writable storage device); a timer 88 as a timekeeping means; ROM 89 (read-only storage device); and the like, and is equipped with a microcomputer having a structure in which the CPU 86 and ROM 89 are connected by an address bus 90 and data bus 91, and the CPU 86, RAM 87, and timer 88 are each connected by a signal bus (not pictured). The control device 85 is disposed on the mount of the control table 79 depicted in FIG. 12.

The CPU 86 is electrically connected, via a sensor input circuit or switch input circuit (not pictured) and the input port 92, to the correct-height sensor 26, the minimum sensor 27, paper-detecting sensor 66, power switch 80, reset switch 81, and feeding table lowering switch 82 provided in the bulk feeding unit 5; as well as to the opening and closing sensor 67 and the first through eighth sensors 50-1 through 50-8 in the intermediate conveyor 4 via sensor input circuits (not pictured) and the input port 92, and receives various signals from these sensors and switches. Also, the encoder sensor 152 indicated by a double-dashed line as an element of the control structure of the intermediate conveyor 4 is not included in the present embodiment, but is used in a modification described hereinafter.

The CPU 86 is electrically connected to the electric elevating motor 28 and the feeding motor 22 in the bulk feeding unit 5 via a motor driving circuit (not pictured) and an output port 93, as well as to the first through third electric motors 33-1 through 33-3 provided in the intermediate conveyor 4, and to the solenoid 72-1 for the paper length sensor and the solenoid 72-2 for the paper-detecting sensor via a motor drive circuit (not pictured), solenoid drive circuit, and the output port 93. The CPU transmits various command signals for controlling the operation of the above-mentioned electric motors, solenoids, and the like and controls the overall system of operation for starting/stopping, timing, and the like of the bulk feeding/transporting unit 1 based on various signals from the above-mentioned sensors and switches and on operation-related programs retrieved from the ROM 89.

ROM 89 stores programs depicted in the flowchart described hereinafter for indicating the flow of the overall operation of the bulk feeding/transporting unit 1 or the operation of paper transport, and various relational data for allowing the CPU 86 to perform its control functions, and these operating programs and relational data are appropriately retrieved by the CPU 86. The RAM 87 has a function for temporarily storing the computational results of the CPU 86, and a function for periodically storing various set/inputted ON/OFF signals, data signals, and other various signals from the above-mentioned switches and sensors. The timer 88 functions as a timekeeping means for measuring the time taken for the trailing edge of the paper P to travel between the sensors 50-1 through 50-8 when transport of the paper P on the sensors 50-1 through 50-8 begins in response to initiation of feeding by the main feeding roller 111 with the aid of the feeding motor 122 of the stencil printer 100.

First, the CPU 86 (sometimes referred to hereinafter as "control device 85" for convenience in description) has a control function as a means of determining the paper size and performing control for changing the system of the transporting rollers 32-1 through 32-3 for controlling paper transport based on signals from the sensors 50-1 through 50-8 during a reset time, which is the time when initialization is performed after transport of a sheet of paper P over the sensors 50-1 through 50-8 is completed.

In the state established at the time of the above-mentioned reset, paper P is located in the third transporting roller 32-3 disposed furthest downstream in the intermediate transport path 18, and the position at which the leading edge of the paper P can be fed by the main feeding roller 111 indicated by the double-dashed line in FIG. 12 is set in advance to become the stopping position P0 depicted in FIG. 11. Also, as shown in FIG. 11, the stopping position P0 is set to a position about 38.5 mm down the paper transport direction X from the nip center formed by the pressing together of the main feeding roller 111 and third transporting roller 32-3.

The control function of the first control device 85 (CPU 86) can be described in other words as consisting of determining the paper size and controlling the electric motors 33-1 through 33-3 so as to change the paper transport control system of the transporting rollers 32-1 through 32-3 based on signals from the sensors 50-1 through 50-8 during initialization when transport of a sheet of paper P over the sensors 50-1 through 50-8 is completed.

Second, to perform the above-mentioned first control function, the control device 85 (CPU 86) executes a control function as a control means designed to add a signal relating to the time measurement obtained by measuring the time between any of the sensors 50-1 through 50-8 as preset by the timer 88, and to vary the paper transport speed in addition to the first control function.

Because the first through third electric motors 33-1 through 33-3 made up of shared stepping motors are used in the present embodiment, the paper transport speed (peripheral velocity or rotational speed) of the first through third transporting rollers 32-1 through 32-3 can be easily and reliably varied by changing the frequency of pulses (pps: pulse per second) delivered to the first through third motors 33-1 through 33-3 by the control device 85 (CPU 86), or, specifically, by changing the pulse interval (narrowing the pulse interval produces higher speed, a constant interval produces constant speed, and widening the pulse interval produces lower speed).

Before describing the details of the control operation specific to the bulk feeding/transporting unit 1 performed by the control device 85, the theoretical details of controlling the paper transport operation in the intermediate conveyor 4 will next be described based on FIG. 14. In the figure, in order to simplify description, a simple description will first be given of the paper transport control system as relates to the positions of the leading edges and trailing edges of a front sheet P1 and a subsequent sheet P2 by using the first through third sensors 50-1 through 50-3 disposed at prescribed intervals in the paper transport direction X. Hereinafter, the front sheet P1 consists of paper resting on the intermediate transport path 18 of the intermediate conveyor 4 that is taken in by the main feeder 104, and the subsequent sheet P2 consists of paper that is continuously fed/transported from the bulk feeding table 10 and paper feeding mechanism 3 to the intermediate transport path 18 subsequent to the front sheet P1. Also, in general, "front sheet P1" can be rewritten "Pn," and "subsequent sheet P2" can be rewritten "Pn+1," where "n" is a positive integer.

First, as shown in "(a)" in FIG. 14, the trailing edge of the front sheet P1 has not passed the second sensor 50-2, so the leading edge of the subsequent sheet P2 is stopped in a position short of where it would be detected by the first sensor 50-1 disposed furthest upstream in the paper transport direction X. In this case, even after the leading edge of the subsequent sheet P2 is detected by the first sensor 50-1, the subsequent sheet P2 advances by the slowdown distance required due to the inertia of the corresponding transporting roller (this can be assumed to be the inertia of the transporting roller, because it houses a one-way clutch 61 such as previously described) and stops.

As shown in "(b)" in FIG. 14, transport of the subsequent sheet P2 begins as soon as the trailing edge of the front sheet P1 then passes the second sensor 50-2 (blocking/reflecting of the reflecting sensor changes to transmitting). The subsequent sheet P2 is transported onward until the leading edge of the subsequent sheet P2 is detected by the second sensor 50-2. Whether the subsequent sheet P2 continues to be transported downstream in the paper transport direction X or is stopped depends on the positional relation between the trailing edge of the front sheet P1 and the third sensor 50-3, and the paper size along the paper transport direction X (hereinafter referred to as the "paper size").

As shown in "(c)" in FIG. 14, when the trailing edge of the front sheet P1 has passed the third sensor 50-3, the subsequent sheet P2 passes the second sensor 50-2 without losing speed (paper transport speed), as indicated by the double-dashed line in the figure, and the leading edge thereof is then able to reach the third sensor 50-3. However, when the trailing edge of the front sheet P1 has not passed the third sensor 50-3, the subsequent sheet P2 is stopped at the position of the second sensor 50-2 indicated by the solid line in the figure.

Thus, the present embodiment entails performing a special type of control whereby the paper transport control system is switched such that sequential transport can be performed without allowing the trailing edge of the front sheet P1 to come into contact with the leading edge of the subsequent sheet P2 while continually detecting the position of the leading edges and trailing edges of the front sheet P1 and subsequent sheet P2 with the sensors 50-1 through 50-8, or, in other words, whereby a preset paper transport control pattern is selected from the ROM 89, and the paper transport speed of the transporting rollers 32-1 through 32-3 is varied. By means of the present embodiment, the structure for detecting paper size can be simple and inexpensive because the ten types of paper sizes shown in FIGS. 11 and 15 can be detected by a minimum of eight sensors 50-1 through 50-8.

Consequently, the present invention is not limited to the eight sensors 50-1 through 50-8 disposed in the intermediate transport path 18 such as in the present embodiment, for example, and also apparently allows varying the starting/stopping or paper transport speed of the transporting rollers 32-1 through 32-3, for example, so as to enable sequential transport without allowing the trailing edge of the front sheet P1 (Pn) to come into contact with the leading edge of the subsequent sheet P2 (Pn+1) even in cases such as those in which the sensors consist of first through Nth sensors 50-1 through 50-N, where N is generally substituted with positive integers and a plurality of sensors are disposed therein (more than eight, for example), and in which the intermediate transport path 18 is elongated past the length described above, and also in cases in which three or more sheets of paper P are resting on the first through Nth sensors 50-1 through 50-N.

As described above, the present invention is not limited to the above-mentioned present embodiment, and may be configured such that the intermediate conveyor has a plurality of paper transporting means that are disposed at intervals from upstream to downstream along the intermediate transport path and are designed for transporting paper fed from the feeding mechanism, and a plurality of first through Nth sensors 50-1 through 50-N as paper detecting means that are disposed at intervals from upstream to downstream along the intermediate transport path and are designed for detecting at least one of either the leading edge or trailing edge of the paper being fed.

The paper transporting operation particularly characteristic of the intermediate conveyor 4 of the bulk feeding/transporting unit 1, performed by the control device 85, will be described with reference to FIGS. 11 and 15 through 18B.

As specifically depicted in FIG. 11, the paper size is detected in the present embodiment by the control device 85 based on a signal from the sensors 50-1 through 50-8 once a sheet of paper P is stopped after having been transported over the sensors 50-1 through 50-8 via the operation carried out during the resetting described in detail hereinafter, or, specifically, in a stopping position P0 in which the sheet of paper P in the diagram, or, in other words, the leading edge of the front sheet P1, is held by the nip between the main feeding roller 111 and the third transporting roller 32-3.

Also, during resetting, when the paper P is of the longest DLY (double letter) size and A3Y size in the paper transport direction X, the fact that the eighth sensor 50-8 through first sensor 50-1 are ON indicates that the paper is of the maximum length by being positioned on sensors (strictly speaking, under the sensors) from the eighth sensor 50-8 to the first sensor 50-1. Also, when the paper P is of the shortest B5T size, the fact that the eighth sensor 50-8 through sixth sensor 50-6 are ON indicates that the paper is of the shortest length by being positioned on sensors from the eighth sensor 50-8 to the sixth sensor 50-6.

The reason is that when an attempt is made to establish a low printing speed in the table in FIG. 15, particularly, 16 rpm or 30 rpm (rotational speed (sometimes the paper transport speed that corresponds to the peripheral velocity) of the printing drum 115 during versioning or test printing for affixing a manufactured thermal stencil master plate to the external peripheral surface of the printing drum 115 depicted in FIG. 1 by ink adhesion) while paper transport is stopped during resetting of B5T, which is the shortest paper P size in the present embodiment, the paper is reliably detected by the ON/OFF state of the sixth sensor 50-6 to allow a margin of error because, since the paper P is short, a state occurs in which two of the paper transporting means 30 (pressing rollers 31 and transporting rollers 32) from among the first through third paper transporting means 30-1 through 30-3 do not hold/transport the paper, and so the inertia, particularly of the third transporting roller 32-3 furthest downstream from among the first through third transporting rollers 32-1 through 32-3, causes the paper to overrun the fifth sensor 50-5 regardless of the braking force applied by the leaf spring 62 depicted in FIGS. 9A and 9B.

In the table in FIG. 15, "other speeds" are printing speeds during normal printing, and may be 60 to 120 rpm, for example. The entry "initial position of paper trailing edge: between sensors ( . . . 0 to 5)" refers to a sensor signal corresponding to the first through eighth sensors 50-1 through 50-8 for detecting the trailing edge of a sheet of paper P during resetting. In this example, the sensor number "0" indicates the position of the separating roller 12. The "second-sheet intake sensor" indicates the sensor number of a sensor for detecting the leading edge of a subsequent sheet to enable the subsequent sheet to be transported after the front sheet has been transported. The sensor number of the second-sheet intake sensor is shown in parenthesis in the table and corresponds to a number in the transporting types 1 through 6 described hereinafter. In this sense, the second-sheet intake sensor for the case of paper P size B5T also includes the fifth sensor 50-5 as well as the sixth sensor 50-6 shown in the table, based on the details described above.

From the above description, the paper transport control patterns pertaining to the paper transport control system when a sheet of paper P is separated and fed from the bulk-feeding unit 5 can be classified into the six transport types listed below. In other words, these types refer to control for determining when transport of the subsequent sheet P2 is begun when the leading edge of the front sheet P1 in the intermediate conveyor 4 is taken away by the main feeding roller 111 of the stencil printer 100 beginning to rotate. Because the intermediate transport path 18 is comparatively short in the present embodiment, only one sheet of paper P is transported in sequence, but it is also apparent that transport control can be performed for any number of sheets of paper P on the intermediate transport path according to the paper sizes that the length of the intermediate transport path of the intermediate conveyor can accommodate.

The same paper transport control processing as described above is performed in transport types 5 and 6 below.

Transport type 1: eighth sensor 50-8 through first sensor 50-1 are ON

Transport type 2: eighth sensor 50-8 through second sensor 50-2 are ON

Transport type 3: eighth sensor 50-8 through third sensor 50-3 are ON

Transport type 4: eighth sensor 50-8 through fourth sensor 50-4 are ON

Transport type 5: eighth sensor 50-8 through fifth sensor 50-5 are ON

Transport type 6: eighth sensor 50-8 through sixth sensor 50-6 are ON

Figure 16:
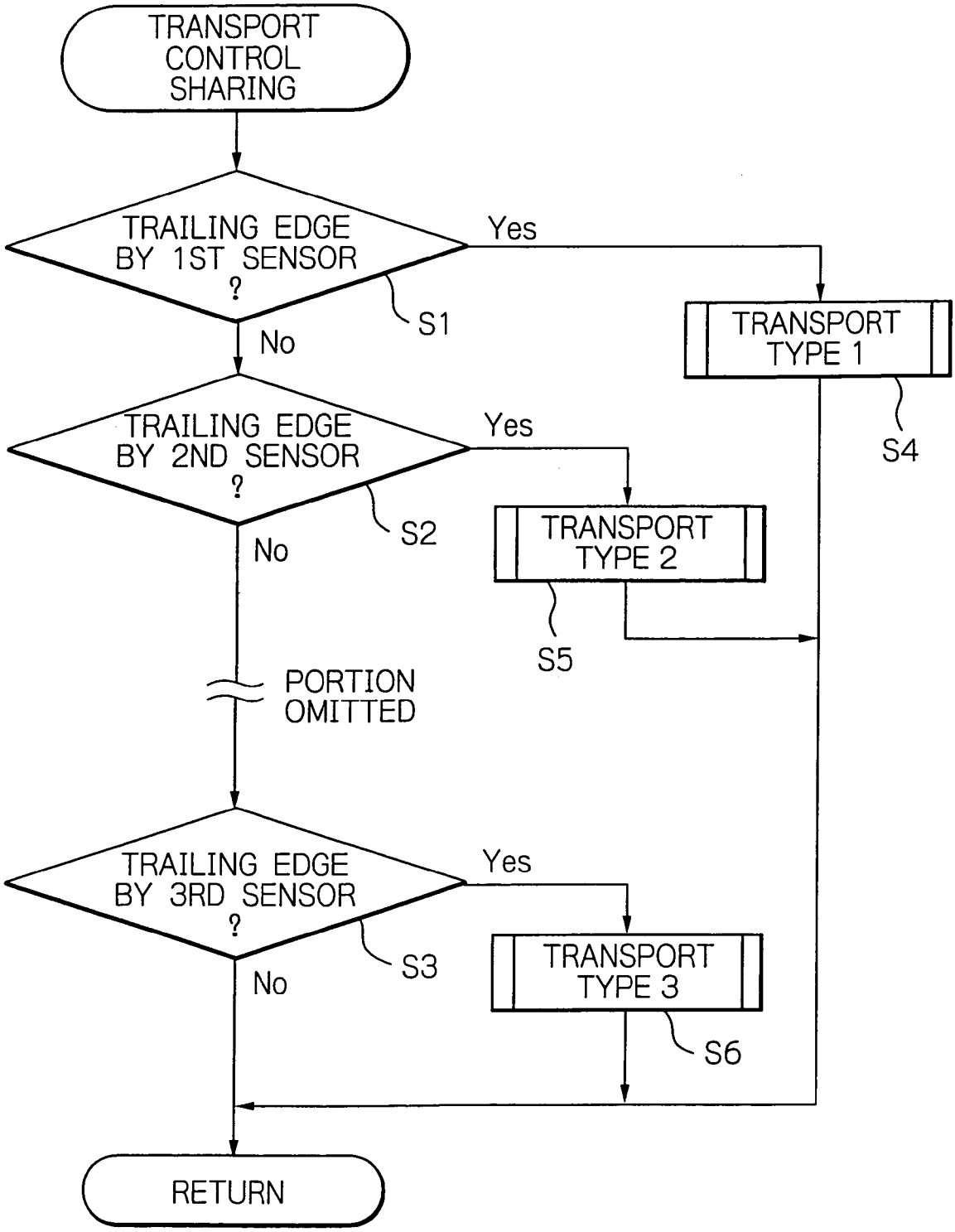
FIG. 16 is a flowchart pertaining to the transport control sharing procedure called up after completion of a reset operation in the present embodiment.

The flowchart in FIG. 16 shows the transport control sharing procedure pertaining to transport types 1 through 6 called up from the ROM 89 after completion of a reset operation by the control device 85 (CPU 86).

It is first determined in step S1 in the figure whether or not the trailing edge of a sheet of paper P is positioned in the first sensor 50-1 during resetting. If the trailing edge of the paper P is positioned in the first sensor 50-1 (first sensor 50-1/ON), the process proceeds to step S4 and the paper transport control subroutine program pertaining to transport type 1 is executed. If the trailing edge of the paper P is not positioned in the first sensor 50-1 (first sensor 50-1/OFF), the process proceeds to step S2 and it is determined whether or not the trailing edge of the paper P is positioned in the second sensor 50-2. If the trailing edge of the paper P is positioned in the second sensor 50-2, the process proceeds to step S5 and the paper transport control subroutine program pertaining to transport type 2 is executed. If the trailing edge of the paper P is not positioned in the second sensor 50-2, it is determined whether or not the trailing edge of the paper P is positioned in the third sensor 50-3. Since the details of the intervening transport types 3 through 5 are the same as described above, description thereof is omitted.

An example of paper transport control at other speeds and short sizes (A4Y, B5Y, and letter Y sizes shown in FIG. 15) in accordance with transport type 3 executed under the control of the control device 85 will be described with reference to FIGS. 15 through 18B. As an intermediate transport condition, the feeding motor 22 and first through third electric motors 33-1 through 33-3 are controlled to produce a constant paper transport speed by the feeding roller 11, separating roller 12, and first through third transporting rollers 32-1 through 32-3. The paper transport speed at this time is set (in the embodiment, the speed is set to a slightly higher speed of 1,370 mm/sec than the 1,130 mm/sec equivalent) to substantially correspond to the maximum printing speed of 120 rpm by the printing drum 115 (equivalent to a converted paper transport speed of 1,130 mm/sec). The feeding motor 122 of the stencil printer 100 is controlled by a control device (not pictured) so that the paper transport speed by the main feeding roller 111 and main separating roller 112 of the stencil printer 100 is also the same as described above.

As depicted in FIG. 15, the initial position of the trailing edge of the paper in the short size transport type 3 is between the third sensor 50-3 and the second sensor 50-2, and the second-sheet intake sensor is at a time in which the third sensor 50-3 is OFF.

Figure 17:
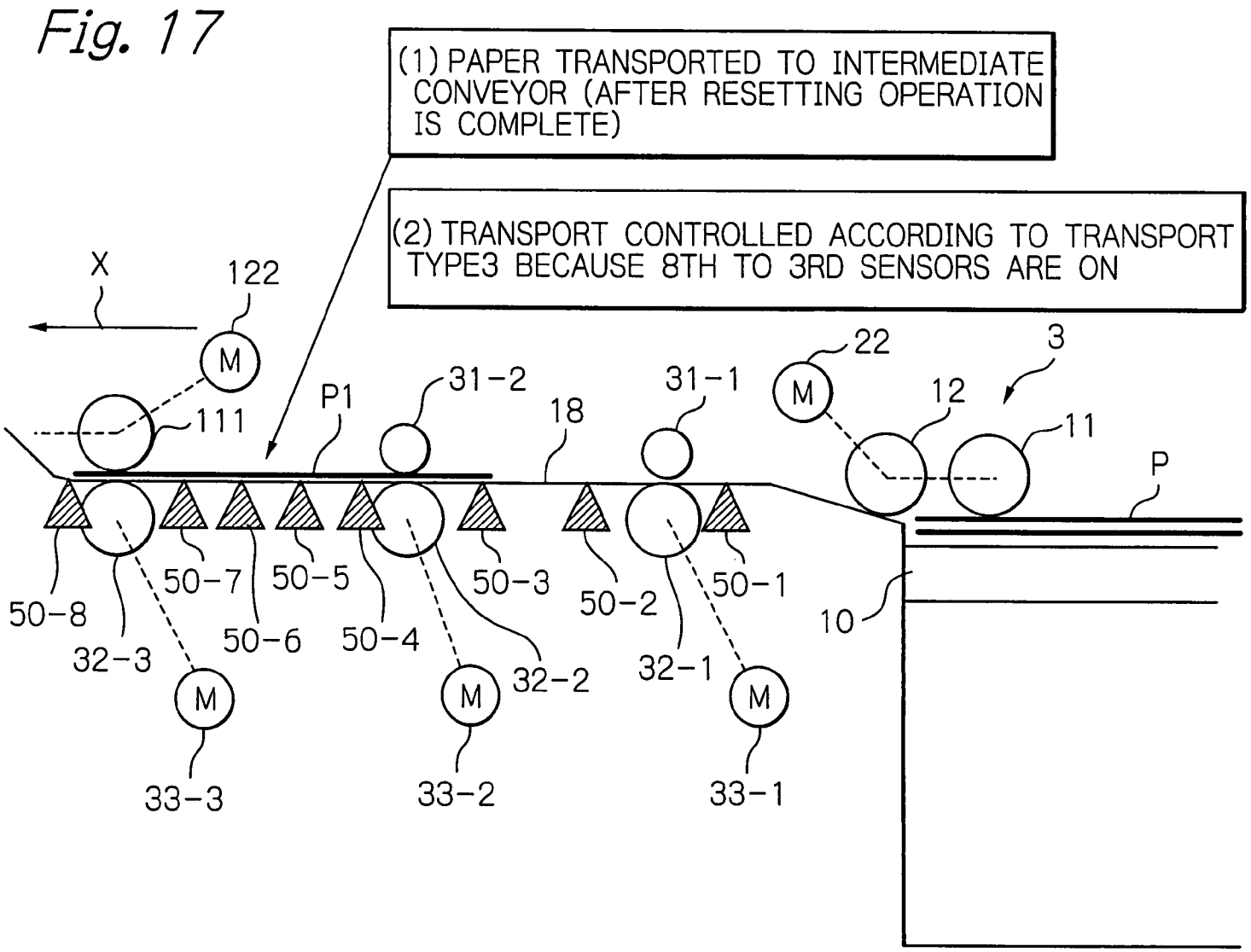
FIG. 17 is a front view depicting a state in which short size paper is in the intermediate conveyor path after completion of a reset operation in the present embodiment.

FIG. 17 depicts a front sheet P1 after the topmost sheet of paper P on the bulk-feeding table 10 is separated, taken in, and fed/transported in the intermediate transport path 18, and the reset operation is completed. Because the reset stopping state of the front sheet P1 denotes a transport type 3 in which the eighth sensor 50-8 through third sensor 50-3 are ON, transport control for transport type 3 is performed.

Figure 18A:
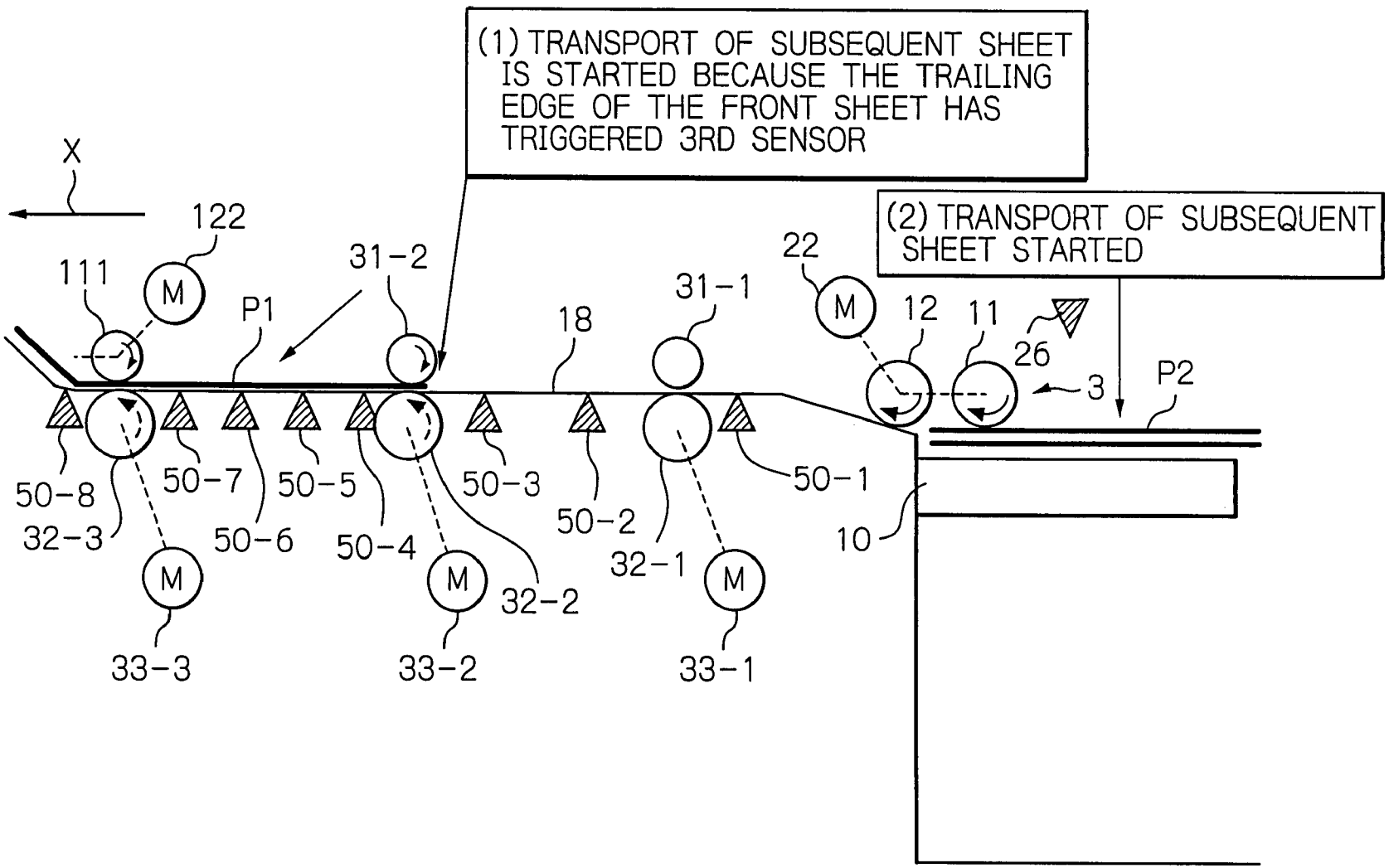
FIGS. 18A and 18B are front views for describing the state of paper transport transition, and control thereof, between subsequent and preceding sheets, continuing from FIG. 17.

The process then proceeds to the state depicted in FIG. 18A. In this state, the front sheet P1 is advanced toward the stencil printer 100 by the start of rotation of the main feeding roller 111 as a result of being induced by the feeding motor 122 of the stencil printer 100, and the figure depicts a state in which the trailing edge of the paper comes out of the third sensor 50-3, and the third sensor 50-3 through first sensor 50-1 are all off. Because the second-sheet intake sensor consisting of the third sensor 50-3 is OFF, a single subsequent sheet P2 separates from the bulk feeding table 10 by the feeding roller 11 and separating roller 12 and begins to be transported to the intermediate transport path 18.

Figure 18B:
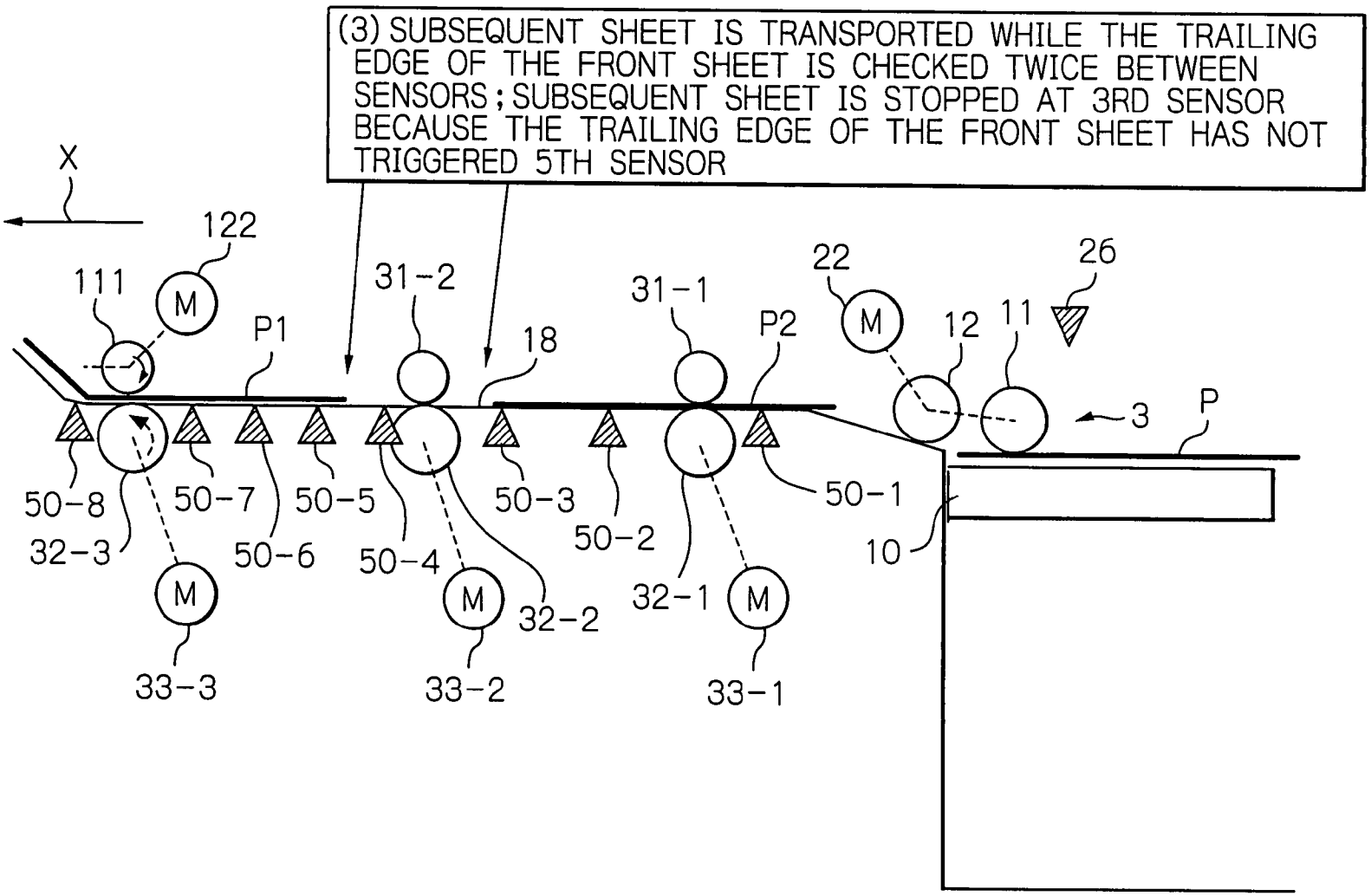

As depicted in FIG. 18B, the subsequent sheet P2 is then transported while the trailing edge of the front sheet P1 is checked by the two sensors consisting of the fourth sensor 50-4 and third sensor 50-3. In this case, the third sensor 50-3 is ON, and the fifth sensor 50-5 that detects the trailing edge of the front sheet P1 is OFF, so the subsequent sheet P2 stops in the position depicted in FIG. 18B.

Thus, after transport has been started for paper P from the bulk feeding table 10, (1) the clearance of a number of the directly preceding sensors 50 (which changes according to paper length) is checked for in order to check for the trailing edge of the front sheet P1. (2) When the trailing edge of the front sheet P1 is not on a prescribed sensor 50 number (in other words, the front sheet P1 has advanced), the subsequent sheet P2 can proceed to the next sensor 50. When the front sheet P1 has not advanced, the subsequent sheet stops until the front sheet P1 advances. (3) The process returns to (1) when the leading edge of the subsequent sheet P2 reaches the next sensor 50. Paper transport control is performed whereby this process repeats until a transport home position (position in which the trailing edge of the paper P passes the eighth sensor 50-8) is attained.

An example of paper transport control executed at low speeds and with short sizes (A4Y, B5Y, and letter Y sizes shown in FIG. 15) in accordance with transport type 3 under the control of the control device 85 will next be described in detail with reference to the flowcharts in FIGS. 21 through 24 and the timing chart in FIG. 25 for the paper transport transition state depicted in FIGS. 19A, 19B, and 20. The flowcharts in FIGS. 21 through 24 begin from step S10. The intermediate transport conditions are the same as in the example depicted in FIGS. 15 through 18B (see step S10).

The stopping state of the single front sheet P1 after completion of the reset operation in the case of this example is the same as is depicted in FIG. 17 (transport type 3, in which the eighth sensor 50-8 through third sensor 50-3 are ON).

The main feeding roller 111 begins to rotate at a constant rotational speed (sometimes, for example, at a peripheral velocity of the main feeding roller 111 that corresponds to the maximum printing speed of 120 rpm (peripheral velocity) of the printing drum 115, specifically, at the paper transport speed) by the actuation of the feeding motor 122 of the stencil printer 100, whereby the front sheet P1 held between the main feeding roller 111 and the third transporting roller 32-3 goes on to be taken in/transported to the main feeder 104. At this time, because the third transporting roller 32-3 is receiving a moderate feed pressure from the main feeding roller 111, it begins to perform forced rotation/slave rotation in the counterclockwise direction, as indicated by the dotted line in FIG. 19, along with the movement of the front sheet P1 by the friction of the front sheet P1 with the high-friction surface (rubber surface) on the external peripheral surface of the third transporting roller 32-3. The load on the third electric motor 33-3 at this time is made so small as to be virtually negligible by the action of the one-way clutch 61 housed in the shaft of the third transporting roller 32-3. Hereinafter, the rotation of the main feeding roller 111, transporting rollers 33-1 through 33-3, separating roller 12, feeding roller 11, and the like will be distinguished by indicating self-powered rotation with a solid line, and forced rotation or slave rotation with a dotted line.

Thus, the front sheet P1 advances toward the stencil printer 100 and the trailing edge of the front sheet P1 comes out of the third sensor 50-3, and it is determined whether or not the third sensor 50-3 through first sensor 50-1 are OFF (see step S11). Specifically, checking of the second-sheet intake sensor depicted in FIG. 15 is performed at this point. The feeding motor 22 and first electric motor 33-1 are started when the third sensor 50-3 through first sensor 50-1 are all OFF, whereby the feeding roller 11 and separating roller 12 begin to rotate clockwise and a single subsequent sheet P2 separates and begins to be transported in the intermediate transport path 18 by the start of rotation of the first transporting roller 32-1 in the counterclockwise direction (see step S12). In step S11, the same determination processing is repeated at such times as when the third sensor 50-3 remains OFF.

Also, in step S12, time measurement by the timer 88 of the control device 85 is initiated, and elapsed time is measured as the trailing edge of the front sheet P1 moves/passes from the third sensor 50-3 to the fifth sensor 50-5 (see FIG. 15).

In step S13, the subsequent sheet P2 is then transported, and it is determined whether or not the second sensor 50-2 has been turned ON by the leading edge of the paper reaching the position thereof. When the subsequent sheet P2 is not transported and the second sensor 50-2 is OFF, the same determination processing is repeated (subsequent description thereof is omitted because this process flow is made clear by the flowchart). If the second sensor 50-2 is ON, the process proceeds to step S14.

In step S14, the front sheet P1 is transported and it is determined whether or not the fourth sensor 50-4 has turned OFF. When the fourth sensor 50-4 is OFF, the process proceeds to step S15, and the second electric motor 33-2 is actuated. When the fourth sensor 50-4 remains ON at this time, the process proceeds to step S35, it is concluded that the front sheet P1 has not been transported and the trailing edge thereof is resting on the fourth sensor 50-4, and actuation of the first electric motor 33-1 is stopped. The front sheet P1 is then transported forward, and it is determined whether or not the fourth sensor 50-4 has turned OFF, in the same manner as described above (see step S36). When the fourth sensor 50-4 is OFF, the process proceeds to step S37, and the first and second electric motors 33-1 and 33-2 are actuated together.

Steps S13 through S15 and steps S35 through S37 described above form a basic checking pattern.

Figure 19A:
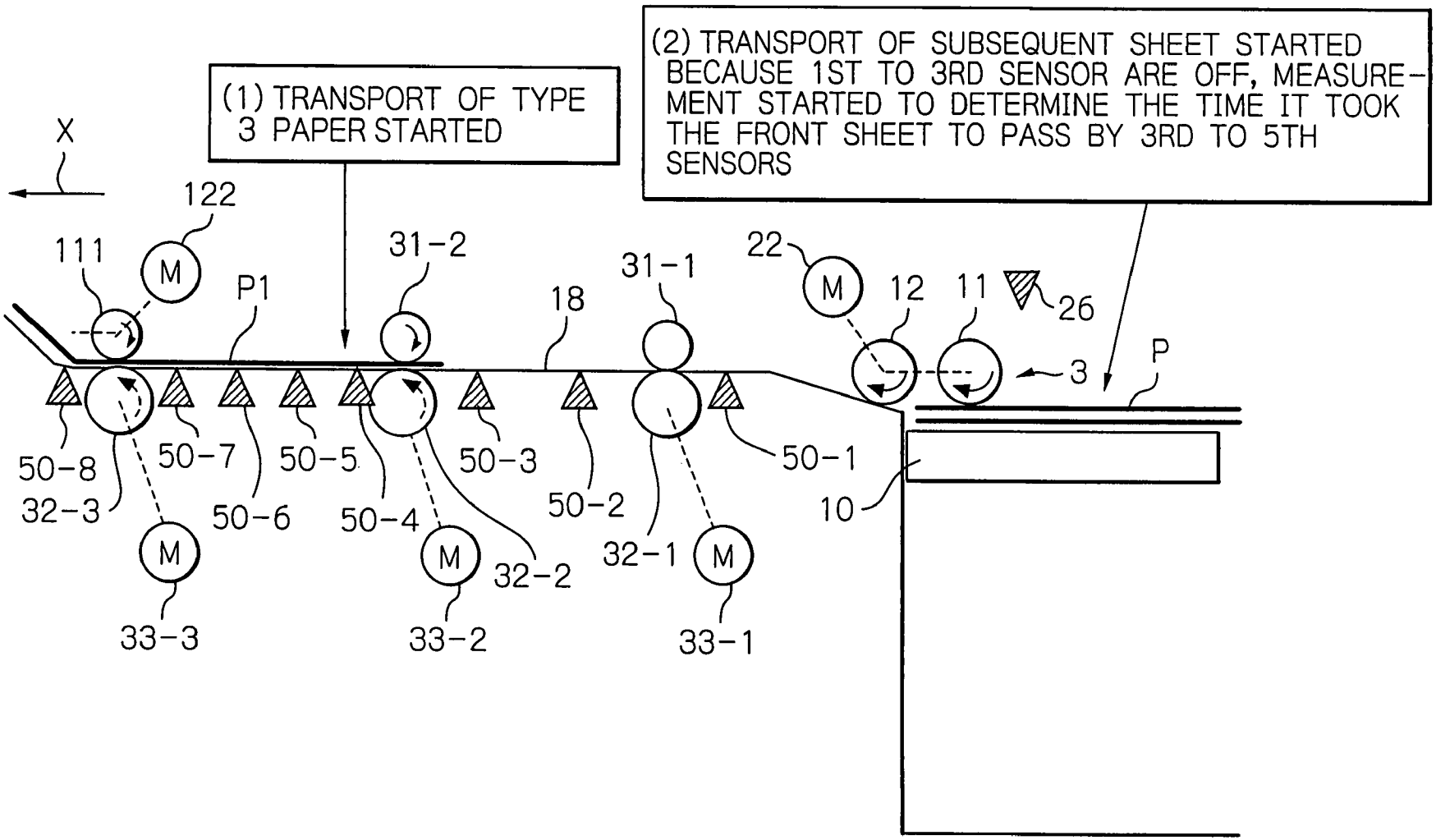
FIGS. 19A and 19B are front views for describing the stat of paper transport transition, and control thereof, between subsequent and preceding sheets in another example of the present embodiment.
Figure 19B:
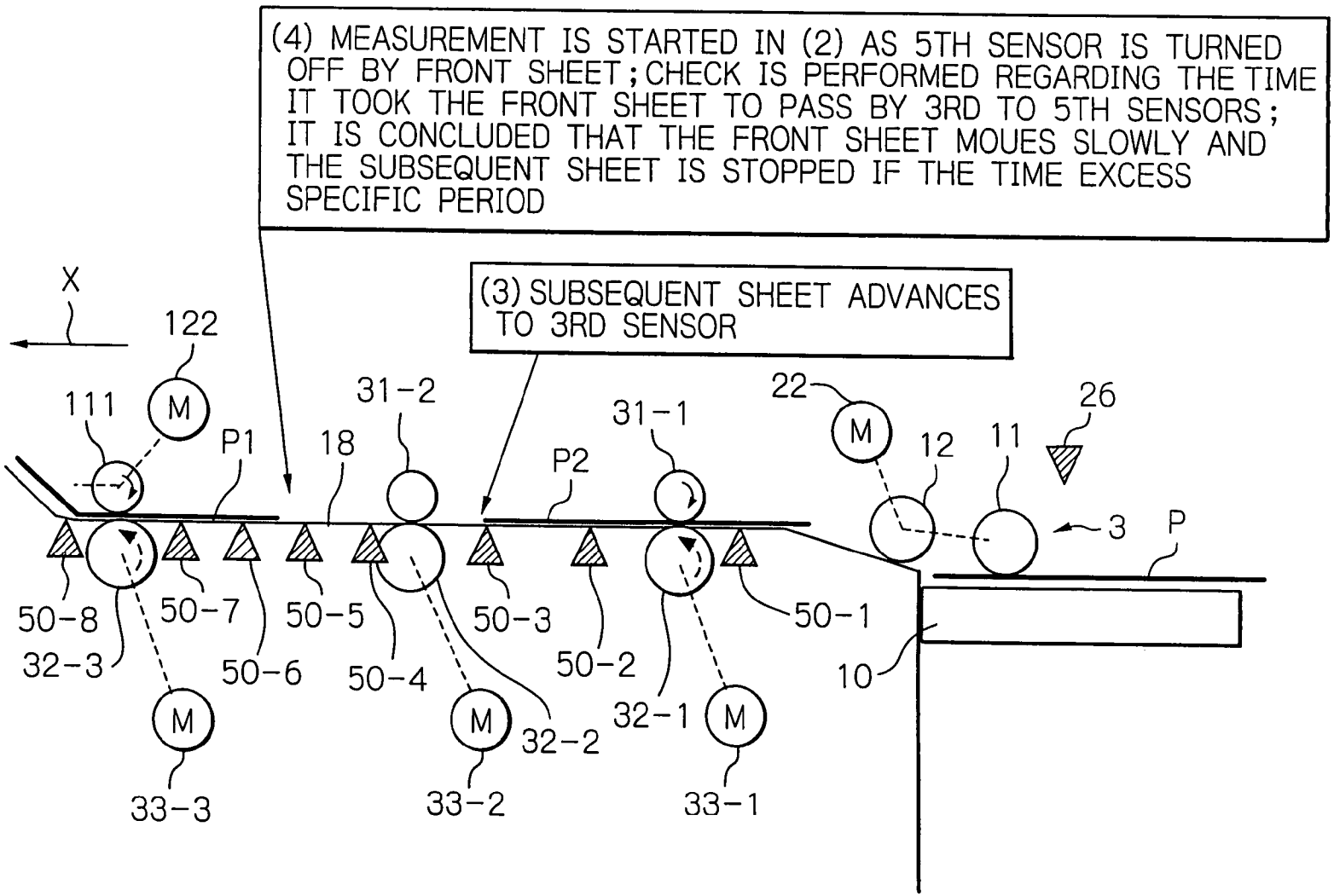
Figure 20:
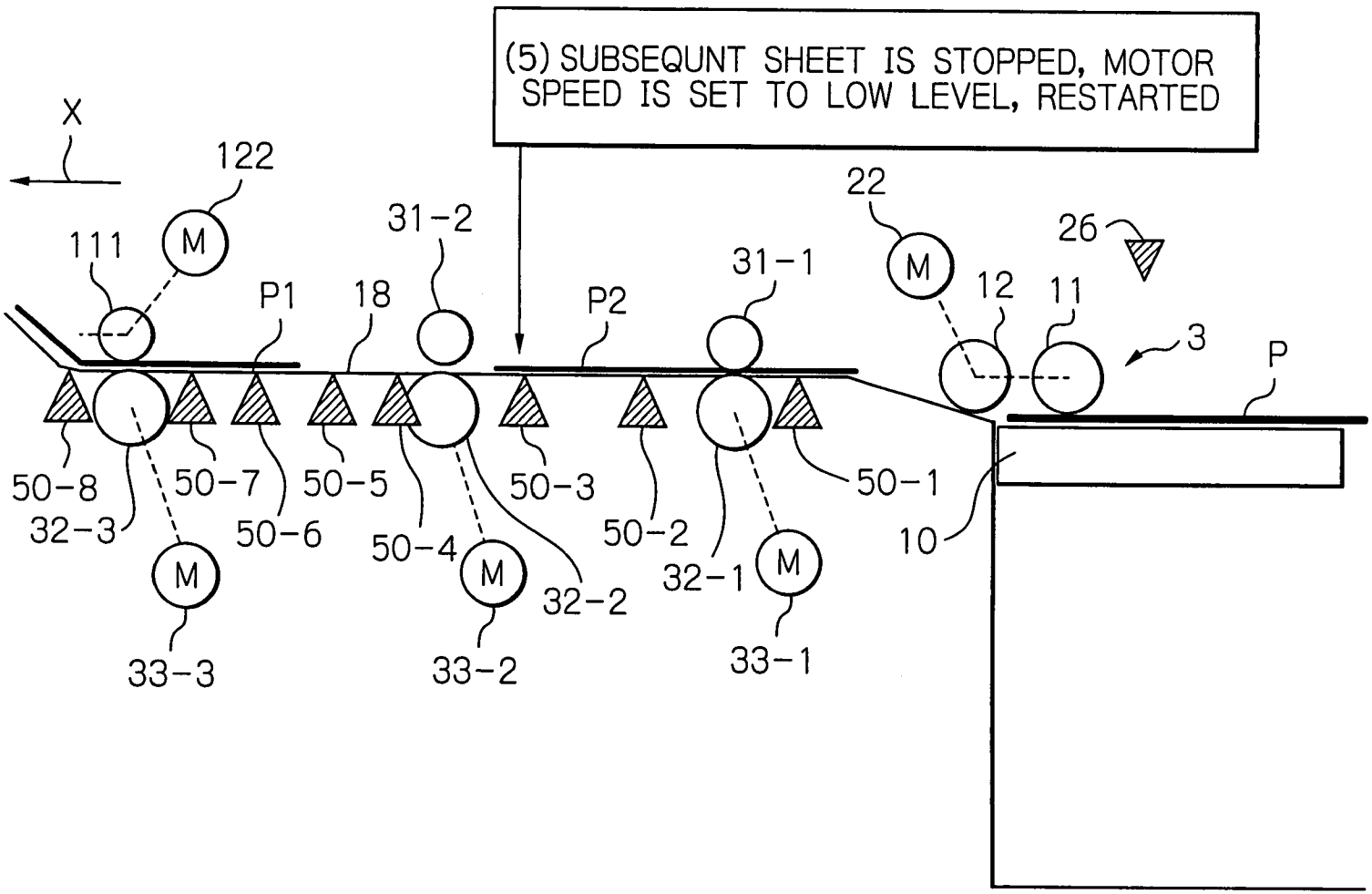
FIG. 20 is a front view of a continuation of FIGS. 19A and 19B.
Figure 21:
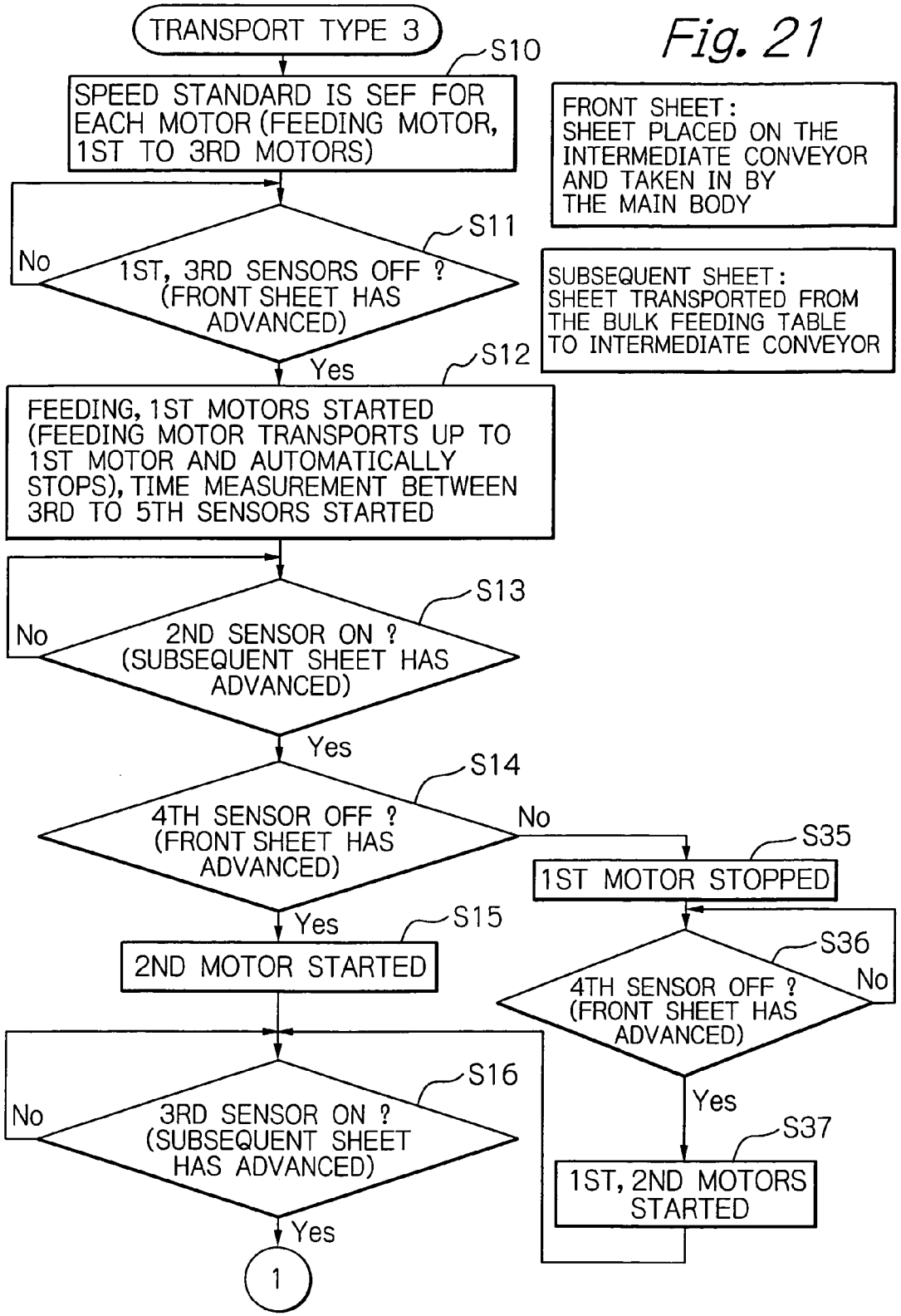
FIG. 21 is a flowchart of the paper transport control pertaining to transport type 3 of the present embodiment.

The subsequent sheet P2 is then transported and it is determined in FIG. 19A and step S16 whether or not the third sensor 50-3 has turned ON. When the subsequent sheet P2 is transported and the third sensor 50-3 has turned ON as a result of being reached by the leading edge of the paper, the process proceeds to step S17 shown in FIG. 22, the front sheet P1 is transported, and it is determined whether or not the fifth sensor 50-5 has turned OFF. At this point, as depicted in FIG. 20, when the front sheet P1 advances and its trailing edge comes out of the fifth sensor 50-5, the CPU 86 assumes based on a signal relating to the time measured by the timer 88 of the control device 85 that the front sheet P1 has low speed, or, specifically, that the paper transport speed of the front sheet P1 (sometimes referred to hereinafter as "front sheet transport speed") is low (for example, 15 or 30 rpm, which is below 60 rpm), and temporarily stops both the first and second electric motors 33-1 and 33-2 so that the subsequent sheet P2 does not advance, in order to prevent the leading edge of the subsequent sheet P2 from overtaking and colliding with the trailing edge of the front sheet P1. The rotational speed of the feeding motor 22 and the first through third motors 33-1 through 33-3 made up of stepping motors is also controlled so that the paper transport speed of the feeding roller 11, separating roller 12, and first through third transporting rollers 32-1 through 32-3 is lowered (for example, to a speed that corresponds to 15 or 30 rpm, which is below 60 rpm) (see steps S18 through S20).

The first and second electric motors 33-1 and 33-2 are then actuated/started so as to rotate the first and second transporting rollers 32-1 and 32-2 at the low paper transport speed switched to in step S20 (see step S21).

On the other hand, in step S17, when the front sheet P1 is not transported and the fifth sensor 50-5 is determined as not having been turned ON by the trailing edge of the paper being positioned on the fifth sensor 50-5, the first and second electric motors 33-1 and 33-2 are temporarily stopped so that the subsequent sheet P2 does not advance (see step S18).

The process then proceeds to step S39, and the same sequence of control processing as in steps S17 through S19 is performed from this point until step S41. The process then proceeds to step S42, and the rotational speed of the feeding motor 22 and the first through third motors 33-1 through 33-3 made up of stepping motors is controlled so that the paper transport speed of the feeding roller 11, separating roller 12, and first through third transporting rollers 32-1 through 32-3 is lowered (for example, to a speed that corresponds to 15 or 30 rpm, which is below 60 rpm).

The subsequent sheet P2 is then transported as a result of the first and second electric motors 33-1 and 33-2 being actuated/started so as to rotate the first and second transporting rollers 32-1 and 32-2 at the low paper transport speed switched to in step S42 (see step S43).

The sequence of control processing in steps S18 through S21 described above represents a case in which the leading edge of the subsequent sheet P2 has not caught up with the trailing edge of the front sheet P1, and indicates that the "speed measuring zone" in FIG. 15 changes according to the transport type (or transport pattern).

Also, the sequence of control processing in steps S38 through S43 described above represents a case in which the leading edge of the subsequent sheet P2 has caught up with the trailing edge of the front sheet P1, and indicates that the "speed measuring zone" in FIG. 15 changes according to the transport type (or transport pattern).

Figure 23:
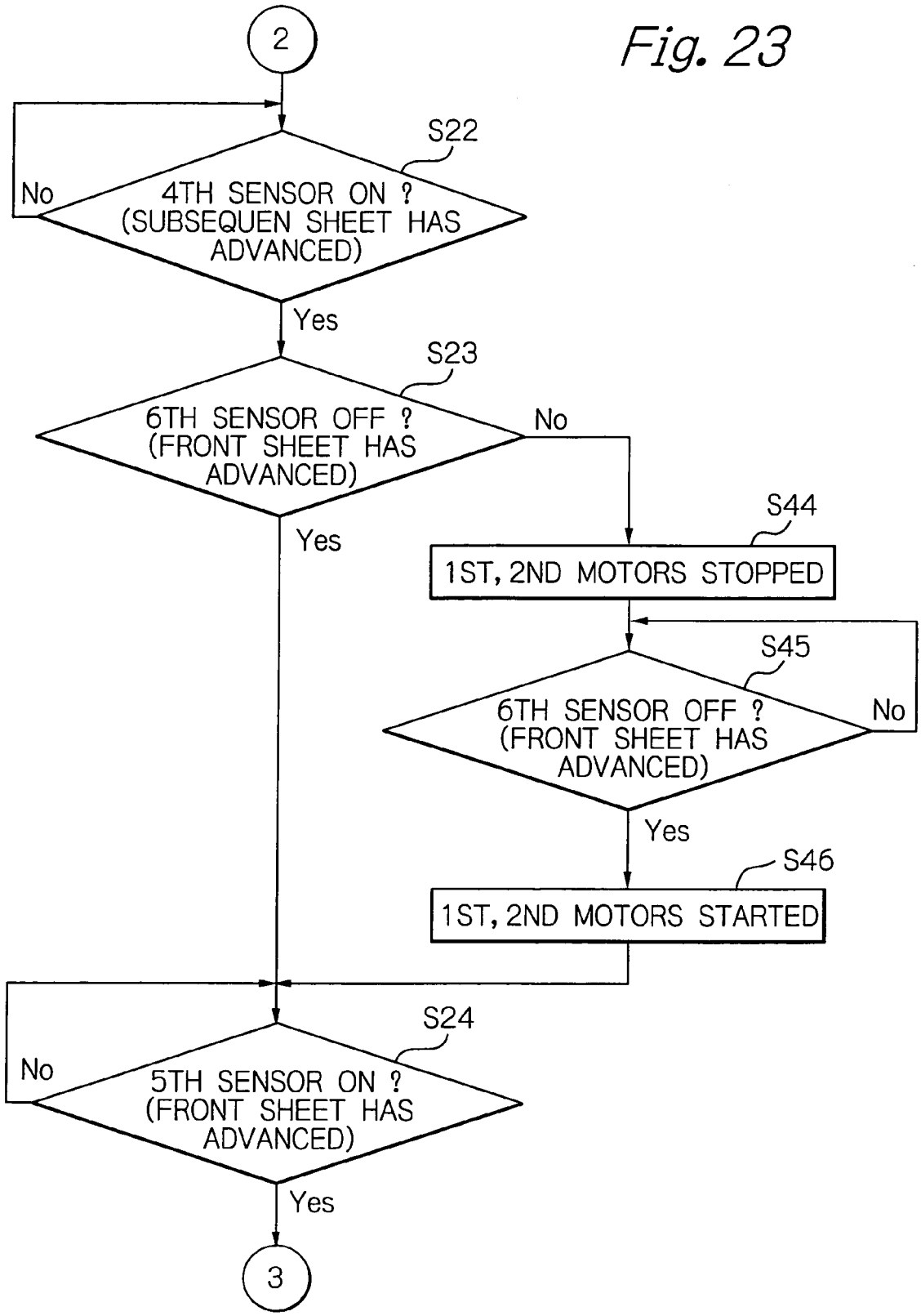
FIG. 23 is a continuation of the flowchart beginning in FIG. 22.

The process then proceeds to step S22 in FIG. 23, the subsequent sheet P2 is transported, and it is determined whether or not the fourth sensor 50-4 has turned ON. When the subsequent sheet P2 is transported and the fourth sensor 50-4 has turned ON by being reached by the leading edge of the paper, the process proceeds to step S23, the front sheet P1 is transported and its trailing edge comes out of the sixth sensor 50-6, and it is determined whether or not the sixth sensor 50-6 has turned OFF. When the front sheet P1 is transported and its trailing edge comes out of the sixth sensor 50-6, the process proceeds to step S24, the subsequent sheet P2 is transported and its leading edge reaches the fifth sensor 50-5, and it is determined whether or not the fifth sensor 50-5 has turned ON.

On the other hand, in step S23, when the front sheet P1 is not transported and its trailing edge is on the sixth sensor 50-6, or, specifically, when the sixth sensor 50-6 remains ON, the first and second electric motors 33-1 and 33-2 are temporarily stopped so that the subsequent sheet P2 does not advance (see step S44). The process then proceeds to step S44, and when the front sheet P1 is transported and its trailing edge is determined to have come out of the sixth sensor 50-6, the first and second electric motors 33-1 and 33-2 are actuated/started so as to rotate the first and second transporting rollers 32-1 and 32-2 (see step S46).

Figure 24:
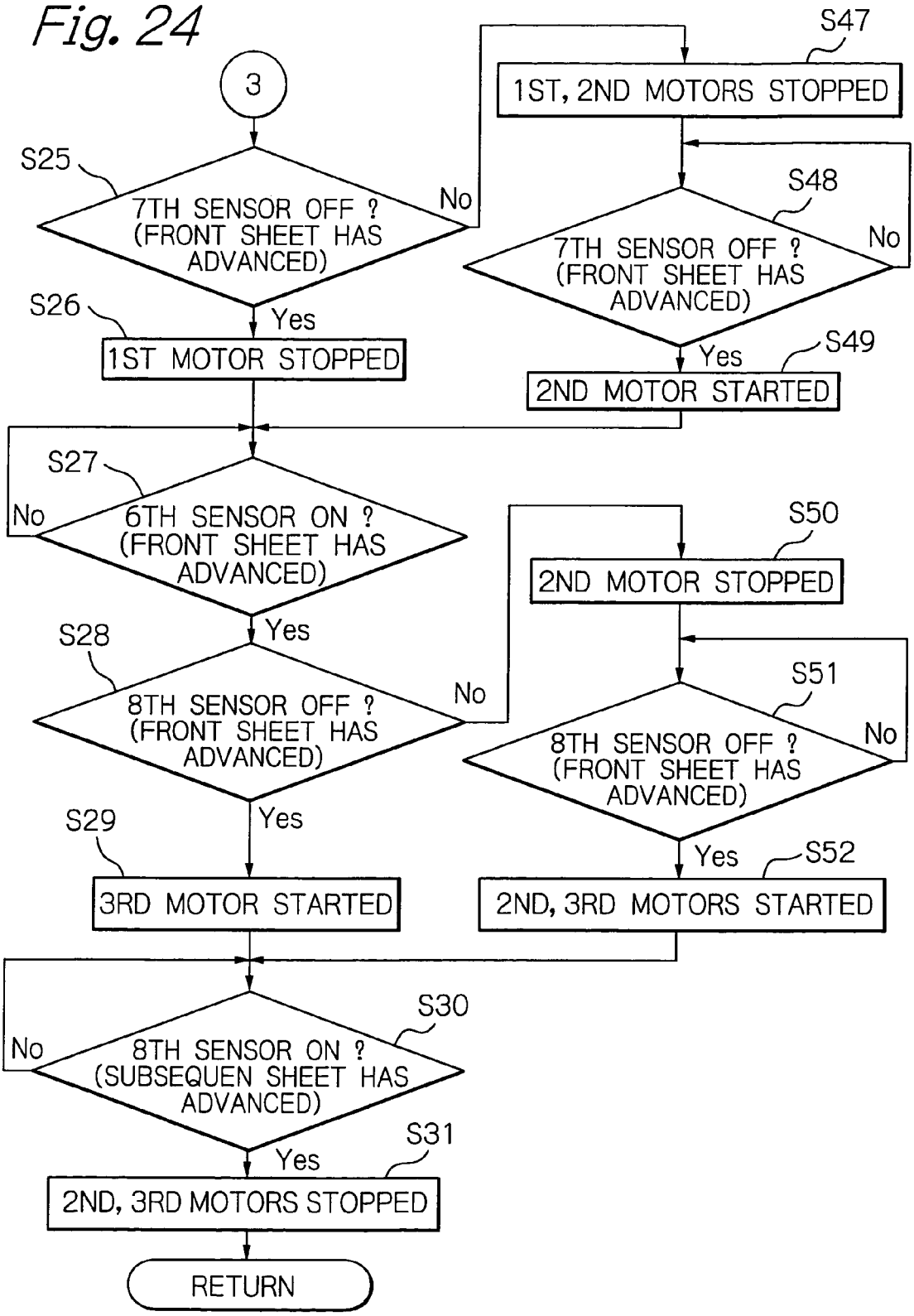
FIG. 24 is a continuation of the flowchart beginning in FIG. 23.

The process then proceeds to step S25 in FIG. 24, the front sheet P1 is transported and its trailing edge comes out of the seventh sensor 50-7, and it is determined whether or not the seventh sensor 50-7 has turned OFF. When the front sheet P1 is transported and its trailing edge has come out of the sixth sensor 50-6, the process proceeds to step S26 and the first electric motor 33-1 is temporarily stopped. The first electric motor 33-1 is stopped because the leading edge of the subsequent sheet P2 has already reached the second transporting roller 32-2 and is passing over the roller 32-2.

On the other hand, in step S25, when the front sheet P1 is not transported and its trailing edge is on the seventh sensor 50-7, or, specifically, when the seventh sensor 50-7 remains ON, the first and second electric motors 33-1 and 33-2 are temporarily stopped so that the subsequent sheet P2 does not advance (see step S47). The process then proceeds to step S48, and when the front sheet P1 is transported and its trailing edge is determined to have come out of the seventh sensor 50-7, the second electric motor 33-2 is actuated/started so as to rotate only the second transporting roller 32-2 (see step S49).

The process then proceeds to step S27, the subsequent sheet P2 is transported, and it is determined whether or not the sixth sensor 50-6 has turned ON. When the subsequent sheet P2 is transported and the sixth sensor 50-6 has turned ON by being reached by the leading edge of the paper, the process proceeds to step S28, the front sheet P1 is transported and its trailing edge comes out of the eighth sensor 50-8, and it is determined whether or not the eighth sensor 50-8 has turned OFF. When the front sheet P1 is transported and its trailing edge has come out of the eighth sensor 50-8, the process proceeds to step S29, and the third electric motor 33-3 is actuated/started so as to rotate the third transporting roller 32-3 (see step S29).

On the other hand, in step S28, when the front sheet P1 is not transported and its trailing edge is on the eighth sensor 50-8, or, specifically, when the eighth sensor 50-8 remains ON, the second electric motor 33-2 is temporarily stopped so that the subsequent sheet P2 does not advance (see step S50) The process then proceeds to step S51, and when the front sheet P1 is transported and its trailing edge is determined to have come out of the eighth sensor 50-8, the second and third electric motors 33-2 and 33-3 are actuated/started so as to rotate the second and third transporting rollers 32-2 and 32-3 (see step S52).

The process then proceeds to step S30, the subsequent sheet P2 is transported, and it is determined whether or not the eighth sensor 50-8 has turned ON. When the subsequent sheet P2 is transported and the eighth sensor 50-8 has turned ON by being reached by the leading edge of the paper, the process proceeds to step S31, and the second and third electric motors 33-2 and 33-3 are stopped together.

Figure 25:
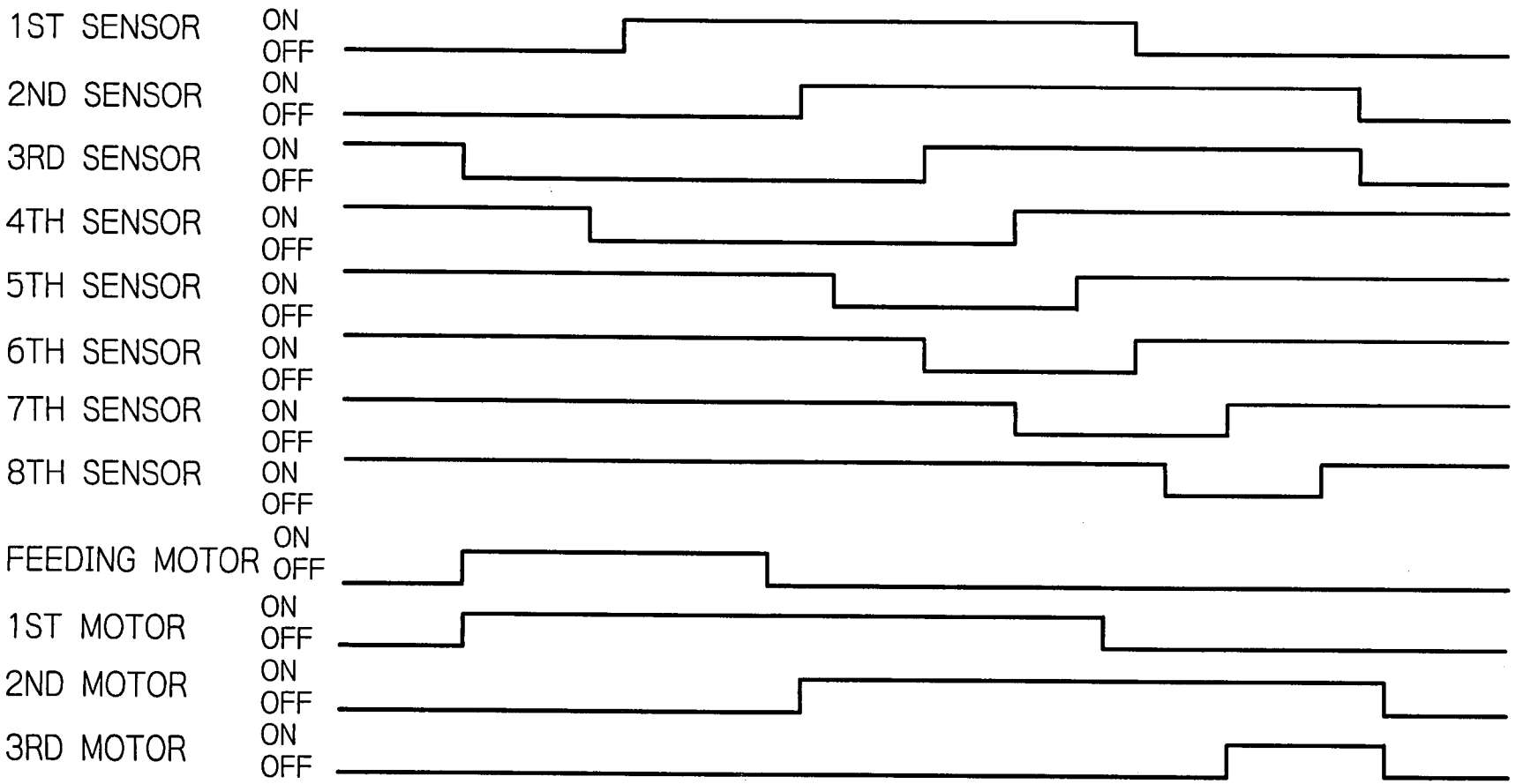
FIG. 25 is a basic timing chart of the paper transport control pertaining to transport type 3 of the present embodiment.

An example of a timing chart for turning ON/OFF the first through eighth sensors 50-1 through 50-8, the feeding motor 22, and the first through third electric motors 33-1 through 33-3 is shown in FIG. 25 for a case in which the leading edge of the subsequent sheet P2 has not caught up with the trailing edge of the front sheet P1 in the paper transport control operation described above.

By means of the specific paper transport control described above, the speed with which paper is transported in the intermediate conveyor 4 can be lowered by changing the rotational speed of the first and second electric motors 33-1 and 33-2 to approximately half (1,600 pps) the normal rotational speed thereof (approximately 3,800 pps) in a case in which, for example, the printing speed (rotational speed of the printing drum 115) of the stencil printer 100 is extremely low (less than 60 rpm, as described above), the drawbacks of the conventional arrangement whereby the leading edge of a subsequent sheet overtakes the trailing edge of the front sheet can be overcome, and paper transport can be performed with high precision in a stable manner.

A simple description of the operation whereby the bulk feeding/transporting unit 1 moves downstream in the paper transport direction X so as to occupy the connected position will next be given with reference to FIGS. 1, 9A, and 9B, and then an overview of the operation of the apparatus as a whole will be described for a case in which the bulk feeding/transporting unit 1 occupies the connected position depicted in FIGS. 1, 9A, and 9B.

Positioning of the paper transport direction X with respect to the stencil printer 100 of the intermediate conveyor 4 of the bulk feeding/transporting unit 1 is performed by means of the leading edge of the tilted member 51 coming into contact with the front panel 124 of the main feeder 104 at the same time as the leading edge of the shutter protecting member 74-2 comes into contact with the front panel 124 as the bulk feeding/transporting unit 1 moves towards the connected position. At the same time, by means of a feeding filler (not pictured) pivoting into position, the light-blocking portion thereof completely blocks the light path of the correct-height sensor 126, and the feeding filler occupies a feeding detection position.

On the other hand, at the same time as the above operation, the connected position is fully occupied by the bulk feeding/transporting unit 1 by means of the third transporting roller 32-3 pressing against the external peripheral surface of the main feeding roller 111 from underneath. When the bulk feeding/transporting unit 1 occupies the connected position, a signal is transmitted to the control device 85 (CPU 86) indicating that the feeding filler continually occupies the feeding detection position, or, specifically, that the correct-height sensor 126 is continuously ON and paper can be fed.

The operation of the apparatus as a whole depicted in FIG. 1 will next be described with reference to FIG. 26. An overview of the operation of the apparatus as a whole when the bulk feeding/transporting unit 1 occupies the connected position depicted in FIG. 1 is described below.

Figure 26A:
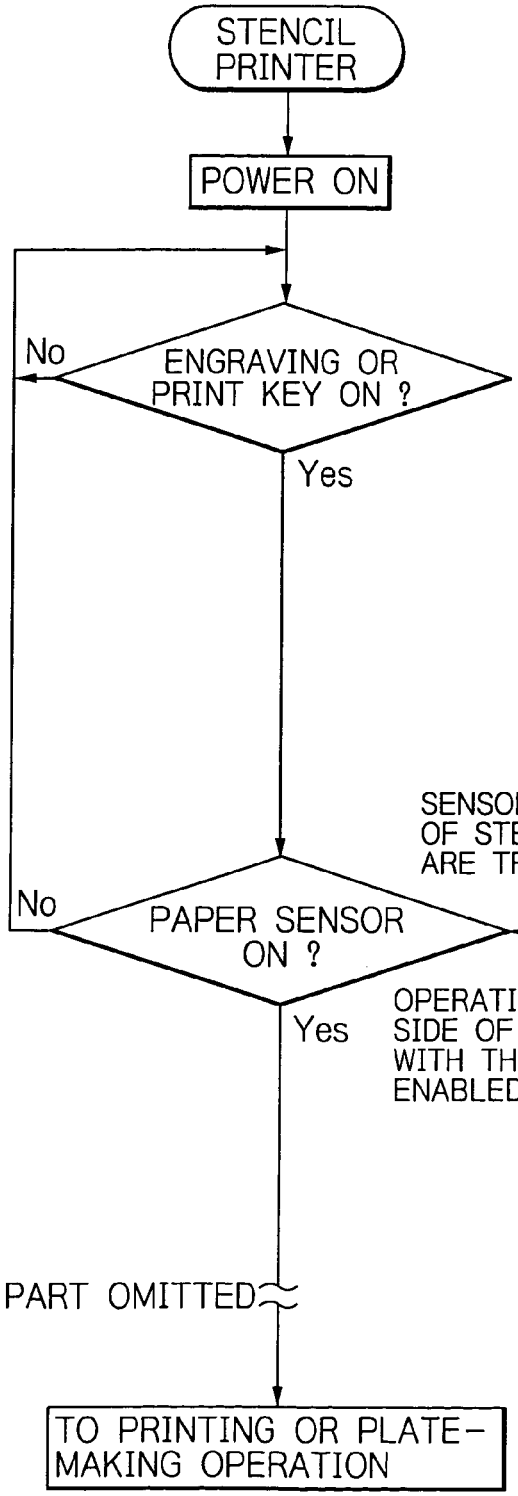
FIGS. 26A and 26B are flowcharts showing the primary operating sequence of the stencil printer with the bulk paper-transporting unit.
Figure 26B:
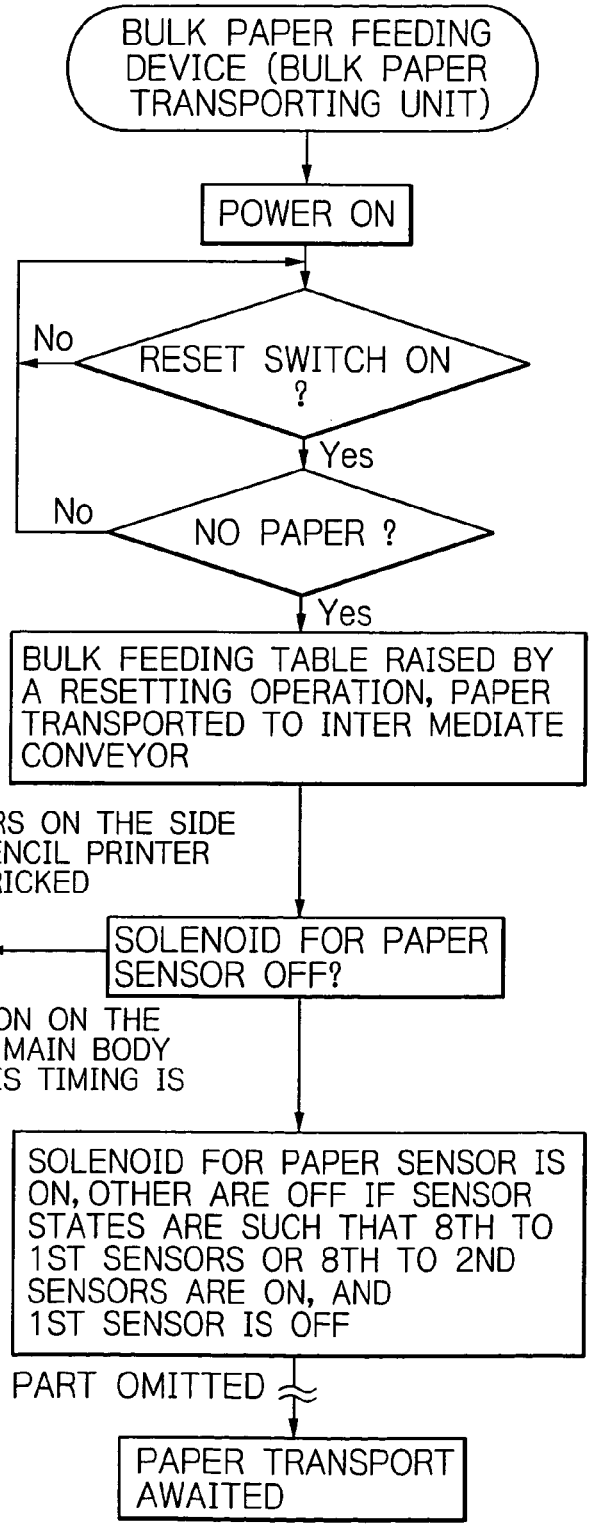
Figure 27:
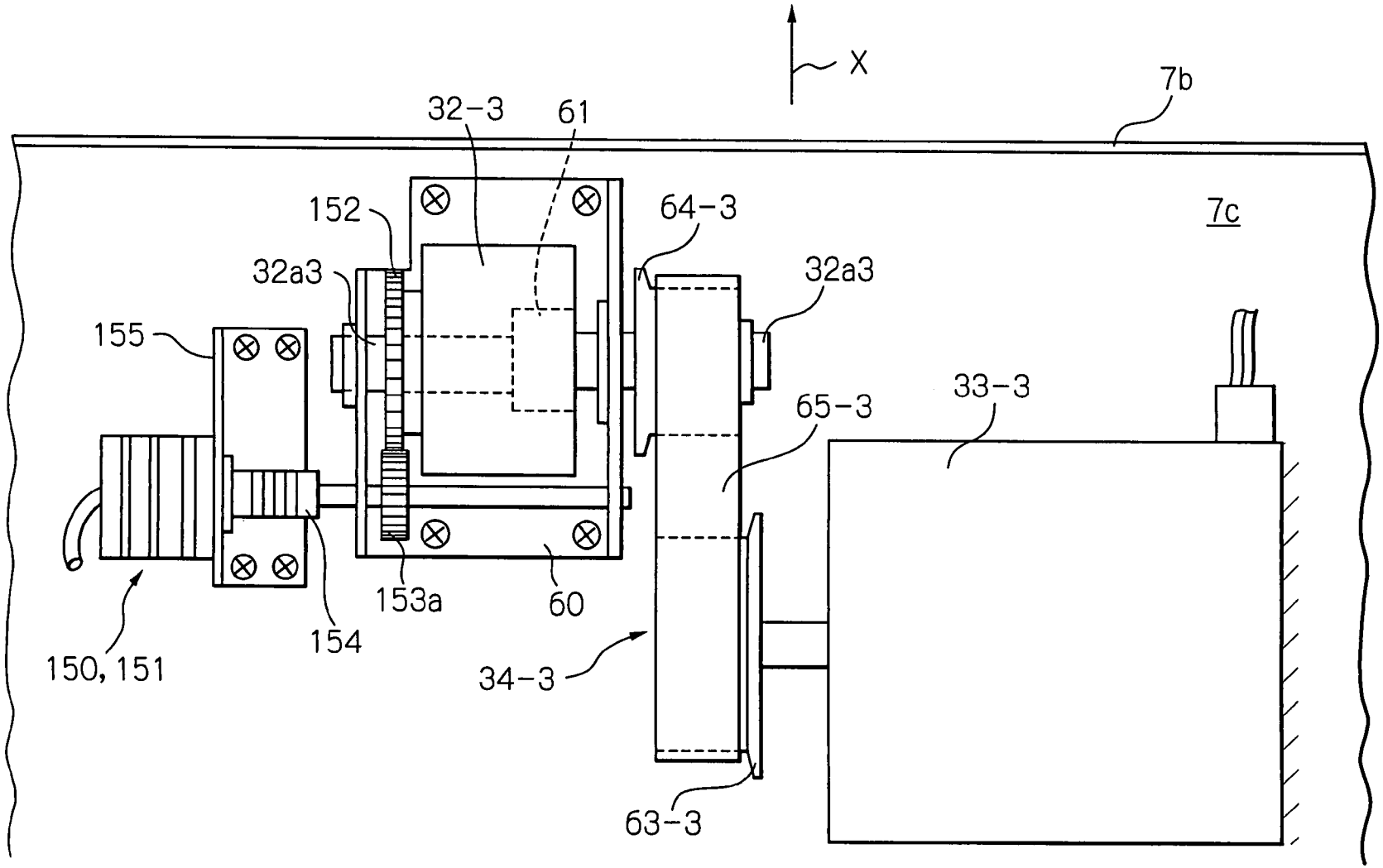
FIG. 27 is a plan view depicting the structure around the placement of a press encoder depicting a modification of the present embodiment.

First, the supplies of electrical power from the power sources are made independent irrespective of the sequence in which closing/turning ON occurs for the power switch 80 of the bulk feeding/transporting unit 1, as depicted in FIG. 26A, and the power switch (not pictured) mounted on the stencil printer 100, as depicted in FIG. 26A.

Irrespective of the order of operation in the bulk feeding/transporting unit 1 and stencil printer 100, pressing the reset switch 81 causes the bulk feeding table 10 in the bulk feeding/transporting unit 1 to be raised by the drive of the electric elevating motor 28 of the feeding table hoisting mechanism 25 shown in FIG. 1 so as to occupy a maximum position (position in which the topmost paper P on the bulk feeding table 10 is fed) detected by the correct-height detecting sensor 26. The above-mentioned reset operation is then executed (see FIG. 17, for example). Specifically, a sheet of paper P1 is taken in by the paper feeding mechanism 3 and fed to the reset position of the intermediate transport path 18, the leading edge of the paper P stops in a position substantially in front of the front panel 124 of the main feeder 104, and the operation is completed. The solenoid 72-2 for the paper-detecting sensor then turns OFF (returns) as soon as the leading edge of the paper P passes the eighth sensor 50-8, and paper P is considered present. Consequently, when there is no paper P in the intermediate transport path 18, the solenoid 72-2 for the paper-detecting sensor turns ON.

Irrespective of the sequence, the paper-detecting sensor 127 and paper length sensor 128 of the main feeding table 110 in the stencil printer 100 are left blocked by the shutters 71-2 and 71-1 as a result of the fact that the solenoid 72-2 for the paper-detecting sensor depicted in FIGS. 9A and 9B remains in the OFF position and the solenoid 72-1 for the paper length sensor remains in the OFF position. (However, the shutter 71-1 is blocked by paper lengths of A4 and above and is released by paper lengths of less than A4 under conditions wherein paper P is present in the intermediate transport path 18 and the paper length is considerable.) This results in a situation equivalent to one in which paper rests on the paper-detecting sensor 127 and the paper length sensor 128 of the main feeding table 110, and the operation on the side of the stencil printer 100 (printing, engraving, or the like) can be performed only with the ON timing of the paper-detecting sensor 127. Also, the process flow thereof is omitted in FIGS. 26A and 26B, but when the bulk feeding/transporting unit 1 is moved downstream in the paper transport direction X to occupy the connected position depicted in FIG. 1, the main feeding roller 111 is pivoted upward by the tilted member 51 depicted in FIGS. 9A and 9B together with a feeding arm (not pictured) so as to smoothly move into the feeding position, and the feeding filler (not pictured) thereby tricks the correct-height sensor 126 shown in FIG. 2 such that the main feeding means appears able to feed paper.

Meanwhile, a starting signal created by pressing an engraving start-up key mounted on an operating panel (not pictured) serves as a trigger, and versioning or version printing, also called test printing, is commonly performed on the side of the stencil printer 100 for a single sheet simultaneously with the completion of a known operation, such as publishing, manuscript image retrieval, or engraving/plate feeding. A sheet of paper P is then transported from the intermediate conveyor 4 of the bulk feeding/transporting unit 1 by means of the paper transport control described in detail above; the leading edge of the paper P is sent to the registering rollers 114 at a paper transport speed that corresponds to the maximum printing speed of 120 rpm of the main feeding roller 111 and the main separating roller 112 of the main feeder 104; the paper is temporarily stopped at the point where it enters the nip of the registering rollers 114 in order to enhance registering precision; and a bend of a prescribed size is formed upwards in the leading edge of the paper P.

The printing drum 115 begins to gradually rotate at an extremely low rotational speed (printing speed) of, for example, 15 to 30 rpm, which is below 60 rpm, in the clockwise direction indicated by the arrow in FIG. 1. A prescribed timing is then set for the image position on the leading edge of an engraved thermal stencil master plate rolled onto the external peripheral surface of the printing drum 115, and paper P is pressed against the engraved thermal stencil master on the printing drum 115 as a result of an operation in which the pair of registering rollers 114 is rotatably driven by the actuation of a registering motor (not pictured) consisting of a stepping motor, and in which the paper P is sent at the same time into the space between the press roller 116 and the printing drum 115 being lifted and displaced in the manner indicated by the double-dashed line in FIG. 1 at an appropriate timing, whereby the engraved thermal stencil master plate is caused to adhere to the external peripheral surface by the adhesive force of the ink supplied from inside the printing drum 115, and ink is transferred to the paper P to perform version printing.

Paper P that has finished version printing is neatly output/loaded onto the bulk delivery table 201 of the bulk delivery and storage unit 200 by a known delivery operation. When the printing startup key (not pictured) mounted on the above-mentioned operating panel is subsequently pressed, the feeding, printing, and delivery steps according to the same process as the above-mentioned version printing are repeated according to a set number of sheets to be printed, and the stencil printing process is completed. Version printing differs from the normal, regular printing process only in that the printing speed is extremely low, as described above, and that such printing does not count as regular printing.

When the bulk feeding/transporting unit 1 is in an unconnected position, rather than occupying the connected position depicted in FIG. 1, the known operations described above are performed on the side of the stencil printer 100 with paper loaded on the main feeding table 110.

A modification of the above-mentioned present embodiment will next be described with reference to FIGS. 13 and 27 through 32.

This modification mainly differs in comparison to the above-mentioned present embodiment in having a pulse encoder 150 provided with an encoder sensor 151 as a transport speed detecting means for detecting the paper transport speed of the third transporting roller 32-3; and that the control device 85 (CPU 86) as a controlling means has a control function for controlling the paper transport speed of the transporting rollers 32-1, 32-2 , and 32-3 steplessly and in real time in addition to the above-mentioned first control function, based on a signal from the encoder sensor 151 and signals from the timer 88.

In other words, the control device 85 (CPU 86) has a control function for controlling the motors 33-1, 33-2, and 33-3 so as to vary the paper transport speed of the transporting rollers 32-1, 32-2, and 32-3 steplessly and in real time in addition to the above-mentioned first control function, based on a signal from the encoder sensor 151 and signals from the timer 88.

A first gear 152 is integrally formed on one end of the third transporting roller 32-3, and the ends of the shaft **32*a*3 are rotatably supported by a third bracket 60 via a bearing. The ends of a shaft 153*a* to which a second gear 153 that continually meshes with the first gear 152 is integrally affixed are rotatably supported in the third bracket 60. One end of the shaft 153*a* of the second gear 153 extends to the left in the figure, and a coupling 154 is fixed to the end thereof. The shaft of the pulse encoder 150 fits into the other end of the coupling 154** in the figure and is secured by a screw (not pictured).

The pulse encoder 150 primarily comprises an encoder disk that has slits (not pictured) and is made up of an incremental-type photo-rotary encoder; and an encoder sensor 151 fixed to a frame in the vicinity of the encoder disk and made up of a transmission sensor (photointerrupter) that clamps onto the above-mentioned encoder disk with a prescribed gap.

When the third transporting roller 32-3 pressing against the main feeding roller 111 is forcibly rotated clockwise in FIGS. 9A and 9B, for example, in the rotation/transport direction of the paper P, by the rotation of the main feeding roller 111, and this rotation is transmitted to the shaft **153*a* via the second gear 153 meshing with the first gear 152, and is further transmitted to the encoder disk from the coupling 154. As a result of the fact that a prescribed number of pulses emitted by the rotation of the encoder disk in concert with the rotation of the third transporting roller 32-3 is detected by the encoder sensor 151 (sometimes referred to hereinafter simply as the "encoder 150"), it is possible for the speed of the paper P transported by the pressing rotation of the printing drum 115 and press roller 116, or, specifically, for the printing speed of the stencil printer 100 (rotational speed of the printing drum 115), to be indirectly read via the main feeder 104 (main feeding roller 111, main separating roller 112, and registering rollers 114) as the third transporting roller 32-3 of the intermediate conveyor 4** positioned furthest downstream is forcibly rotated.

In the above-mentioned present embodiment, a one-way clutch is installed in the shaft of the third transporting roller 32-3, and a pulse encoder 150 such as described above is disposed/mounted with consideration for ease of assembly/maintenance and the like, but it is also apparent that a configuration may be adopted that involves direct attachment to one end of the third transporting roller 32-3 in order to reduce the number of parts, to eliminate backlash of gears and the like, and to more accurately detect the printing speed in the stencil printer 100.

Figure 28A:
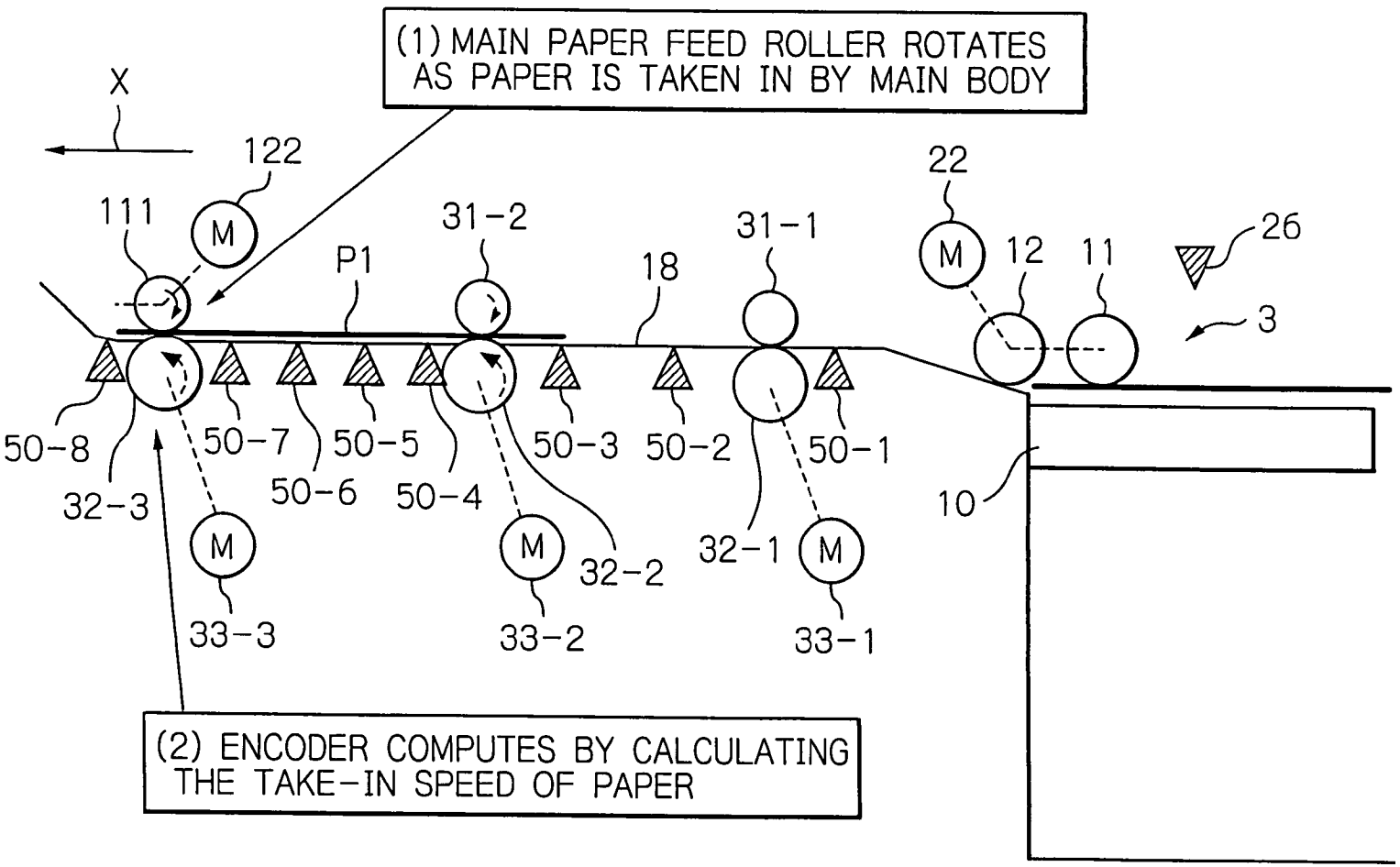
FIGS. 28A and 28B are front views for describing the state of paper transport transition, and control thereof, between subsequent and preceding sheets in the same modification.
Figure 28B:
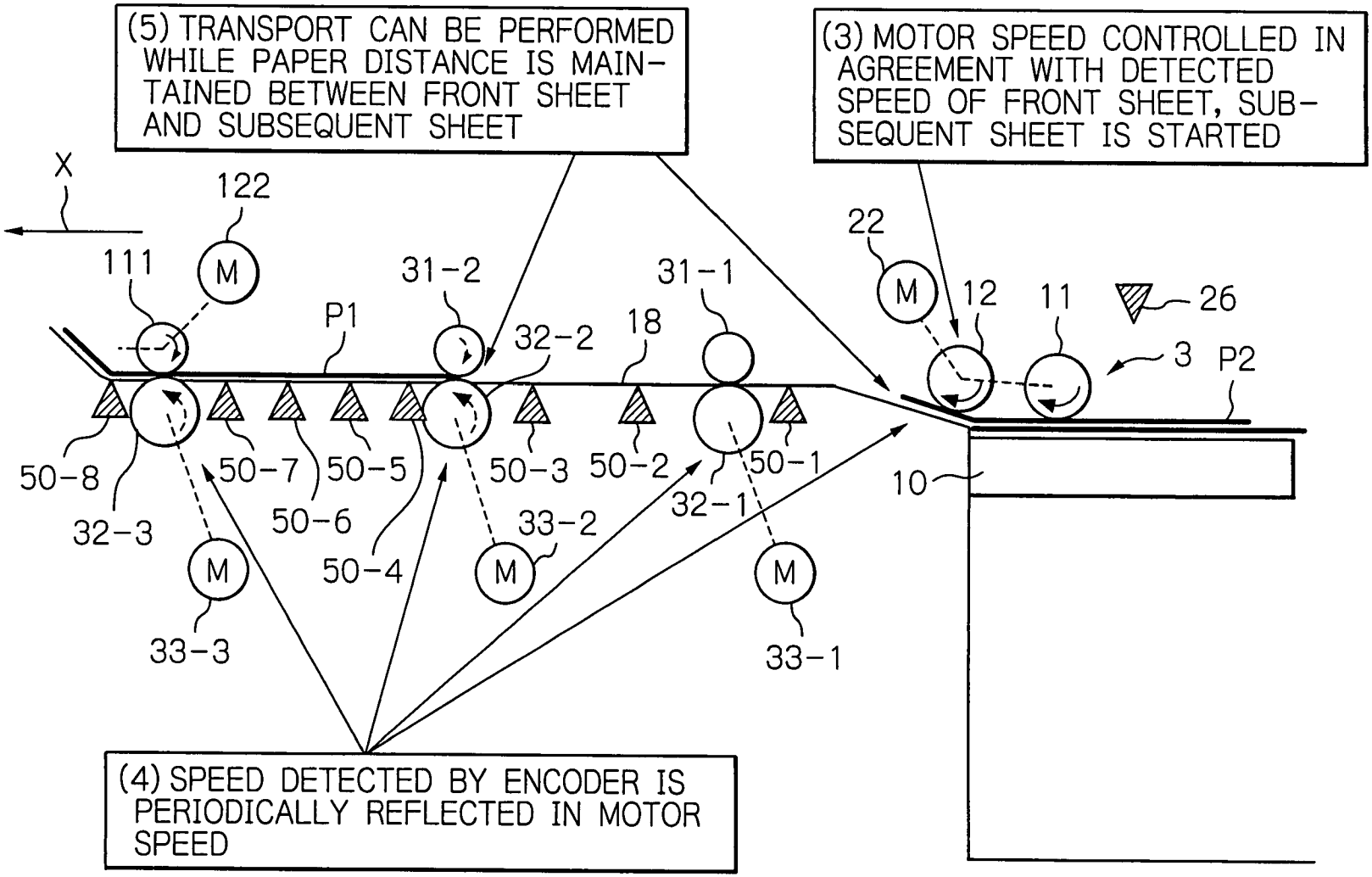

A simple description will next be given with reference to the flowchart in FIGS. 29 through 31 and the timing chart in FIG. 32 of an example of paper transport control executed under the control of the control device 85 in the paper transport transition state in FIGS. 28A and 28B.

Figure 29:
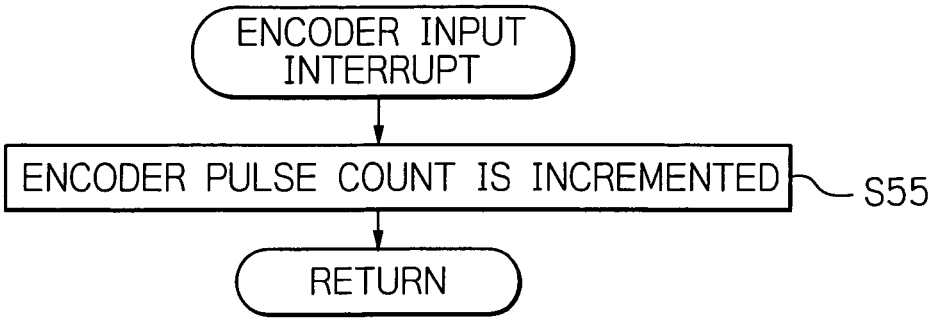
FIG. 29 is a flowchart of encoder interrupt processing pertaining to the same modification.

The flowchart in FIG. 29 is an example of a program relating to input interrupting of the pulse encoder 150. The process flow begins with step S55, and the encoder pulse count generated by the pulse encoder 150 is incremented.

Figure 30:
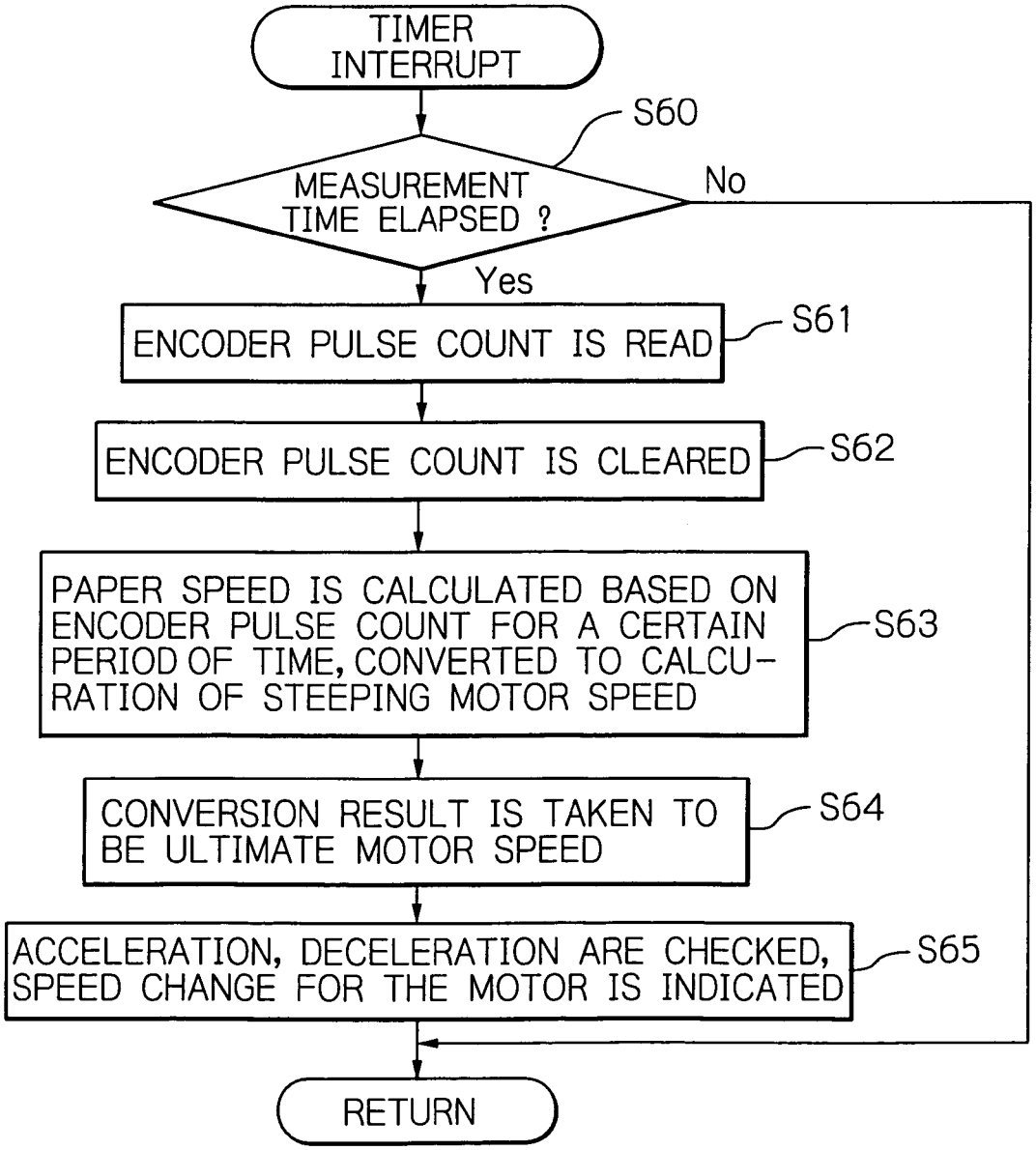
FIG. 30 is a flowchart of timer interrupt processing pertaining to the same modification.

The flowchart in FIG. 30 is an example of a program relating to interrupting of the timer 88 in the control device 85. The process flow begins with step S60. In step S60, it is determined whether or not the measurement time of the timer 88 has passed the above-mentioned preset length of time. If the above-mentioned length of time has elapsed, an encoder pulse count is read, the encoder pulse count is then cleared, the paper transport speed in the stencil printer 100 is calculated via the third transporting roller 32-3 from the encoder pulse count number with respect to the length of time, and conversion processing is performed for calculating the rotational speed of the stepping motors for the first through third electric motors 33-1 through 33-3 and the feeding motor 22 (all of which are stepping motors) (see steps S61 through S63).

Processing aimed at setting the result of the above-mentioned conversion as the ultimate speed of the motors 22 and 33-1 through 33-3 is then performed. Lastly, acceleration and deceleration are checked, and a speed change is instructed for the motors 22 and 33-1 through 33-3 (see steps S64 and S65).

Figure 31:
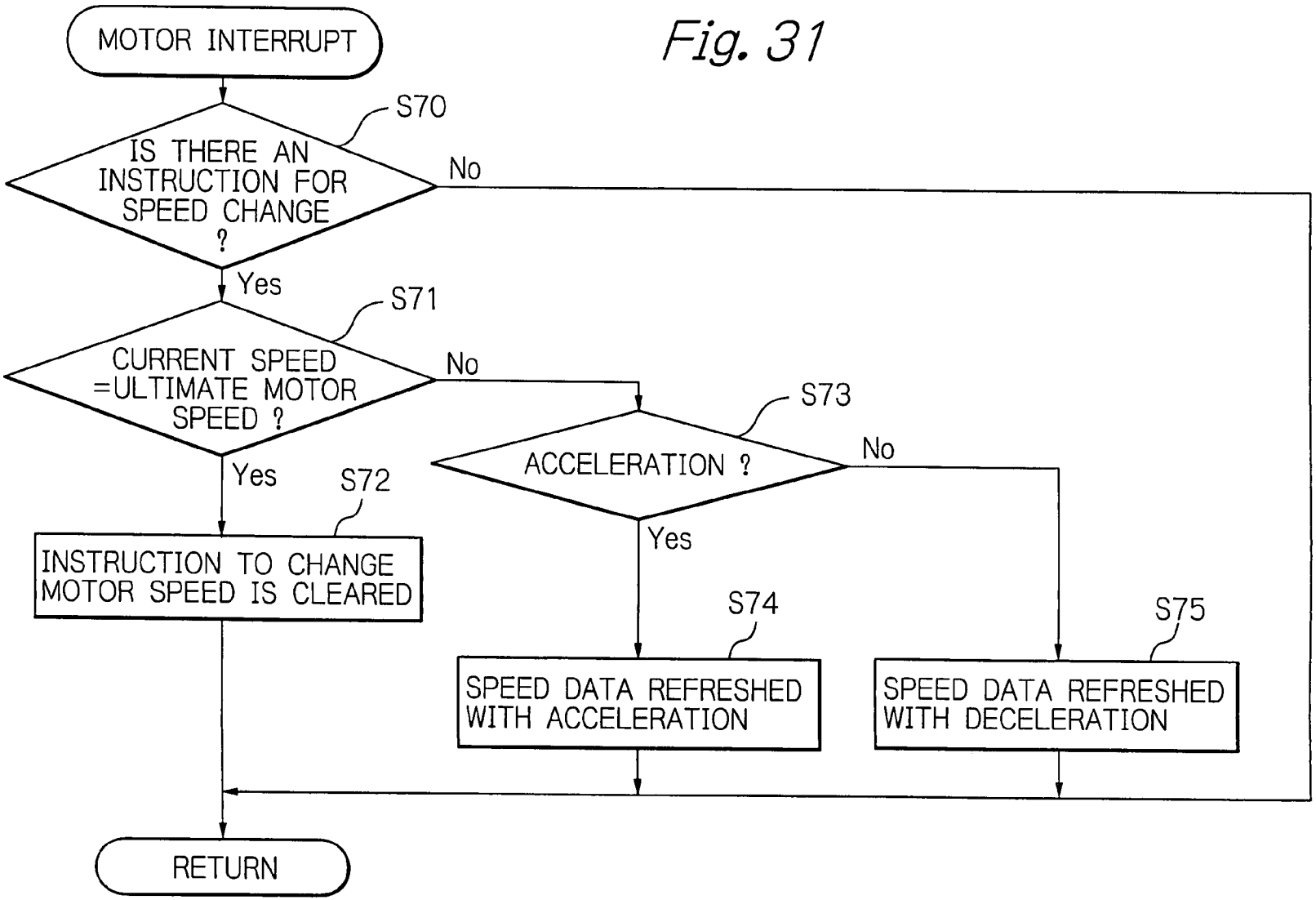
FIG. 31 is a flowchart of electric motor interrupt processing pertaining to the same modification.

The flowchart in FIG. 31 is an example of a program relating to motor interruption of the motors 22 and 33-1 through 33-3, and the process flow begins with step S70. In step S70, the presence of a speed change instruction in step S65 of FIG. 30 is determined. When the determination procedure finds that a speed change instruction is present, the process proceeds to step S71, and it is determined whether or not the speed of the motors 22 and 33-1 through 33-3 has reached the ultimate speed. When the speed of the motors 22 and 33-1 through 33-3 has reached the ultimate speed, the instruction for rotational speed change for the motors 22 and 33-1 through 33-3 is cleared.

On the other hand, in step S70, when the determination procedure finds that the above-mentioned speed change instruction is not present, the process returns. Also, in step S71, when the above-mentioned speed change instruction is present and the rotational speed of the motors 22 and 33-1 through 33-3 is not at the ultimate speed as pertains to the change instruction, the process proceeds to step S73, and it is determined whether or not to accelerate. Speed data are updated to reflect the acceleration when acceleration is performed (see step S74). When there is no acceleration, the speed data are updated to reflect a deceleration (see step S75).

The intermediate transport conditions pertaining to the paper transport control in the present modification are the same as in the example depicted in FIGS. 15 through 18B. In FIG. 28A, the main feeding roller 111 begins to rotate at a peripheral velocity (which may also be a paper transport speed) of the main feeding roller 111 that corresponds to the same constant rotational speed as described above as a result of being actuated by the feeding motor 122 of the stencil printer 100, whereby the front sheet P1 held between the main feeding roller 111 and the third transporting roller 32-3 goes on to be taken in by/transported to the main feeder 104. At this time, the third transporting roller 32-3 is receiving a moderate feed pressure from the main feeding roller 111, so it begins to perform forcible rotation/slave rotation in the counterclockwise direction as indicated by the dotted line in FIG. 19 along with the movement of the front sheet P1 through the friction of the front sheet P1 with the high-friction surface (rubber surface) on the external peripheral surface of the third transporting roller 32-3. The load on the third electric motor 33-3 at this time is made so small as to be virtually negligible by the action of the one-way clutch 61 housed in the shaft of the third transporting roller 32-3.

When the front sheet P1 advances towards the stencil printer 100 in this manner, as described above, the paper transport speed of the paper P transported by the pressing rotation of the printing drum 115 and press roller 116, or, specifically, the printing speed of the stencil printer 100 (rotational speed of the printing drum 115), can be indirectly read by the pulse encoder 150 (encoder sensor 151) as a result of the forcible rotation of the third transporting roller 32-3 positioned furthest downstream of the intermediate conveyor 4.

Figure 32:
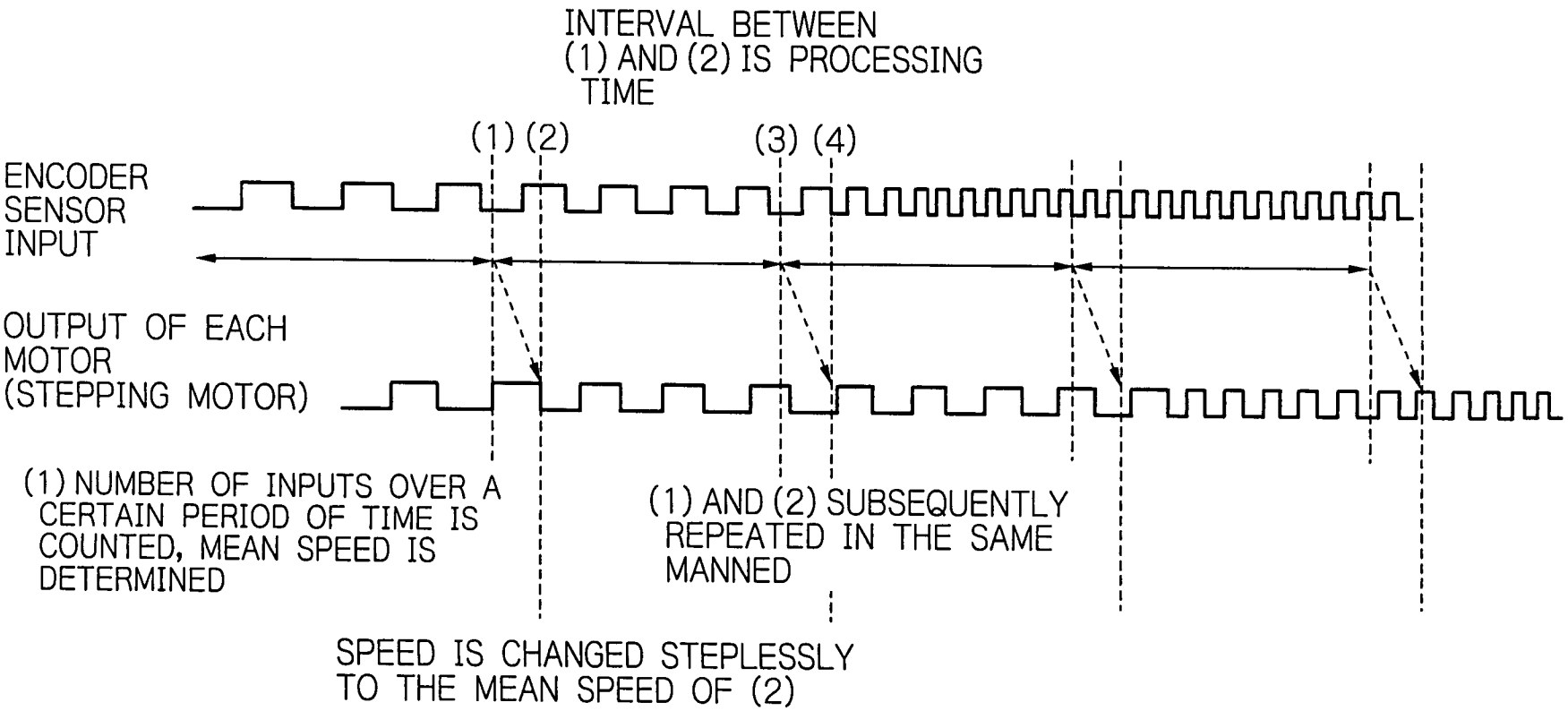
FIG. 32 is a schematic timing chart of relevant parts of the paper transport control pertaining to the same modification.

Rotational speed control of the motors 22 and 33-1 through 33-3, as described by the above-mentioned flowcharts and schematically displayed in the timing chart of FIG. 32, can be automatically executed by the control device 85 (CPU 86) so as to change the paper transport speed of the transporting rollers 32-1, 32-2, and 32-3 steplessly and in real time based on a signal related to an encoder pulse count per unit of time from the encoder sensor 151 and timer 88.

Also, when the printing speed (rotational speed of the printing drum 115) in the stencil printer 100 detected by the pulse encoder 150 is extremely low (less than 60 rpm, such as described above), the paper transport speed in the intermediate conveyor 4 can be lowered by changing the rotational speed of the first and second electric motors 33-1 and 33-2 to approximately half (1,600 pps) the normal rotational speed thereof, the drawbacks of the conventional arrangement whereby the leading edge of a subsequent sheet overtakes the trailing edge of the front sheet can be overcome, and paper transport can be performed with high precision in a stable manner using a comparatively simple configuration.

The following advantages are obtained by means of the above-mentioned embodiment and modification.

(1) Paper transport from the intermediate conveyor 4 of the bulk feeding/transporting unit 1 is made possible regardless of the paper size or printing speed in the stencil printer 100, and paper feeding is possible even when there is no electrical connection with the stencil printer 100.

In the case of a long paper size, paper transport can be performed by concluding that the leading edge of a subsequent sheet may proceed to the Nth sensor (meaning that there are as many sensors as there are numbers for sensors in the stencil printer 100) by virtue of the fact that the trailing edge of the front sheet has passed the Nth sensor, and when the trailing edge of the front sheet has not passed the Nth+1 sensor, paper transport can be performed with a space continually maintained between sheets irrespective of the printing speed in the stencil printer 100, on the basis of control whereby the leading edge of the subsequent sheet is stopped at the Nth sensor. By this means, paper transport can be performed according to the same conditions as those used for paper fed from the main feeding table if a subsequent sheet supplied within a given time reaches the third transporting roller 32-3 disposed in a position substantially facing the main feeding roller of the main feeding table mounted in the body of a copier, printer, or other image forming device.

In the case of a short paper size, paper transport can be performed by concluding that the leading edge of a subsequent sheet may proceed to the Nth sensor by virtue of the fact that the trailing edge of the front sheet has passed the Nth sensor, and when the trailing edge of the front sheet has not passed the Nth+1 sensor, paper transport can be performed with a space continually maintained between sheets irrespective of the printing speed in the stencil printer 100, on the basis of control whereby the leading edge of the subsequent sheet is stopped at the Nth+1 sensor. By this means, paper transport can be performed according to the same conditions as those used for paper fed from the main feeding table if a subsequent sheet supplied within a given time reaches the third transporting roller 32-3 disposed in a position substantially facing the main feeding roller 111 of the main feeding table 110 mounted in the body of a copier, printer, or other image forming device.

Because a subsequent sheet can arrive under the main feeding roller 111 without being stopped due to the swiftness of the paper leaving the intermediate conveyor 4 in the case of a short paper size, a great deal of leeway in time can be obtained compared to long-sized paper, and hence two sensor spaces are provided for determining the paper interval. Alternatively, because there is no time leeway in the case of long-sized paper, a single sensor space is provided for determining the paper interval.

(2) By means of the above-mentioned control, there is no need to read the printing speed of the stencil printer 100, so the device can be applied in machines already commercially available, and an existing machine can be easily converted/transformed into a printer that includes a stencil printer capable of large-volume printing without purchasing a new machine.

(3) Disposing the third transporting roller 32-3 under the main feeding roller 111 allows the main feeding roller 111 to be rotated by the actuation of the third transporting roller 32-3, and the leading edge of the paper to be prevented from catching on or being damaged by protrusions on the main feeding roller 111. Drawbacks of paper failing to move are also overcome by using rollers instead of a fixed rubber pad. An accurate transport quantity can also be maintained because the length for determining the stopping position of the leading edge of the paper is short.

(4) Because the transporting roller interval+α becomes the minimum transportable size, shorter paper sizes can be accommodated by disposing a plurality of transporting rollers.

(5) (Paper) Providing a plurality of sensors allows the paper size to be determined by detecting which sensor space the trailing edge of the paper is stopped in. It is also necessary to provide a plurality of sensors in order to continually keep a space open between sheets of paper (perform detection to keep sheets from touching), and having more sensors is connected with maintaining the distance between sheets.

(6) Control is simplified by using stepping motors capable of accurately moving by a paper transport distance in the first through third electric motors 33-1 through 33-3. More accurate paper transport is also made possible because the number of pulses delivered to the stepping motor can be compared with the time taken to pass the sensor space in order to determine how much the paper has slipped.

(7) By having a one-way clutch 61 built in to the shafts of the first through third transporting rollers 32-1 through 32-3, the resistance of the first through third transporting rollers 32-1 through 32-3 against the intake force of the main feeding roller 111 can be reduced.

(8) At the same time, the paper stopping precision can be affected by the inertia of the first through third transporting rollers 32-1 through 32-3. In order to compensate for this, once the motors have stopped, the idle rotation of the first through third transporting rollers 32-1 through 32-3 can be stopped by a mechanism for applying a constant braking force, thus enabling the stopping precision of the paper to be maintained in a stable manner. When the stencil printer 100 is feeding paper, the above-mentioned one-way clutch 61 is mounted in the shaft of the third transporting roller 32-3 so as to place as little load as possible on,the paper. Because of this, the first through third transporting rollers 32-1 through 32-3 continuously rotate or make repeated temporary stops in accordance with the printing speed and paper size in the body of a copier, printer, or other image forming device, and can enter a stopped condition even in the slow-up/slow-down range of the stepping motors, and the stopping position tends to fluctuate due to inertial differences. The distance moved by the paper and the precision of the paper stopping position due to the accompanying inertia also change according to differences in the frictional coefficient due to variations in the surface condition of the paper, and the weight (heaviness) of the paper. The leading edge of the subsequent sheet is thereby stopped at the Nth sensor when the trailing edge of the front sheet has not passed the Nth+1 sensor in the intermediate conveyor 4 for performing paper transport based on a determination that the leading edge of a subsequent sheet may proceed to the Nth sensor as a result of the fact that the trailing edge of the front sheet has passed the Nth sensor under conditions in which the distance between sheets is small for long paper and the printing speed is high. However, even if stopped forcibly or by slow-up control, the paper cannot be stopped in the predetermined position due to the inertia of the main feeding roller 111 (the shaft thereof may also be included in some cases) because the above-mentioned one-way clutch 61 is in use. Consequently, in the worst case, the leading edge of the subsequent sheet overtakes/comes into contact with the trailing edge of the front sheet, thus damaging the paper, and the deformation of the paper due to such contact causes jamming during transport, but in the present embodiment, braking force is applied to the third transporting roller 32-3 by a leaf spring, and consistent stopping position is obtained with the effects of inertia minimized, thus enabling improved quality of paper transport.

In the above-mentioned present embodiment and modification, a configuration was described that uses three transporting rollers consisting of the first through third transporting rollers 32-1 through 32-3 as the minimum necessary paper transporting means configured with consideration for keeping costs low by avoiding complicated control and for making it possible to perform the above-mentioned specific paper transport control, including varying the paper transport speed using the ten paper sizes ("B5T" being the smallest workable size) shown in FIGS. 11 and 15 and normally used by a stencil printer 100, but this configuration is not limiting, and an arrangement such as the following may also be adopted.

For example, if the present embodiment is added to, giving a total of four transporting rollers as the paper transporting means, the minimum workable size can be broadened to include "letter size" (in this case, the distance between transporting rollers is about 130 to 140 mm). Also, because an A4 transverse size (A4T: the short side of A4 size as viewed by an operator) cannot be fed when only two transporting rollers are used, this arrangement is somewhat impractical, and so three rollers were included in the present embodiment as a suitable example.

In the present embodiment and modification described above, an offline state was described in which there is no exchange of signals and no electrical connection between the bulk feeding/transporting unit 1 and the stencil printer 100, but this arrangement is not limiting, and it is apparent that there may also be a so-called "online" state in which there is an electrical connection and exchange of signals. It is also apparent that the same advantages as described above and the same effects as described hereinafter are also demonstrated when in an online state.

It is apparent that an image forming device to which the bulk feeding/transporting unit 1 is connected is not limited to a stencil printer 100 in which an ink supplying member, mounted to the inside of a printing drum 115 provided with a plate cylinder on the external periphery thereof such as described above, comes into contact with the internal peripheral surface of the plate cylinder, whereby ink is supplied to an engraved master on a plate cylinder from inside the plate cylinder and printing is performed, and it is possible to use a structure in which a connection is formed in the same manner as above in a copier, printing machine, facsimile machine, printer, or other image forming device.

As described above, the present invention has the following effects.

(1) The size and transport speed of the paper being transported by the intermediate conveyor can be determined and identified on the side of the bulk paper feeding device with the intermediate conveyor, and sequential transport can therefore be accomplished in a reliable manner without the trailing edge of the front sheet coming into contact with the leading edge of the subsequent sheet in the paper feeding means or the vicinity of the paper feeding port in the body of an image forming device even when there is no electrical connection (signal exchange) with the body of the image forming device.

(2) The control means allows paper to be transported irrespective of whether it is a regular size or irregular size, and can thereby feed paper in a stable manner in accordance with size because the paper can be transported merely by detecting the trailing edge of a sheet in each of a plurality of paper transport means in accordance with a control method in which the paper size is identified and the paper transport control system of each paper transport means is varied on the basis of signals from a plurality of paper detecting means when initialization is performed upon completion of transport of a single sheet of paper onto the plurality of paper detecting means.

(3) In the initialized state, paper can be reliably taken in by the body of the image forming device because a sheet of paper is positioned in the paper transport means disposed on the furthest downstream side of the intermediate transport path and because the leading edge of the sheet is set in a position in which paper can be fed by the main paper feeding means.

(4) The paper transport distance can be made accurate and the amount by which paper is advanced can be controlled with high precision, inexpensively, and in a simple manner by using stepping motors for the drive means; the paper transport speed can also be switched by the drive means inexpensively and with ease; and paper can also be fed in a more precise manner by allowing the number of pulses fed to the stepping motors and the time of passage between the paper detecting means to be compared, and the amount of paper slippage to be determined.

(5) The control means adds a signal from timekeeping means for measuring the time between the paper detecting means, and controls the paper transport speed of each paper transport means in a stepless manner and in real time, when the trailing edge of a sheet moves at the time that transport of paper onto the plurality of paper detecting means is started in accordance with the start of paper feed by the main paper feeding means, making it possible to maintain the paper distance and to transport paper in a stable manner without the leading edge of the subsequent sheet overtaking or colliding with the trailing edge of the front sheet by adopting a control method in which the paper transport speed of each paper transport means is reduced because a reduction in speed can be detected by measuring the time between the paper detecting means when the trailing edge of the sheet moves in case of decreased image forming speed (for example, printing speed) on the side of the body of the image forming device. The image forming speed (for example, printing speed) on the side of the body of the image-forming device can be detected easily and accurately even when the paper used has a short size in the paper transport direction.

(6) At least three paper transport means are provided, making it possible to inexpensively control the transport of paper of numerous sizes with the aid of at least three paper transport means.

(7) The intermediate conveyor comprises paper transport means for transporting paper that has been fed by a paper feeding means, a pair of guiding means for guiding paper that is transported by the paper transport means to the main feeding table or to the vicinity of the paper feeding port, and a chassis for accommodating the paper feeding means and the pair of guiding means, whereby paper that has been fed from the paper feeding means of the bulk paper feeding device can be transported while reliably guided to the main feeding table or to the vicinity of the paper feeding port via the intermediate conveyor.

(8) At least one member from among the upper guiding member and the lower guiding member extends to the main feeding table or to the vicinity of the paper feeding port, allowing, in addition to the effects of the invention described in 1, 2, or 3, paper to be reliably guided and transferred to the main paper feeding means without the leading edge of paper catching on the protrusions of the main paper feeding means (for example, paper feeding roller) or the leading edge of the paper being cut, damaged, jammed, or otherwise affected even when thin, easily-torn paper is used, as when, for example, paper is replaced.

(9) It is possible to reduce the resistance load of a paper transport means (for example, transport roller) in relation to the paper intake force developed by the drive of the main paper feeding means (for example, the rotation of the paper feeding roller) on the side of the body of the image forming device, and hence to transport paper with greater reliability because a unidirectional rotational driving force transmitting means is provided to the shaft of the transport roller disposed at least on the furthest downstream side of the intermediate transport path.

(10) The effect of inertia during transport in the transport roller disposed at least on the furthest downstream side of the intermediate transport path can be reduced to maintain a consistent stopping position and to provide enhanced precision of paper transport because braking force is applied by braking force applying means to the transport roller disposed at least on the furthest downstream side of the intermediate transport path.

(11) The occurrence of paper jams due to the absence of paper can be prevented and wide-ranging measures that extend from direct shipping machines/products to already manufactured products can be taken because the use of a stepping motor allows the on/off signals of at least the paper detecting means from among the paper detecting means and paper length detecting means of the main feeding table to be switched and transmitted to the body of the image forming device in an offline state in which there is no electrical connection with the body of the image forming device. In addition, work to electrically connect the body of the image forming device and the bulk paper feeding device with the intermediate conveyor becomes unnecessary (offline), and it becomes much simpler to perform mounting and connecting on site.

(12) The shutter mechanism stepping motor has a shield member for selectively shielding the detecting means, and drive means for driving the shield member, whereby signals/information can be transmitted by using, for example, the simplest solenoid or other electric drive means, and an inexpensive solution can therefore be provided.

(13) The waiting time can be reduced and the occurrence of paper jams due to the absence of paper referred to in (1)

can be reliably prevented because the bulk paper feeding device with an intermediate conveyor can move between a connected position in which paper that is fed from the intermediate conveyor can be taken in and fed by the main feeding table, and an unconnected position that is spaced apart from the connected position in a state in which the intermediate conveyor is placed on the main feeding table retained at a prescribed height, and because placing the intermediate conveyor on the main feeding table via a shutter mechanism makes it unnecessary to place and raise the intermediate conveyor on the main feeding table in the manner adopted in the past.

The present invention was described above with reference to specific embodiments, modifications, and the like, but it should be apparent to those skilled in the art that the structure and operation of the present invention are not limited by the above-described embodiments, modifications, and the like and may be appropriately combined into new structures and operations, and that various other embodiments may be constructed in accordance with the need, application, and the like within the range of the present invention.

What is claimed is:

1. A bulk paper feeding device with an intermediate conveyor, comprising:

a carrier capable of carrying a large quantity of paper;

a paper feeding mechanism for picking up and feeding one sheet at a time of the paper from the carrier;

an intermediate conveyor for transporting a sheet of paper fed from the feeding mechanism to a main paper feeding table of a paper feeder on a body of an image forming device or to a vicinity of a paper feeding port that faces main paper feeding means of a paper feeder, said intermediate conveyor comprising paper transport means for transporting paper that has been fed from the paper feeding mechanism, disposed in a plurality at prescribed intervals from upstream to downstream along an intermediate transport path thereof; and paper detecting means for detecting at least one edge from among the leading and trailing edges of the paper being transported, disposed in a plurality at intervals from upstream to downstream along the intermediate transport path;

control means for performing control in which the paper size is identified and a paper transport control system of each paper transport means is varied on a basis of signals from the plurality of paper detecting means when initialization is performed upon completion of transport of a single sheet of paper onto the plurality of paper detecting means; and timekeeping means for measuring a time between the paper detecting means when the trailing edge of the paper moves at a time that transport-of paper on the plurality of paper detecting means is started in accordance with a start of paper feed by the main paper feeding means, wherein the control means adds a signal from the timekeeping means and controls the paper transport speed of each paper transport means.

2. The bulk paper feeding device with an intermediate conveyor as claimed in claim 1, wherein the paper in the initialized state is positioned on the paper transport means disposed on a furthest downstream side of the intermediate transport path, and the leading edge of the paper is set in a position in which the paper can be fed by the main paper feeding means.

3. The bulk paper feeding device with an intermediate conveyor as claimed in claim 1, further comprising transport speed detecting means for detecting the paper transport speed, wherein the control means adds a signal from the transport speed detecting means and controls the paper transport speed of each paper transport means in a stepless manner and in real time.

4. The bulk paper feeding device with an intermediate conveyor as claimed in claim 1, further comprising at least one drive means for driving each of the paper transport means mounted in the intermediate conveyor, and wherein the control means controls the drive means such that the paper size is identified and the paper transport control system of each paper transport means is switched on the basis of signals from the plurality of paper detecting means.

5. The bulk paper feeding device with an intermediate conveyor as claimed in claim 4, wherein the drive means is a stepping motor.

6. The bulk paper feeding device with an intermediate conveyor as claimed in claim 1, wherein at least three paper transport means are disposed.

7. The bulk paper feeding device with an intermediate conveyor as claimed in claim 1, wherein the image forming device is a stencil printer which has a printing drum for winding a thermal stencil master produced by engraving, and paper that has been fed from the intermediate conveyor is pressed against the thermal stencil master on the printing drum and printed by the feeding of ink from an interior of the printing drum.

* * * * *